US012234692B2

(12) United States Patent
Zhang et al.

(10) Patent No.: US 12,234,692 B2
(45) Date of Patent: Feb. 25, 2025

(54) AUTOMATED APPARATUS FOR OIL FIELD DRILLING AND WORKOVER OPERATIONS

(71) Applicant: SHENGLI OILFIELD SHENGJI PETROLEUM EQUIPMENT CO., LTD., Shandong (CN)

(72) Inventors: Xiqing Zhang, Shandong (CN); Duanguang Zhang, Shandong (CN); Junfang Shen, Shandong (CN); Jidi Yu, Shandong (CN); Qiuling Wang, Shandong (CN); Ye Ji, Shandong (CN); Yang Li, Shandong (CN); Xiaoyu Cui, Shandong (CN); Zhongwei Li, Shandong (CN); Chunli Guan, Shandong (CN); Xiaonan Zhang, Shandong (CN)

(73) Assignee: SHENGLI OILFIELD SHENGJI PETROLEUM EQUIPMENT CO., LTD., Shandong (CN)

( * ) Notice: Subject to any disclaimer, the term of this patent is extended or adjusted under 35 U.S.C. 154(b) by 0 days.

(21) Appl. No.: 18/335,992

(22) Filed: Jun. 15, 2023

(65) Prior Publication Data

US 2024/0018833 A1 Jan. 18, 2024

Related U.S. Application Data

(63) Continuation-in-part of application No. PCT/CN2021/141749, filed on Dec. 27, 2021.

(30) Foreign Application Priority Data

Dec. 28, 2020 (CN) ..... 202023246053.1
Jan. 4, 2021 (CN) ..... 202120001448.0
(Continued)

(51) Int. Cl.
*E21B 19/087* (2006.01)
*E21B 15/00* (2006.01)
(Continued)

(52) U.S. Cl.
CPC ..... *E21B 19/087* (2013.01); *E21B 15/00* (2013.01); *E21B 19/06* (2013.01); *E21B 19/10* (2013.01); *E21B 19/24* (2013.01)

(58) Field of Classification Search
CPC ..... E21B 19/087; E21B 19/06; E21B 19/10; E21B 19/24; E21B 15/00
See application file for complete search history.

(56) References Cited

U.S. PATENT DOCUMENTS 6,926,097 B1 8/2005 Blake
8,935,901 B2 1/2015 Petrello et al.
(Continued)

FOREIGN PATENT DOCUMENTS

CN 102174879 A 9/2011
CN 102359346 A 2/2012
(Continued)

OTHER PUBLICATIONS

First Search of Priority Application in Application No. 2021105031970 dated Jun. 22, 2021 in 2 pages.
(Continued)

*Primary Examiner* — D. Andrews
(74) *Attorney, Agent, or Firm* — Knobbe Martens Olson & Bear LLP

(57) ABSTRACT

The present disclosure provides automated equipment for drilling and workover operations of oil field, and an oil field workover operation device, an integrated hydraulic clamp, a buckling apparatus and a string automated operating apparatus, and a derrick floor pipe handling manipulator for use
(Continued)

in the automated equipment. The automated equipment comprises a workover rig, a derrick floor, an elevator, a monkey-board string automatic placement apparatus, a slip, an oil field workover operation device, a power clamp, and a derrick floor pipe handling manipulator, and the workover rig, the derrick floor, the elevator, the monkey-board string automatic placement apparatus, the slip, the oil field workover operation device, the power clamp, and the derrick floor pipe handling manipulator cooperate with each other to realize a lifting operation and a lowering operation of a string at a wellhead. The workover rig has a derrick, the workover rig is arranged along a front-rear direction of the automated equipment, and the derrick is disposed at a rear end portion of the workover rig and aligned with the wellhead. The derrick floor is placed on the ground and disposed at the wellhead, and the derrick floor is disposed adjacent to the derrick. The oil field workover operation device is positioned on one side of the wellhead in a left-right direction of the automated equipment, and the oil field workover operation device is disposed on the derrick floor in a manner of being movable between a raised position where the oil field workover operation device extends out above the derrick floor and a retreated position where the oil field workover operation device retreats below the derrick floor. The automated equipment in the present disclosure significantly improves operation efficiency of the drilling and workover operations, greatly reduces manual operation strength, and improves safety factor.

20 Claims, 30 Drawing Sheets

(30) Foreign Application Priority Data

| | | |
|---|---|---|
| Jan. 4, 2021 | (CN) | 202120001464.X |
| Jan. 4, 2021 | (CN) | 202120001472.4 |
| May 10, 2021 | (CN) | 202110503197.0 |

(51) Int. Cl.

| | |
|---|---|
| ***E21B 19/06*** | (2006.01) |
| ***E21B 19/10*** | (2006.01) |
| ***E21B 19/24*** | (2006.01) |

(56) References Cited

U.S. PATENT DOCUMENTS

| | | | | |
|---|---|---|---|---|
| 10,844,674 | B2 * | 11/2020 | Berry | E21B 19/20 |
| 2016/0090796 | A1 * | 3/2016 | Roodenburg | E21B 15/02 414/800 |
| 2022/0034176 | A1 * | 2/2022 | Skibsrud | E21B 19/14 |

FOREIGN PATENT DOCUMENTS

| | | | |
|---|---|---|---|
| CN | 103573190 | A | 2/2014 |
| CN | 203822194 | U | 9/2014 |
| CN | 104989296 | A | 10/2015 |
| CN | 204729030 | U | 10/2015 |
| CN | 105239940 | A | 1/2016 |
| CN | 205259958 | U | 5/2016 |
| CN | 205858221 | U | 1/2017 |
| CN | 106948770 | A | 7/2017 |
| CN | 109779542 | A | 5/2019 |
| CN | 209244532 | U | 8/2019 |
| CN | 209324280 | U | 8/2019 |
| CN | 110714730 | A | 1/2020 |
| CN | 110977930 | A | 4/2020 |
| CN | 111502564 | A | 8/2020 |
| WO | WO 2016/118714 | A1 | 7/2016 |
| WO | WO 2022/143559 | A1 | 7/2022 |

OTHER PUBLICATIONS

International Preliminary Report on Patentability in Application No. PCT/CN2021/141749 dated Jul. 4, 2023 in 11 pages.
International Search Report and Written Opinion in Application No. PCT/CN2021/141749 dated Mar. 17, 2022 in 17 pages.
Notification to Grant Patent Right for Invention in Application No. 202110503197.0 dated Jul. 8, 2021 in 3 pages.
Office Action in Application No. 202110503197.0 dated Jun. 28, 2021 in 10 pages.

* cited by examiner

AUTOMATED APPARATUS FOR OIL FIELD DRILLING AND WORKOVER OPERATIONS

CROSS-REFERENCE TO RELATED APPLICATIONS

The present disclosure claims priority to a Chinese patent application No. 202023246053.1 filed with the China National Intellectual Property Administration on Dec. 28, 2020 and entitled "Derrick Floor Pipe Handling Manipulator", a Chinese patent application No. 202120001472.4 filed with the China National Intellectual Property Administration on Jan. 4, 2021 and entitled "Integrated Hydraulic Clamp", a Chinese patent application No. 202110503197.0 filed with the China National Intellectual Property Administration on May 10, 2021 and entitled "Oil Field Workover Operation Device", a Chinese patent application No. 202120001448.0 filed with the China National Intellectual Property Administration on Jan. 4, 2021 and entitled "Buckling Apparatus and String Automated Operating Apparatus", and a Chinese patent application No. 202120001464.X filed with the China National Intellectual Property Administration on Jan. 4, 2021 and entitled "Power Slip for Oil Field Workover Operation", the contents of these patent applications are incorporated herein by reference in entirety.

TECHNICAL FIELD

The present disclosure relates to the technical field of drilling and workover operations of oil field, in particular to automated equipment for drilling and workover operation of oil field, and to an oil field workover operation device, an integrated hydraulic clamp, a buckling apparatus and a string automated operating apparatus, and a derrick floor pipe handling manipulator for use in the automated equipment.

BACKGROUND ART

The drilling and workover operations of oil field are an important link of oil field exploitation, and one important work therein is tripping of tubing, sucker rods, and drill rods. At present, the tripping operation mainly relies on manually pushing and pulling elevator, pushing and pulling hydraulic clamp, pushing and holding derrick floor string, handling the string on a monkey board higher than the ground and so on. Such conventional operation mode not only requires more operators, but also has high manual operation strength and low operation efficiency, and moreover, the manual operation is extremely dangerous.

Screwing on and off apparatuses of a drilling and workover operation automated system mainly have two forms of iron roughneck and automatic hydraulic clamp. The two existing forms both have problems such as complex structure and large volume to a certain extent. Generally, mounting and connection to the derrick floor mainly adopt flange bolt connection, insertion barrel and other manners, and a truck, a crane, and a dedicated base are needed in transportation and installation processes and many people are needed for cooperation, so that transportation costs are high, and the transportation and installation are tedious and time-consuming. After a main body of the device is mounted, hydraulic pipelines and communication cables need to be plugged on site, and the whole mounting process takes a long time. In addition, during intermittent downtime without working for workover, the main body of the device still occupies a space of derrick floor surface, causing inconvenience to other work on the derrick floor.

The workover operation frequently involves operations of screwing on and off strings. When being applied to the workover operation, a suspension-type workover power tong has problems of greater hidden danger of accidents, high labor intensity, and low efficiency of workover operation, and the iron roughneck with relatively high automation degree, when being applied to the workover operation, also has problems of a large volume, a large weight, and low efficiency of screwing on and off the strings. Without a clamp-head leveling apparatus, if an error exists in installation, a problem that the clamp head is not parallel to the horizontal plane may occur.

In the drilling and workover operations, buckling of strings is realized by a string buckling apparatus, wherein a string automated operating apparatus located at a wellhead includes an iron roughneck, a power slip, a hydraulic elevator, and a multi-functional manipulator, and in the drilling and workover operations, a slope angle of the derrick is changed with load changes, so as to cause certain displacement to the power slip, which increases the difficulty for realizing the buckling of strings grabbed by the multi-functional manipulator, and requires manual intervention and adjustment, so that the string buckling efficiency is low. Although the existing apparatus can solve the above problems, the apparatus is complex in structure and occupies a large space, so that the originally cramped derrick floor space is more crowded. Meanwhile, the complex structure also makes it more difficult to repair and maintain the apparatus.

The derrick floor pipe handling is a simple and most frequent operation in the workover operation, and at present, the way of derrick floor pipe handling has been changed from the conventional manual pipe handling to the highly automated mechanical pipe handling, thus the workover operation efficiency is improved. But compared with the manual pipe handling, while realizing high automation, the mechanical pipe handling also has problems of a large device volume and cumbersome disassembly when failure occurs, and when the manual pipe handling is needed in some special technologies or when the device fails, as the device occupies a route where the pipe handling passes, the manual pipe handling has hidden safety risks underfoot, so that the manual pipe handling cannot be carried out, seriously affecting progress of the workover operation.

SUMMARY

The present disclosure provides automated equipment for drilling and workover operations of oil field, so as to solve various technical problems existing in relevant drilling and workover operations.

The automated equipment for drilling and workover operations of oil field provided in the present disclosure may include a workover rig, a derrick floor, an elevator, a monkey-board string automatic placement apparatus, a slip, an oil field workover operation device, a power clamp, and a derrick floor pipe handling manipulator, and the workover rig, the derrick floor, the elevator, the monkey-board string automatic placement apparatus, the slip, the oil field workover operation device, the power clamp, and the derrick floor pipe handling manipulator can cooperate with each other to realize a lifting operation and a lowering operation of a string (i.e., a tubular column or a pipe) at a wellhead. The workover rig may have a derrick, the workover rig can be arranged along a front-rear direction of the automated equipment, and the derrick can be disposed at a rear end portion of the workover rig and aligned with the wellhead. The derrick floor can be placed on the ground and disposed at the wellhead, and the derrick floor can be disposed adjacent to the derrick. The oil field workover operation device can be positioned on one side of the wellhead in a left-right direction of the automated equipment, and the oil field workover operation device can be disposed on the derrick floor in a manner of being movable between a raised position where the oil field workover operation device extends out above the derrick floor and a retreated position where the oil field workover operation device retreats below the derrick floor.

Optionally, in the raised position of the oil field workover operation device, the oil field workover operation device can move between an extended state and a retracted state, in the extended state of the oil field workover operation device, the power clamp connected to the oil field workover operation device can be positioned close to the wellhead so as to screw on and off the string positioned at the wellhead, and in the retracted state of the oil field workover operation device, the power clamp connected to the oil field workover operation device can be positioned away from the wellhead, and in the retreated position of the oil field workover operation device, the oil field workover operation device can be in the retracted state of the oil field workover operation device.

Optionally, the derrick floor can be provided thereon with a string storage portion for receiving the string, the derrick floor pipe handling manipulator can move between a first position away from the slip and a second position close to the slip, and in the second position of the derrick floor pipe handling manipulator, the derrick floor pipe handling manipulator can be configured to grab the string, and the derrick floor pipe handling manipulator can rotate between a facing position facing the slip and a back position facing back to the slip, and in the facing position of the derrick floor pipe handling manipulator, the derrick floor pipe handling manipulator can be used to grab the string located at the slip, and in the back position of the derrick floor pipe handling manipulator, the derrick floor pipe handling manipulator can be used to grab the string located at the string storage portion.

Optionally, the automated equipment further may include a buckling apparatus for realizing buckling of the strings, and the buckling apparatus can be connected to the slip.

Optionally, the monkey-board string automatic placement apparatus may include a fingerboard bank for receiving the string, the monkey-board string automatic placement apparatus further may include a monkey-board manipulator, and the monkey-board manipulator can be used to push the string into the fingerboard bank or take the string from the fingerboard bank.

Optionally, the automated equipment further may include:

a driller centralized control operating apparatus, wherein the driller centralized control operating apparatus can be fixed on the derrick floor and positioned on the left of the derrick floor pipe handling manipulator in the left-right direction of the automated equipment, and the driller centralized control operating apparatus can be configured to realize the lowering operation and the lifting operation of the automated equipment on the string by sending instructions to the automated equipment; and a hydraulic station, wherein the hydraulic station can be mounted on the derrick floor and located below the driller centralized control operating apparatus, and the hydraulic station can be used to provide power to the automated equipment.

Optionally, the elevator may include an elevator main body and a bushing, and the elevator main body can be overturned, so that the string enters the bushing of the elevator, to clamp the string.

Optionally, the automated equipment further may include a power catwalk positioned on the ground, the power catwalk and the workover rig can be positioned on two opposite sides of the wellhead in the front-rear direction of the automated equipment, and the power catwalk can be used to transport the string from the ground to the derrick floor and to transport the string from the derrick floor to the ground.

Optionally, the derrick floor may include a first derrick floor, a second derrick floor, and a third derrick floor, wherein the slip, the oil field workover operation device, and the derrick floor pipe handling manipulator can be mounted on the first derrick floor, the string storage portion can be located on the second derrick floor; and the driller centralized control operating apparatus and the hydraulic station can be mounted on the third derrick floor.

Optionally, the slip may include a slip housing, a slip assembly, a slip front stop, a first transmission rod, a connecting shaft, a drive member, and a second transmission rod, wherein the slip front stop can be mounted on the slip housing, the slip assembly can be attached to the slip housing and the slip front stop, and the drive member can be connected to the slip assembly through the first transmission rod, the connecting shaft, and the second transmission rod.

Optionally, the slip housing may include a slip body lug, and the slip assembly includes a slip insert, a slip bowl, and a connecting lug, wherein the slip body lug can be used to receive the connecting shaft, the slip insert can be used to clamp the string, the slip bowl can shrink and expand, and the drive member can be connected to the slip assembly through the first transmission rod, the connecting shaft, the second transmission rod, and the connecting lug.

The automated equipment for drilling and workover operations of oil field provided in the present disclosure can at least partially realize unmanned drilling and workover operations, significantly improve operation efficiency of the drilling and workover operations, greatly reduce manual operation strength, and improve safety factor.

The present disclosure further provides an oil field workover operation device, so as to alleviate a technical problem of long time of on-site installation of the derrick floor and a screwing on and off apparatus in related art.

The oil field workover operation device provided in the present disclosure may include: the first derrick floor, a lifting apparatus, and a screwing on and off apparatus, wherein the first derrick floor may include a derrick floor panel, and an avoidance hole is formed in the derrick floor panel;

the lifting apparatus can be mounted below the derrick floor panel, the lifting apparatus may include a platform base, a guide stand column group, a lifting platform, and a lifting drive mechanism, wherein the guide stand column group can be fixedly connected between the platform base and the derrick floor panel; the lifting platform can be slidably connected to the guide stand column group; the lifting driving mechanism can be in transmission connection with the lifting platform for driving the lifting platform to be lifted up and down along the guide stand column group; and the screwing on and off apparatus can be mounted on the lifting platform, and the lifting platform can drive the screwing on and off apparatus to extend out of or retreat to the avoidance hole.

Optionally, the lifting drive mechanism can be arranged in two groups and opposite to each other;

the lifting drive mechanism may include a lifting motor, a transmission component, and a lead screw, wherein two groups of lead screws can be provided and arranged parallel to the guide stand column group, and the lifting motor can be connected to the two groups of lead screws respectively through the transmission component;

the lifting platform can be in transmission connection with the lead screws, and the lifting motor can drive the lead screws to rotate through the transmission component, so as to make the lifting platform move along axes of the lead screws.

Optionally, the transmission component may include an angular transmission box, a coupling, and a worm gear mechanism;

the angular transmission box can be in transmission connection with the lifting motor, and the angular transmission box can be connected between two groups of couplings, and the couplings are arranged perpendicular to the lead screws;

the worm gear mechanism can be provided in two groups, and each worm gear mechanism can be in transmission connection between the coupling and the lead screw.

Optionally, the guide stand column group may include four guide stand columns, and the four guide stand columns can be arranged in a rectangular shape;

the lifting platform may include two groups of guide cylinders and a track group fixedly connected between the two groups of guide cylinders; and the guide cylinders can be slidably sleeved on two guide stand columns located on the same side.

Optionally, a translation apparatus can be provided between the lifting platform and the screwing on and off apparatus;

the translation apparatus may include a translation drive cylinder and a movable trolley in transmission connection, the translation drive cylinder can be mounted on the guide cylinder, the movable trolley can be movably arranged on the track group, and the translation drive cylinder can be used to drive the movable trolley to move between the two groups of guide cylinders; and the avoidance hole can be a long hole, and an extension direction of the long hole can be the same as a moving direction of the movable trolley.

Optionally, the screwing on and off apparatus may include a rotating mechanism, a lifting fine-tuning mechanism, a telescoping mechanism, and a screwing on and off mechanism;

the rotating mechanism can be mounted on the movable trolley; and the lifting fine-tuning mechanism is mounted on an output end of the rotating mechanism;

the telescoping mechanism can be mounted on an output end of the lifting fine-tuning mechanism; and the screwing on and off mechanism can be mounted on an output end of the telescoping mechanism.

Optionally, the lifting fine-tuning mechanism may include a lifting guide track, a lifting pulley, a rack, a gear, and a lifting motor;

the lifting guide track can be fixedly connected to the output end of the rotating mechanism; the lifting pulley can be slidably connected to the lifting guide track;

the rack can be fixedly connected to the lifting guide track and be meshed with the gear; the gear can be pivotally connected to the lifting pulley and be in transmission connection with the lifting motor, and the lifting motor can drive the lifting pulley to move along the lifting guide track; and the telescoping mechanism can be mounted on the lifting pulley.

Optionally, in a process that the screwing on and off apparatus extends out of the avoidance hole, a projection area thereof on the horizontal plane is not larger than a projection area of the avoidance hole, and the lifting guide track penetrates through the avoidance hole;

a first cover plate and a second cover plate can be provided at the avoidance hole, and the first cover plate can cover a part of the avoidance hole at two sides of the lifting guide track; and an area of plate surfaces of the first cover plate and the second cover plate can be adapted to an aperture area of the avoidance hole.

Optionally, the telescoping mechanism may include a scissor-type cross component and a telescoping hydraulic cylinder;

the scissor-type cross component can be hinged between the lifting pulley and the screwing on and off mechanism, and the telescoping hydraulic cylinder can be in transmission connection with the scissor-type cross component, for driving the scissor-type cross component to extend and retract.

Optionally, the screwing on and off mechanism may include a bracket, a cantilever, a shifting mechanism, and a hydraulic clamp;

the bracket can be connected to one end of the scissor-type cross component away from the lifting pulley;

the cantilever can be fixedly connected to a top end of the bracket;

the shifting mechanism can be mounted on the hydraulic clamp; and the hydraulic clamp can be hinged to the cantilever.

Beneficial effects are as follows.

According to the oil field workover operation device provided in the present disclosure, the first derrick floor includes the derrick floor panel, and the avoidance hole is formed in the derrick floor panel; the lifting apparatus is mounted below the derrick floor panel, the lifting apparatus includes the platform base, the guide stand column group, the lifting platform, and the lifting drive mechanism, wherein the guide stand column group is fixedly connected between the platform base and the derrick floor panel; the lifting platform is slidably connected to the guide stand column group; the lifting driving mechanism is in transmission connection with the lifting platform, and the lifting driving mechanism can drive the lifting platform to be lifted up and down along the guide stand column group, and as the screwing on and off apparatus is mounted on the lifting platform, the lifting platform can drive the screwing on and off apparatus to be lifted so as to extend out of or retreat to the avoidance hole, specifically, when in use, the screwing on and off apparatus can be made to extend out of the avoidance hole so as to facilitate use, and when not in use, the screwing on and off apparatus can be made to retreat to the avoidance hole, facilitating storage and transportation. It can be seen that the oil field workover operation device integrates the screwing on and off apparatus to the first derrick floor, then when in use, on-site installation is not required, and installation time is saved; meanwhile, overall transportation is realized, and the transportation is also relatively convenient.

The present disclosure further provides an integrated hydraulic clamp, which can realize position floating of a hydraulic clamp body, and further ensures that the hydraulic clamp body can be fitted to the string.

The integrated hydraulic clamp provided in the present disclosure may include: the hydraulic clamp body, a floating deflection device, and a movable bracket; and the floating deflection device can be connected to the movable bracket, and the hydraulic clamp body can be mounted on the floating deflection device.

Optionally, the floating deflection device may include: a floating mounting frame and a spring sleeve, one end of the spring sleeve is connected to the movable bracket, the other end of the spring sleeve is connected to the floating mounting frame, and the hydraulic clamp body is mounted on the floating mounting frame.

Optionally, the floating deflection device further may include a floating barrel fixing seat, the floating barrel fixing seat may be mounted on the movable bracket, and the floating mounting frame is slidably connected to the floating barrel fixing seat.

Optionally, a tackle may be mounted on the floating mounting frame, the tackle may be fitted to the floating barrel fixing seat, and the tackle can roll along the floating barrel fixing seat.

Optionally, a top portion of the hydraulic clamp body can be hinged with the floating mounting frame, and a tension spring can be disposed between the hydraulic clamp body and the floating barrel fixing seat.

Optionally, the spring sleeve can be connected to the floating mounting frame through a pin shaft, and the pin shaft can be slidably connected to the floating barrel fixing seat.

Optionally, the floating barrel fixing seat may include: a sliding frame and a stand column, the sliding frame is mounted in a top portion of the stand column, the floating mounting frame is slidably connected to the sliding frame, and the stand column is provided with a chamber for accommodating the spring sleeve.

Optionally, the movable bracket may include a telescoping boom, and the floating deflection device can be connected to the telescoping boom.

Optionally, the movable bracket further may include a lifting pulley, and the telescoping boom can be mounted at a movable end of the lifting pulley.

Optionally, the movable bracket further may include a transportation base, and the lifting pulley can be mounted on the transportation base.

The embodiments of the present disclosure bring about the following beneficial effects: by connecting the floating deflection device to the movable bracket, and mounting the hydraulic clamp body to the floating deflection device, the hydraulic clamp body is allowed to have position floating amount through the floating deflection device, and when the position of the string floats slightly at the wellhead, the hydraulic clamp body still can be fitted to the string, further ensuring the smooth progress of the workover operations.

The present disclosure further provides a buckling apparatus and a string automated operating apparatus, so as to alleviate a technical problem that the apparatus for realizing buckling of strings in the related art is complex in structure.

The buckling apparatus provided in the present disclosure may include: a slip component, a drive member, and a pipe centralizing component; and the pipe centralizing component can be movably connected to the slip component, the drive member can be connected to the slip component and be in transmission connection with the pipe centralizing component, and the drive member can be used to drive the pipe centralizing component, so that an axis of a string in the pipe centralizing component coincides with an axis of a string fixed in the slip component.

Optionally, the pipe centralizing component may include a pipe centralizing arm and a pipe centralizing hand; and the pipe centralizing arm can be movably connected to the slip component and be in transmission connection with the drive member, and the pipe centralizing hand can be connected to one end of the pipe centralizing arm away from the drive member, for guiding buckling of the string.

Optionally, the pipe centralizing arm can be rotatably connected to the slip component.

Optionally, the slip component may include a fixing seat, the slip, and a positioning plate, and the fixing seat, the slip, and the drive member are all connected to the positioning plate; and the pipe centralizing arm can be rotatably connected to the fixing seat through a rotating shaft, and the drive member can drive the pipe centralizing arm to rotate around the axis of the rotating shaft.

Optionally, the pipe centralizing arm may include a transmission arm and a supporting arm that are connected at an angle; and the transmission arm can be rotatably connected to the fixing seat through the rotating shaft, the drive member can be in transmission connection with the transmission arm, one end of the transmission arm away from the drive member can be connected to one end of the supporting arm, and the other end of the supporting arm can be connected to the pipe centralizing hand.

Optionally, the pipe centralizing hand can be detachably connected to the supporting arm.

Optionally, the pipe centralizing hand may be a half cylinder, an inner wall of the pipe centralizing hand can be provided with a clamping platform, and the clamping platform can be used to block the string fixed in the slip component.

Optionally, the pipe centralizing hand may include a semi-cylindrical barrel and a semi-horn barrel; and a diameter of a first end of the semi-horn barrel can be smaller than a diameter of a second end of the semi-horn barrel, the first end of the semi-horn barrel can be connected to the semi-cylindrical barrel, and the clamping platform can be located at a joint of the semi-cylindrical barrel and the semi-horn barrel.

Optionally, the drive member can be in transmission connection with the pipe centralizing arm through a connecting rod, and the connecting rod is vertically connected to the drive member and the pipe centralizing arm respectively.

The string automated operating apparatus provided in the present disclosure may include the buckling apparatus.

Compared with the related art, the buckling apparatus and the string automated operating apparatus provided in the present disclosure have the following technical advantages.

The buckling apparatus provided in the present disclosure includes the slip component, the drive member, and the pipe centralizing component, wherein the pipe centralizing component is movably connected to the slip component, the drive member is connected to the slip component and in transmission connection with the pipe centralizing component, and the drive member is used to drive the pipe centralizing component, so that an axis of the string in the pipe centralizing component coincides with an axis of the string fixed in the slip component.

The buckling apparatus provided in the present disclosure has the following merits.

In the present disclosure, the pipe centralizing component is movably connected to the slip component, and the two are integrated into one body, and when the slip component has displacement changes with the derrick, the pipe centralizing component connected thereto moves synchronously therewith; when the drive member is started, the drive member can drive the pipe centralizing component to move, after the drive member drives for a certain period of time, an axis of a free end of the pipe centralizing component coincides with the axis of the string in the slip component, and at this time, a multi-functional manipulator of the derrick floor grabs the string and places the string into the free end of the pipe centralizing component, so that the axis of the string in the pipe centralizing component coincides with the axis of the string in the slip component, thus realizing accurate buckling of two strings. It can thus be seen that, when the buckling apparatus operates, relative positions of the pipe centralizing component and the slip component are unchanged, so that a problem of inaccurate buckling of the strings caused by the displacement change of the slip component is eliminated, meanwhile, the buckling of the strings can be realized through cooperation of the slip component, the drive member, and the pipe centralizing component with each other, which simplifies the structure of the buckling apparatus, thus a space occupied by the buckling apparatus is reduced, and the buckling apparatus is easy to maintain and repair due to the simple structure.

The string automated operating apparatus provided in the present disclosure includes the buckling apparatus, thus, technical advantages achieved by the string automated operating apparatus include the technical advantages and effects achieved by the above buckling apparatus, and are not repeated again.

The present disclosure further provides a derrick floor pipe handling manipulator, so as to alleviate a technical problem that manual pipe arrangement cannot be carried out when a mechanical pipe arranging device fails in the related art.

The derrick floor pipe handling manipulator provided in the present disclosure may include: a trolley feeding mechanism, a base, a rotating mechanism, a boom mechanism, a clamping jaw mechanism, and a first drive member;

the trolley feeding mechanism can be slidably connected to the base, the base may include a first base and a second base, the first base and the second base can be detachably connected, the first drive member can be connected to the first base and be in transmission connection with the trolley feeding mechanism;

a bottom end of the rotating mechanism can be connected to the trolley feeding mechanism, a top end of the rotating mechanism can be in transmission connection with the boom mechanism, and a free end of the boom mechanism can be connected with the clamping jaw mechanism.

Optionally, the first base can be provided with a first clamping member, the second base can be provided with a second clamping member adapted to the first clamping member, and the first base and the second base are connected through a bolt.

Optionally, the base can be provided thereon with a track, two ends of the track both can be provided with a limiting part, and the limiting part can be used to restrict a sliding range of the trolley feeding mechanism.

Optionally, the first drive member can use a hydraulic cylinder, a cylinder body of the hydraulic cylinder can be hinged with the first base, and a drive end of the hydraulic cylinder can be hinged with the trolley feeding mechanism.

Optionally, the clamping jaw mechanism may include a second drive member, a first link rod, a second link rod, two third link rods, and two curved rods, the curved rods can be in a bent shape, and openings of the two curved rods can be disposed opposite to each other; and the second drive member can be mounted on the boom mechanism and be in transmission connection with the first link rod, and two ends of the first link rod can be respectively hinged with one end of the two third link rods, the other ends of the two third link rods can be correspondingly hinged to bent parts of the two curved rods respectively, the second link rod can be connected to the boom mechanism, and two ends of the second link rod can be respectively hinged to one end of the two curved rods close to the first link rod, the other ends of the two curved rods can move close to or away from each other under driving of the third link rods, so that the other ends of the two curved rods are in a fully opened state, a half opened and half closed state, or a fully closed state.

Optionally, a plurality of rollers can be provided on the curved rods, and when the curved rods clamp the string, the plurality of rollers can be in rolling fit with the string.

Optionally, the boom mechanism may include a supporting boom, a telescoping boom, and a third drive member; and one end of the supporting boom can be connected to the rotating mechanism, and the other end can be hinged with a first end of the telescoping boom, a second end of the telescoping boom can be connected to the clamping jaw mechanism, and the third drive member can be hinged with the supporting boom and be in transmission connection with the telescoping boom.

Optionally, the second end of the telescoping boom can be provided with a buffer mechanism, and the buffer mechanism may include a buffer rod, a supporting rod, a supporting base, and a buffer spring; and the buffer rod can be connected to one end of the supporting rod, and the supporting rod can be slidably connected to the supporting base, the supporting base can be connected to the telescoping boom, the buffer spring can be sleeved on the supporting rod, and two ends of the buffer spring can abut against the buffer rod and the supporting base respectively, when the clamping jaw mechanism clamps the string, the buffer rod is impacted by the string, and the buffer spring may have a tendency to make the string move in a direction away from the telescoping boom.

Optionally, an induction rod can be connected to the supporting rod, and the telescoping boom can be provided with a proximity switch, then when the buffer rod is impacted by the string, the proximity switch can be triggered due to contact with the induction rod.

Optionally, the rotating mechanism may include a rotating base, a rotating component, a decelerator, and a fourth drive member; and the rotating base can be mounted on the trolley feeding mechanism, and be rotatably connected to the rotating component, and the rotating component can be connected to the boom mechanism, and be in transmission connection with the decelerator, and the decelerator can be connected to the rotating base, and be in transmission connection with the fourth drive member.

Compared with the related art, the derrick floor pipe handling manipulator provided in the present disclosure has the following technical advantages.

The derrick floor pipe handling manipulator provided in the present disclosure includes the trolley feeding mechanism, the base, the rotating mechanism, the boom mechanism, the clamping jaw mechanism, and the first drive member, wherein the trolley feeding mechanism is slidably connected to the base, the base includes the first base and the second base, the first base and the second base are detachably connected, the first drive member is connected to the first base and in transmission connection with the trolley feeding mechanism, the bottom end of the rotating mechanism is connected to the trolley feeding mechanism, the top end of the rotating mechanism is in transmission connection with the boom mechanism, and the free end of the boom mechanism is connected with the clamping jaw mechanism.

The derrick floor pipe handling manipulator provided in the present disclosure has the following merits.

In the present disclosure, when the derrick floor pipe handling manipulator operates in the operation area, the first drive member is started and drives the trolley feeding mechanism to slide on the first base and the second base, the trolley feeding mechanism synchronously drives the rotating mechanism, the boom mechanism, and the clamping jaw mechanism to move, the rotating mechanism drives the clamping jaw mechanism to rotate through the boom mechanism, thus, with the cooperation of the first drive member and the rotating mechanism, the clamping jaw mechanism can move to a position where the string is located, and then the string is grabbed or released by the jaw mechanism. When the derrick floor pipe handling manipulator fails, the trolley feeding mechanism can be driven by the first drive member to slide to the first base, then the second base is detached from the first base, so that a space occupied by the derrick floor pipe handling manipulator in the operation area is reduced, a path is provided for the manual pipe handling, and meanwhile, potential safety risks underfoot during the manual pipe handling are also eliminated, so that the manual pipe handling can still be carried out in cases where the derrick floor pipe handling manipulator fails, thereby ensuring normal progress of the workover operations.

BRIEF DESCRIPTION OF DRAWINGS

In order to more clearly illustrate the technical solutions in specific embodiments of the present disclosure or the related art, drawings which need to be used in the description of the specific embodiments or the related art will be introduced briefly below, and apparently, the drawings in the following description merely show some embodiments of the present disclosure, and a person ordinarily skilled in the art still could obtain other drawings in light of these drawings without using any inventive efforts.

FIG. 51A, FIG. 51B, FIG. 51C and FIG. 51D show flowcharts of realizing a lowering operation of a string by the automated equipment for drilling and workover operations of oil field provided in an embodiment of the present disclosure, in which FIG. 51A shows the step of preparation, FIG. 51B shows the step of taking out the string; FIG. 51C shows the step of conveying the string; and FIG. 51D shows the steps of screwing on the string and lowering down the string.

REFERENCE SIGNS

Figure 1:
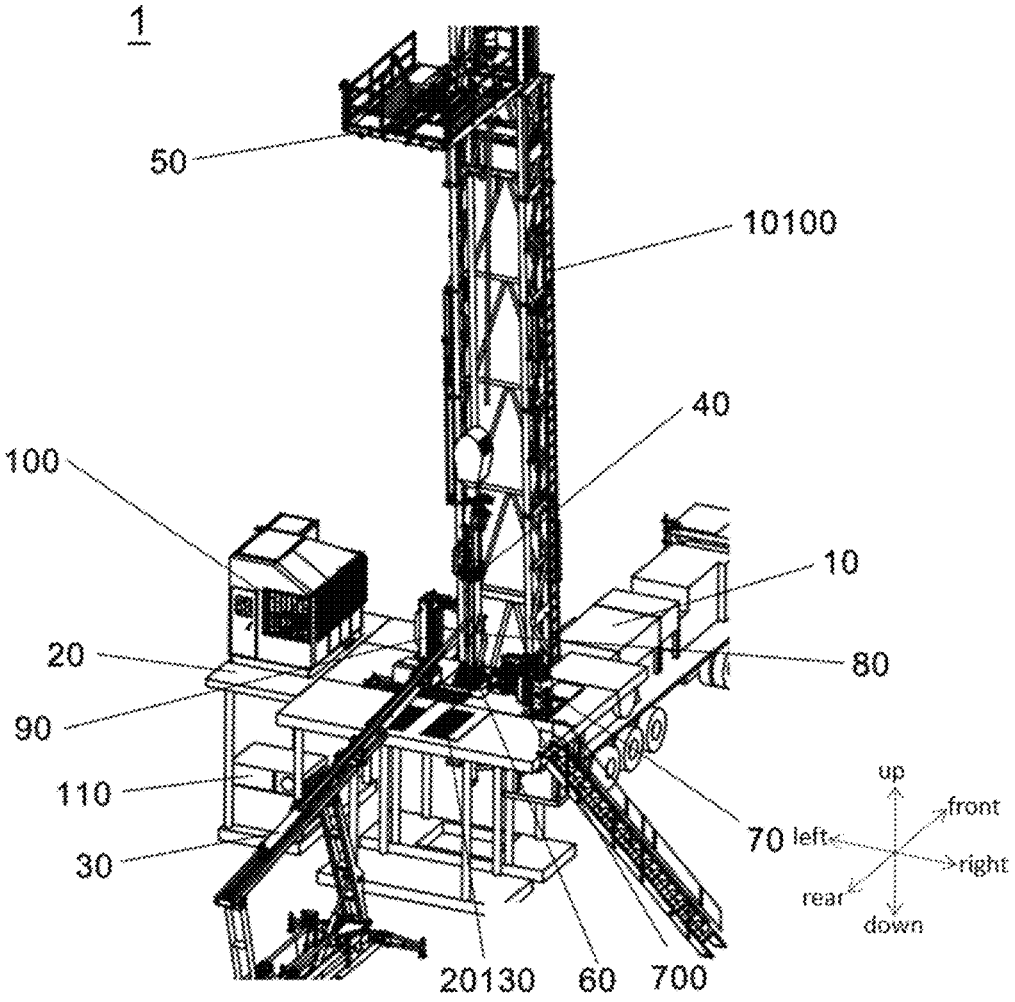
FIG. 1 is a structural schematic perspective diagram of automated equipment for drilling and workover operations of oil field provided in an embodiment of the present disclosure.

1—automated equipment for drilling and workover operations of oil field; 10—workover rig; 20—derrick floor; 30—power catwalk; 40—elevator; 50—monkey-board string automatic placement apparatus; 60—slip; 70—oil field workover operation device; 80—buckling apparatus; 90—derrick floor pipe handling manipulator; 100—driller centralized control operating apparatus; 110—hydraulic station; 1000—string;

10100—derrick;

20100—first derrick floor; 20110—second derrick floor; 20120—third derrick floor; 20130—string storage portion;

30100—mechanical system; 30110—hydraulic system; 30120—electrical system; 30101—base; 30102—hoisting mechanism; 30103—transporting mechanism; 30104—loading and unloading mechanism; 301010—bracket assembly; 301011—jack leg; 301020—front rotating arm; 301021—rear rotating arm; 301022—hoisting hydraulic cylinder; 301030—bearing platform; 301031—secondary telescoping mechanism; 301032—turnover trough; 301033—sliding shoe trough; 301034—secondary telescoping hydraulic cylinder; 301035—sliding shoe hydraulic cylinder; 301036—turnover hydraulic cylinder; 301040—loading frame; 301041—rotating arm; 301042—loading hydraulic cylinder;

40100—main body; 40110—valve; 40120—latch; 40130—bushing; 40140—turnover mechanism;

50100—monkey board and fingerboard mechanism; 50110—electrical control box; 50120—jaw opening mechanism; 50130—monkey board; 50140—monkey-board manipulator; 50150—rotating mechanism of the monkey-board manipulator; 50160—traveling drive mechanism; 501401—clamping jaw arm; 501402—middle guide track; 501403—manipulator base; 501404—jaw opening mechanism; 501405—push rod mechanism;

60100—slip housing; 60110—slip assembly; 60120—slip front stop; 60130—first transmission rod; 60140—connecting shaft; 60150—drive member; 60160—second transmission rod; 601001—slip body lug; 601101—slip insert; 601102—slip bowl; 601103—connecting lug;

20100—first derrick floor; 70110—derrick floor panel; 70120—derrick floor bottom plate; 70130—supporting column; 70140—first cover plate; 70150—second cover plate; 70111—avoidance hole;

70200—lifting apparatus; 70210—platform base; 70220—guide stand column; 70230—lifting platform; 70240—lifting motor; 70250—lead screw; 70260—angular transmission box; 70270—coupling; 70280—worm gear mechanism; 70231—guide cylinder; 70232—track;

70310—translation drive cylinder; 70320—movable trolley;

70400—screwing on and off apparatus; 70410—rotating mechanism; 70420—lifting fine-tuning mechanism; 70430—telescoping mechanism; 70440—screwing on and off mechanism; 70421—lifting guide track; 70422—lifting pulley; 70423—rack; 70424—gear; 70425—lifting motor; 70431—scissor-type cross component; 70432—telescoping hydraulic cylinder; 70441—bracket; 70442—cantilever; 70443—shifting mechanism; 70444—hydraulic clamp;

700100—hydraulic clamp body; 700200—floating deflection device; 700210—floating mounting frame; 700211—tackle; 700220—spring sleeve; 700230—floating barrel fixing seat; 700231—sliding frame; 700232—stand column; 700240—pin shaft; 700300—movable bracket; 700310—telescoping boom; 700320—lifting pulley; 700330—transportation base; 700400—tension spring;

80100—slip component; 80110—fixing seat; 80130—positioning plate;

80200—drive member;

80300—pipe centralizing component; 80310—pipe centralizing arm; 80311—transmission arm; 80312—supporting arm; 80320—pipe centralizing hand; 80321—clamping platform; 80322—semi-cylindrical barrel; 80323—semi-horn barrel;

80400—connecting rod;

90100—trolley feeding mechanism; 90110—feeding trolley; 90120—first holding plate; 90130—supporting framework;

90200—base; 90210—first base; 90211—first clamping member; 90220—second base; 90221—second clamping member; 90230—track;

90300—rotating mechanism; 90310—rotating base; 90320—rotating component; 90321—supporting frame; 90322—second holding plate; 90330—decelerator; 90340—fourth drive member; 90350—hydraulic transducer;

90400—boom mechanism; 90410—supporting boom; 90420—telescoping boom; 90430—third drive member;

90500—clamping jaw mechanism; 90510—second drive member; 90520—first link rod; 90530—second link rod; 90540—third link rod; 90550—curved rod; 90560—roller;

90600—first drive member;

90700—buffer mechanism; 90710—buffer rod; 90720—supporting rod; 90730—supporting base; 90731—first supporting base; 90732—second supporting base; 90740—buffer spring; 90750—induction rod; 90760—proximity switch; 90770—locking nut.

DETAILED DESCRIPTION OF EMBODIMENTS

In order to make objectives, technical solutions, and advantages of the embodiments of the present disclosure clearer, the technical solutions in the embodiments of the present disclosure will be described clearly and completely below with reference to drawings in the embodiments of the present disclosure, and apparently, the embodiments described are some but not all embodiments of the present disclosure. Generally, components in the embodiments of the present disclosure, as described and shown in the drawings herein, may be arranged and designed in various different configurations.

Therefore, the following detailed description of the embodiments of the present disclosure provided in the drawings is not intended to limit the claimed scope of the present disclosure, but merely illustrates chosen embodiments of the present disclosure. All of other embodiments obtained by those of ordinary skill in the art based on the embodiments of the present disclosure without using any inventive efforts shall belong to the scope of protection of the present disclosure.

It should be noted that similar reference signs and letters represent similar items in the following drawings, therefore, once a certain item is defined in one drawing, it is not needed to be defined or explained in subsequent drawings.

In the description of the present disclosure, it should be noted that orientation or positional relationships indicated by the terms such as "center", "upper", "lower", "left", "right", "vertical", "horizontal", "inner", and "outer" are based on orientation or positional relationships as shown in the drawings, or orientation or positional relationships of a product of the present disclosure conventionally placed when in use, merely for facilitating describing the present disclosure and simplifying the description, rather than indicating or suggesting that related apparatuses or elements have to be in the specific orientation, or configured or operated in a specific orientation, therefore, they should not be construed as limiting the present disclosure. Besides, the terms such as "first", "second", and "third" are merely for distinguishing the description, but should not be construed as indicating or implying importance in the relativity.

Besides, the terms "horizontal", "vertical" and the like do not mean that the parts are required to be absolutely horizontal or overhanging, but may be slightly inclined. For example, by "horizontal" it merely means that a structure is more horizontal in comparison with "vertical", rather than being completely horizontal, while the structure can be slightly inclined.

In the description of the present disclosure, it should be further noted that, unless otherwise specifically regulated and defined, the terms "set", "install", "link", and "connect" should be understood in a broad sense, for example, a connection may be a fixed connection, a detachable connection, or an integrated connection; it may be a mechanical connection or an electrical connection; it may be direct joining or indirect joining through an intermediary, and it also may be inner communication between two elements. For a person ordinarily skilled in the art, the specific meanings of the above-mentioned terms in the present disclosure could be construed in accordance with specific circumstances.

Hereinafter, some embodiments of the present disclosure will be described in detail with reference to the drawings. The following embodiments and the features in the embodiments may be combined with each other without conflict.

Figure 2:
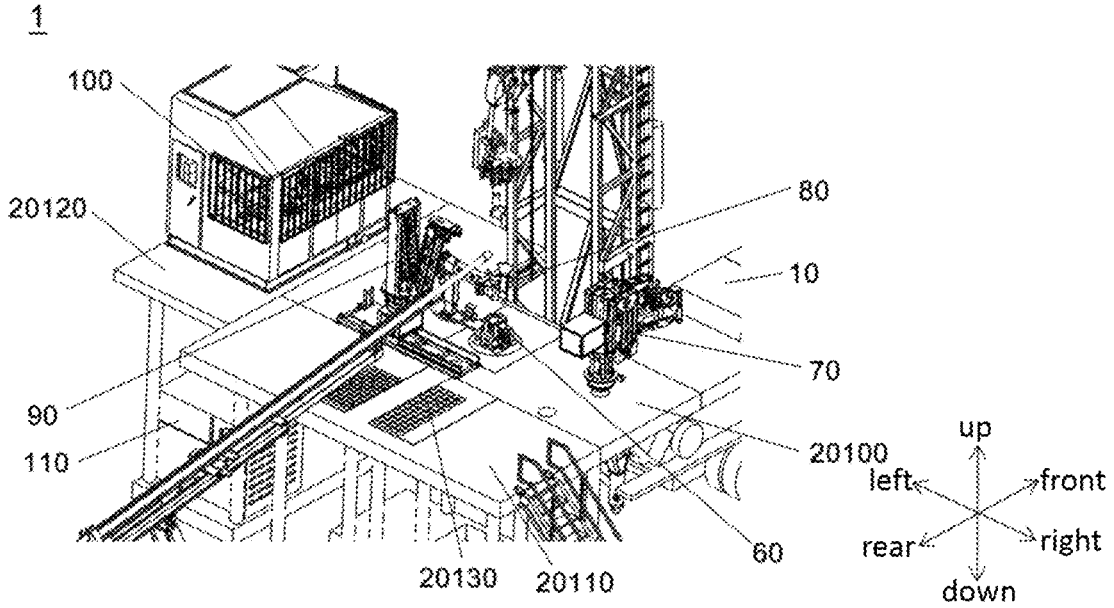
FIG. 2 is a structural schematic enlarged perspective diagram of the automated equipment for drilling and workover operations of oil field provided in an embodiment of the present disclosure.

First, automated equipment 1 for drilling and workover operations of oil field according to an exemplary embodiment of the present disclosure is illustrated with reference to FIG. 1 and FIG. 2. FIG. 1 is a structural schematic perspective diagram of the automated equipment 1 for drilling and workover operations of oil field provided in an embodiment of the present disclosure. FIG. 2 is a structural schematic enlarged perspective diagram of the automated equipment 1 for drilling and workover operations of oil field provided in an embodiment of the present disclosure.

As shown in FIG. 1 and FIG. 2, the automated equipment 1 for drilling and workover operations of oil field according to an exemplary embodiment of the present disclosure can be used to realize a lifting operation and a lowering operation of a string 1000 (shown in FIG. 3B and FIG. 4A to FIG. 4B) at a wellhead, wherein the string 1000 may have a first end portion and a second end portion. In an exemplary embodiment shown, the automated equipment 1 may include a workover rig 10, a derrick floor 20, an elevator 40, a monkey-board string automatic placement apparatus 50, a slip 60, an oil field workover operation device 70, a power clamp 700, and a derrick floor pipe handling manipulator 90.

In an exemplary embodiment of the present disclosure, the workover rig 10 may have a derrick 10100. In an exemplary embodiment shown, the workover rig 10 can be arranged along a front-rear direction of the automated equipment 1. In some embodiments, the derrick 10100 can be disposed at a rear end portion of the workover rig 10 and aligned with the wellhead.

In an exemplary embodiment shown, the derrick floor 20 can be placed on the ground and disposed at the wellhead. In some embodiments of the present disclosure, the derrick floor 20 can be disposed adjacent to the derrick 10100. The derrick floor 20 can be provided with a string storage portion 20130 for receiving the first end portion of the string. In some optional embodiments, the string storage portion 20130 may be a recess in an upper portion of the derrick floor 20. By way of example and not limitation, the string storage portion 20130 may be a separate part arranged on an upper surface of the derrick floor 20. In addition, a plurality of string storage portions 20130 can be provided, the plurality of string storage portions 20130 can be divided into one or more groups, and each group can be disposed at a different position of the derrick floor 20. In an optional embodiment of the present disclosure, the derrick floor 20 may include a first derrick floor 20100, a second derrick floor 20110, and a third derrick floor 20120, the slip 60, the oil field workover operation device 70, and the derrick floor pipe handling manipulator 90 can be mounted on the first derrick floor 20100, and the string storage portions 20130 can be located on the second derrick floor 20110.

According to an embodiment shown in the present disclosure, the elevator 40 can be connected to the derrick 10100, and the elevator 40 can be configured to move up and down along the derrick 10100 above the wellhead. In some exemplary embodiments, the elevator 40 can be configured to lift up and lower down the string along the derrick 10100 by clamping the string 1000.

In an exemplary embodiment of the present disclosure, the monkey-board string automatic placement apparatus 50 can be mounted on the derrick 10100 and positioned above the derrick floor 20. According to some embodiments of the present disclosure, the monkey-board string automatic placement apparatus 50 may include a fingerboard bank for receiving the second end portion of the string. The monkey-board string automatic placement apparatus 50 can be configured to push the second end portion of the string into the fingerboard bank or take the second end portion of the string from the fingerboard bank.

In an exemplary embodiment shown, the slip 60 can be mounted on the derrick floor 20 and positioned above the wellhead, the slip 60 can be configured to be switchable between a closed position where the slip 60 clamps the string so as to prevent the string 1000 from moving through, and an opened position where the slip 60 is opened so as to allow the string 1000 to move through.

In some exemplary embodiments of the present disclosure, the oil field workover operation device 70 can be mounted on the derrick floor 20 and positioned on one side of the wellhead in a left-right direction of the automated equipment 1.

In an exemplary embodiment shown, the oil field workover operation device 70 can be connected to the power clamp 700, and the power clamp 700 can be configured to screw on and off the string 1000. It should be indicated that in some optional embodiments of the present disclosure, the power clamp 700 may be an integrated hydraulic clamp, but is not limited thereto, for example, the power clamp 700 can be electrically driven.

In an embodiment shown in the present disclosure, the derrick floor pipe handling manipulator 90 can be mounted on the derrick floor 20, and the derrick floor pipe handling manipulator 90 and the oil field workover operation device 70 can be positioned on two opposite sides of the wellhead in a left-right direction of the automated equipment 1. The derrick floor pipe handling manipulator 90 can be used to grab the string 1000 on which the lifting operation or the lowering operation is to be performed and convey the string 1000.

According to an exemplary embodiment of the present disclosure, the automated equipment 1 further may include a buckling apparatus 80, wherein the buckling apparatus 80 can be mounted on the derrick floor 20 and can be positioned around the wellhead, and the buckling apparatus 80 can be used to realize buckling of the strings 1000. In some embodiments, the buckling apparatus 80 can be mounted on the first derrick floor 20100.

According to the automated equipment 1 of an exemplary embodiment of the present disclosure, in the lowering operation of the string 1000, the monkey-board string automatic placement apparatus 50 grabs the second end portion of the string 1000 on which the lowering operation is to be performed, and takes the string 1000 from the fingerboard bank by grasping the second end portion of the string 1000 and conveys the string to the elevator 40; when the string 1000 is conveyed to the elevator 40, the elevator 40 clamps the string 1000 and the monkey-board string automatic placement apparatus 50 releases the string 1000; with the elevator 40 clamping the string 1000, the derrick floor pipe handling manipulator 90 grabs the first end portion of the string 1000; with the string 1000 being clamped by the elevator 40 and grasped by the derrick floor pipe handling manipulator 90, the elevator 40 lifts up the string 1000 so that the first end portion of the string 1000 moves away from the string storage portion 20130; the derrick floor pipe handling manipulator 90 conveys the string 1000 to the buckling apparatus; after the buckling apparatus 80 realizes the buckling of the strings 1000, the elevator 40 lowers down the string 1000 so that the string 1000 comes into contact with a collar located at the slip 60; the derrick floor pipe handling manipulator 90 releases the string 1000, and the power clamp 700 connected to the oil field workover operation device 70 screws on the string 1000; after the string 1000 is screwed on, the elevator 40 is lifted up for a certain distance, and then the slip 60 is opened, and the elevator 40 lowers down the string 1000, so that the lowering operation of the string 1000 is realized.

According to the automated equipment 1 of an exemplary embodiment of the present disclosure, in the lifting operation of the string 1000, the elevator 40 clamps the second end portion of the string 1000 on which the lifting operation is to be performed; the slip 60 is opened; the elevator 40 lifts up the string 1000 so as to expose the collar located at the slip 60; after the collar is exposed, the slip 60 is closed, and the power clamp 700 connected to the oil field workover operation device 70 screws off the string 1000; after the string 1000 is screwed off, the derrick floor pipe handling manipulator 90 grabs the first end portion of the string 1000 screwed off; with the string 1000 being clamped by the elevator 40 and grasped by the derrick floor pipe handling manipulator 90, the elevator 40 lifts the string 1000 up so that the string 1000 is disengaged from the collar; the derrick floor pipe handling manipulator 90 conveys the disengaged string 1000 to above the string storage portion 20130; the elevator 40 lowers the string 1000 down, until the first end portion of the string 1000 is placed in the string storage portion 20130; the monkey-board string automatic placement apparatus 50 grabs the second end portion of the string 1000 and pushes the second end portion of the string 1000 into the fingerboard bank, so as to realizing the lifting operation of the string 1000.

The automated equipment 1 for drilling and workover operations of oil field according to the exemplary embodiments of the present disclosure can at least partially realize unmanned drilling and workover operations, significantly improve operation efficiency of the drilling and workover operations, greatly reduce manual operation strength, and improve safety factor.

According to some exemplary embodiments of the present disclosure, the automated equipment 1 further may include a power catwalk 30 positioned on the ground. By way of example and not limitation, the power catwalk 30 and the workover rig 10 can be positioned on two opposite sides of the wellhead in the front-rear direction of the automated equipment 1. In some embodiments, the power catwalk 30 can be used to transport the string from the ground to the derrick floor 20 and to transport the string from the derrick floor 20 to the ground.

In an optional embodiment of the present disclosure, the automated equipment 1 further may include a driller centralized control operating apparatus 100. Exemplarily, the driller centralized control operating apparatus 100 can be fixed on the derrick floor 20 and positioned on the left of the derrick floor pipe handling manipulator 90 in the left-right direction of the automated equipment 1. In an exemplary embodiment, the driller centralized control operating apparatus 100 can be configured to realize the lowering operation and the lifting operation of the automated equipment 1 on the string 1000 by sending instructions to the automated equipment 1.

In some embodiments, the automated equipment 1 further may include a hydraulic station 110, wherein the hydraulic station 110 can be mounted on the derrick floor 20 and located below the driller centralized control operating apparatus 100, and the hydraulic station 110 can be used to provide power to the automated equipment 1.

In an exemplary embodiment shown in the present disclosure, the driller centralized control operating apparatus 100 and the hydraulic station 110 can be mounted on the third derrick floor 20120.

Next, some states of the automated equipment 1 for drilling and workover operations of oil field provided in embodiments of the present disclosure in processes of realizing the lifting operation and the lowering operation of the string 1000 will be described in detail with reference to FIG. 3 to FIG. 4C.

Figure 3A:
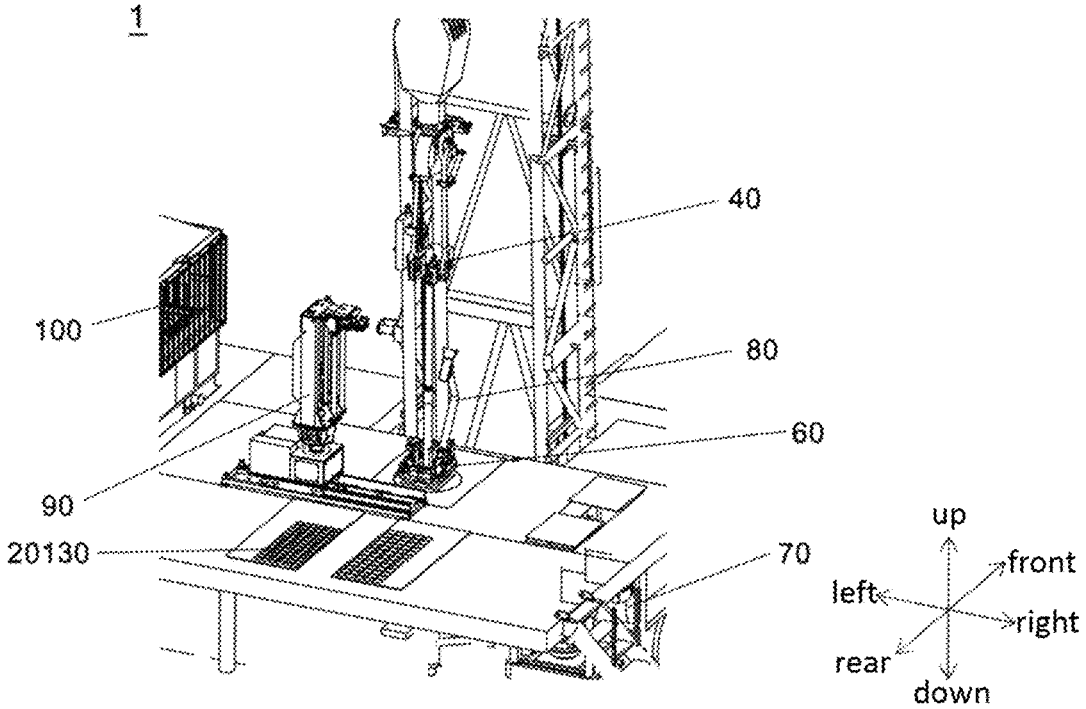
FIG. 3A to FIG. 3B respectively are structural schematic perspective diagrams of the automated equipment for drilling and workover operations of oil field provided in an embodiment of the present disclosure in an initial state and a ready state.
Figure 3B:
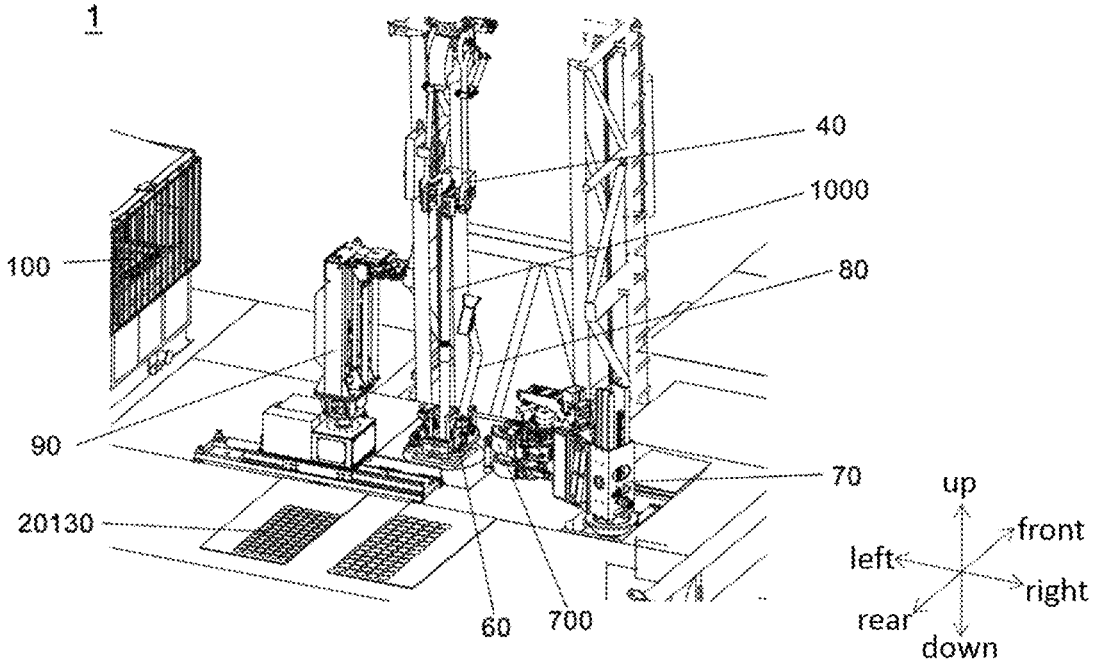

FIG. 3A and FIG. 3B respectively are structural schematic perspective diagrams of the automated equipment 1 for drilling and workover operations of oil field provided in an embodiment of the present disclosure in an initial state and a preparation state. In FIG. 3A, the slip 60 is opened, the oil field workover operation device 70 and the power clamp 700 connected to the oil field workover operation device 70 are located below the derrick floor 20, and the derrick floor pipe handling manipulator 90 is located in a position away from the slip 60. In FIG. 3B, the slip 60 is opened, the oil field workover operation device 70 is located above the derrick floor 20, and the derrick floor pipe handling manipulator 90 is located in a position close to the slip 60.

Figure 4A:
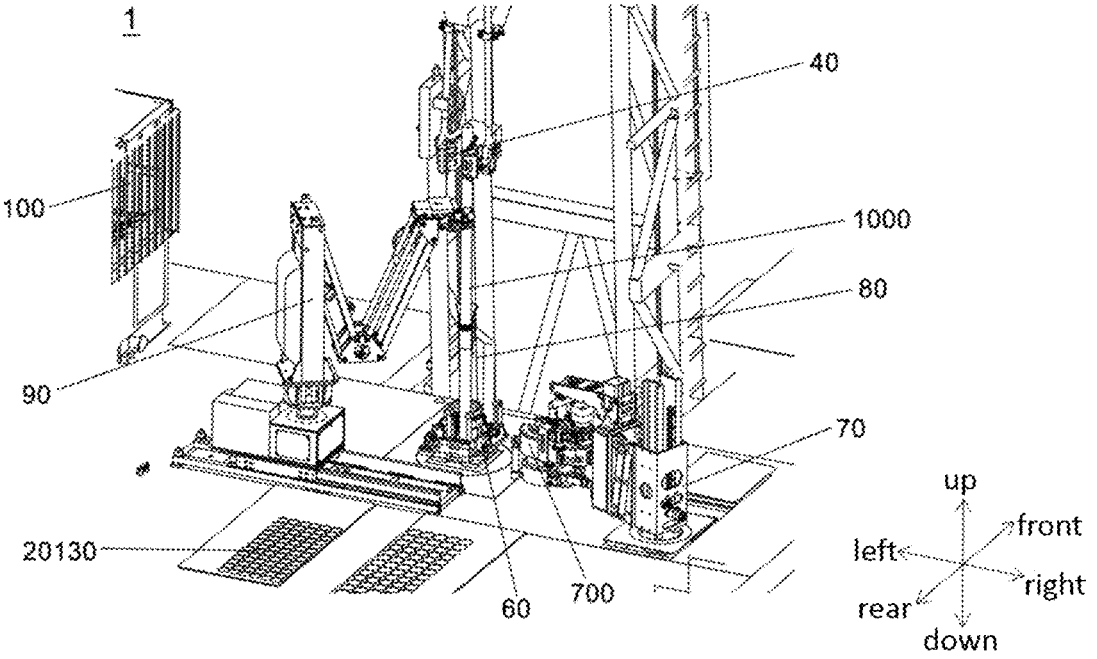
FIG. 4A to FIG. 4B respectively are structural schematic perspective diagrams of the automated equipment for drilling and workover operations of oil field provided in an embodiment of the present disclosure in an operation state.
Figure 4B:
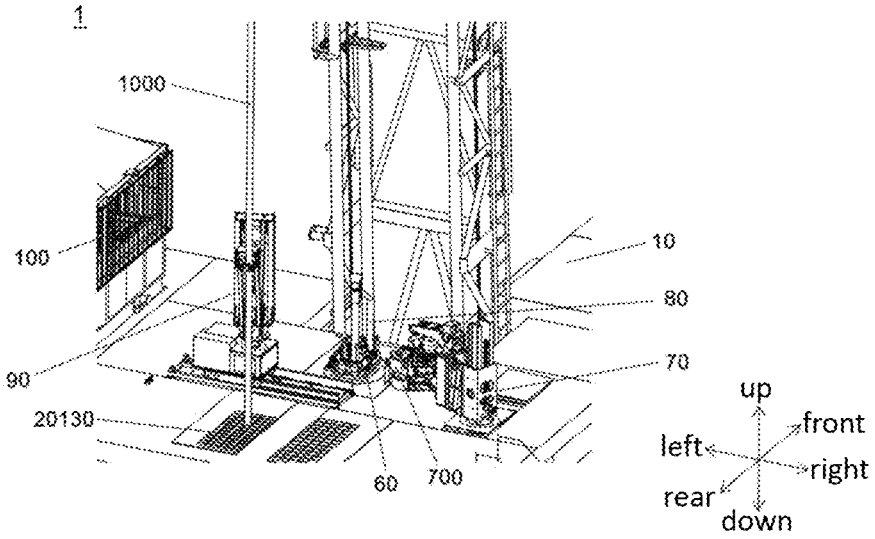

FIG. 4A to FIG. 4B respectively are structural schematic perspective diagrams of the automated equipment 1 for drilling and workover operations of oil field provided in an embodiment of the present disclosure in an operation state. In FIG. 4A, the slip 60 is closed, the oil field workover operation device 70 and the power clamp 700 connected to the oil field workover operation device 70 are located above the derrick floor 20, and the derrick floor pipe handling manipulator 90 is located in a position close to the slip 60 and grabs, in a position facing the slip 60, the string 1000 located at the slip 60. In FIG. 4B, the slip 60 is closed, the oil field workover operation device 70 and the power clamp 700 connected to the oil field workover operation device 70 are located above the derrick floor 20, and the derrick floor pipe handling manipulator 90 is located in a position close to the slip 60 and grabs, in a position facing back to the slip 60, the string 1000 located at the string storage portion 20130.

In some optional embodiments of the present disclosure, the oil field workover operation device 70 can be disposed on the derrick floor 20 in a manner of being movable between a raised position (e.g., as shown in FIG. 3B) where the oil field workover operation device 70 extends out above the derrick floor 20 and a retreated position (e.g., as shown in FIG. 3A) where the oil field workover operation device 70 retreats below the derrick floor 20. In an exemplary embodiment, in the raised position of the oil field workover operation device 70, the oil field workover operation device 70 can move between an extended state and a retracted state, wherein in the extended state of the oil field workover operation device 70, the power clamp 700 connected to the oil field workover operation device 70 can be positioned close to the wellhead so as to screw on and off the string 1000 positioned at the wellhead, and in the retracted state of the oil field workover operation device 70, the power clamp 700 connected to the oil field workover operation device 70 can be positioned away from the wellhead. In some embodiments, in the retreated position of the oil field workover operation device 70, the oil field workover operation device 70 can be in the retracted state of the oil field workover operation device 70.

In an exemplary embodiment of the present disclosure, the derrick floor pipe handling manipulator 90 can be configured to move between a first position away from the slip 60 and a second position close to the slip 60, in the second position of the derrick floor pipe handling manipulator 90, the derrick floor pipe handling manipulator 90 can be used to grab the string 1000, and the derrick floor pipe handling manipulator 90 can rotate between a facing position facing the slip 60 and a back position facing back to the slip, and in the facing position of the derrick floor pipe handling manipulator 90, the derrick floor pipe handling manipulator 90 can be used to grab the string 1000 located at the slip 60, and in the back position of the derrick floor pipe handling manipulator 90, the derrick floor pipe handling manipulator 90 can be used to grab the string located at the string storage portion 20130.

Next, various apparatuses used in the automated equipment 1 for drilling and workover operations of oil field provided in embodiments of the present disclosure will be described in detail with reference to FIG. 5 to FIG. 47.

Now, the power catwalk 30 provided in embodiments of the present disclosure will be described in detail with reference to FIG. 5 to FIG. 9.

Figure 5:
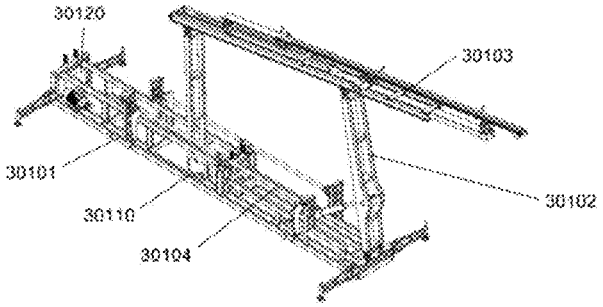
FIG. 5 is a structural schematic perspective diagram of a power catwalk provided in an embodiment of the present disclosure.

Referring first to FIG. 5, FIG. 5 is a structural schematic perspective diagram of the power catwalk 30 provided in an embodiment of the present disclosure. In an exemplary embodiment shown in the present disclosure, the power catwalk 30 and the workover rig 10 are positioned on two opposite sides of the wellhead in the front-rear direction of the automated equipment 1. In some embodiments of the present disclosure, the power catwalk 30 can be used to transport the string from the ground to the derrick floor 20 and transport the string from the derrick floor 20 to the ground. The power catwalk 30 may include a mechanical system 30100, a hydraulic system 30110, and an electrical system 30120, wherein the mechanical system 30100 may include a base 30101, a hoisting mechanism 30102, a transporting mechanism 30103, and a loading and unloading mechanism 30104.

Figure 6:
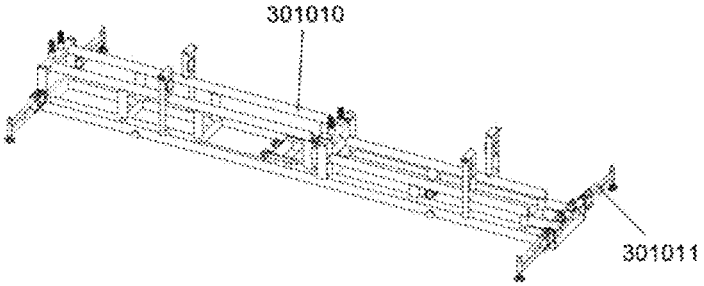
FIG. 6 is a structural schematic perspective diagram of a base of the power catwalk provided in an embodiment of the present disclosure.

Referring now to FIG. 6, FIG. 6 is a structural schematic perspective diagram of the base 30101 of the power catwalk 30 provided in an embodiment of the present disclosure. According to some exemplary embodiments of the present disclosure, the base 30101 may include a bracket assembly 301010 and a jack leg 301011, wherein the bracket assembly 301010 is foundation of the whole set of device, for connecting and supporting moving parts above; the jack leg 301011 can be hinged with the bracket assembly 301010, and by adjusting height of the jack leg 301011, levelling of the base 30101 can be realized, ensuring that the device operates more steadily in the operation state, and meanwhile, the jack leg 301011 can be folded or disassembled in a transportation process, facilitating the transportation of the device.

Figure 7:
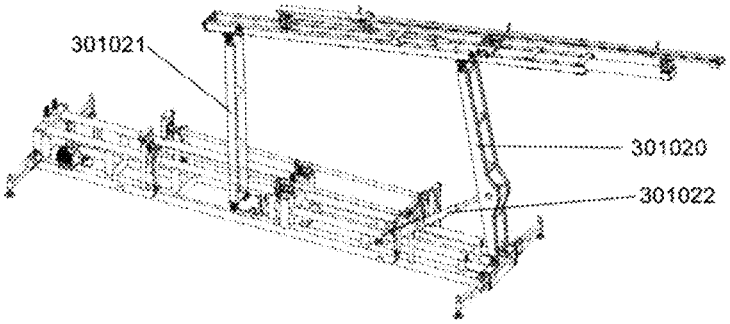
FIG. 7 is a structural schematic perspective diagram of a hoisting mechanism of the power catwalk provided in an embodiment of the present disclosure.

Referring now to FIG. 7, FIG. 7 is a structural schematic perspective diagram of the hoisting mechanism 30102 of the power catwalk 30 provided in an embodiment of the present disclosure. In some embodiments of the present disclosure, the hoisting mechanism 30102 may include a front rotating arm 301020, a rear rotating arm 301021, and a hoisting hydraulic cylinder 301022, the hoisting mechanism 30102 can be driven hydraulically, and by controlling hoisting and lowering speeds of the hydraulic cylinder 301022, quick rising and slow lowering of hoisting action can be realized, such that the apparatus moves more steadily, ensuring safe and reliable operations.

Figure 8:
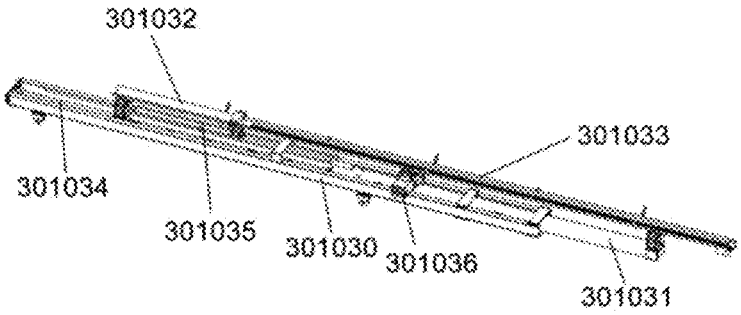
FIG. 8 is a structural schematic perspective diagram of a transporting mechanism of the power catwalk provided in an embodiment of the present disclosure.

Referring now to FIG. 8, FIG. 8 is a structural schematic perspective diagram of the transporting mechanism 30103 of the power catwalk 30 provided in an embodiment of the present disclosure. In an exemplary embodiment of the present disclosure, the transporting mechanism 30103 may include a bearing platform 301030, a secondary (two-stage) telescoping mechanism 301031, a turnover trough 301032, a sliding shoe trough 301033, a secondary telescoping hydraulic cylinder 301034, a sliding shoe hydraulic cylinder 301035, a turnover hydraulic cylinder 301036, and so on, wherein the secondary telescoping hydraulic cylinder 301034 can drive the secondary telescoping mechanism 301031 to move back and forth along a guide track of the bearing platform 301030, the sliding shoe hydraulic cylinder 301035 drives the sliding shoe trough 301033 to move back and forth along the turnover trough 301032, and the turnover hydraulic cylinder 301036 can drive the turnover trough 301032 to tilt left and right, and the three act in sequence to realize horizontal transportation of the string.

Figure 9:
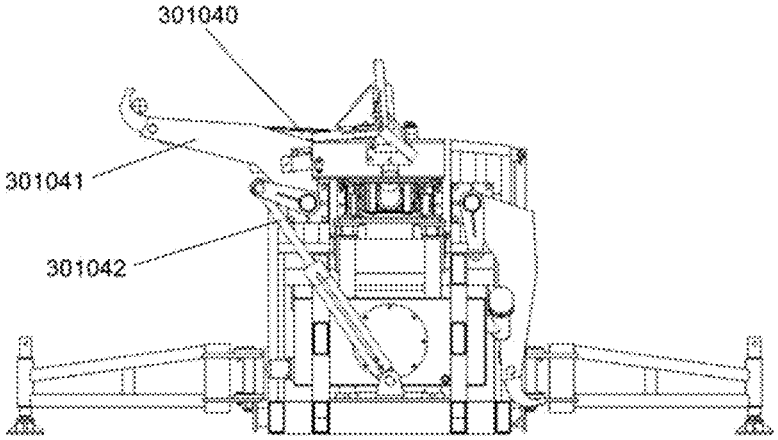
FIG. 9 is a structural schematic diagram of a loading and unloading mechanism of the power catwalk provided in an embodiment of the present disclosure.

Referring now to FIG. 9, FIG. 9 is a structural schematic diagram of the loading and unloading mechanism 30104 of the power catwalk 30 provided in an embodiment of the present disclosure. According to some embodiments of the present disclosure, the loading and unloading mechanism 30104 may include a rotating arm assembly, a loading frame 301040, and an unloading transition bridge, and the rotating arm assembly may include a rotating arm 301041 and a loading hydraulic cylinder 301042. During loading, the loading hydraulic cylinder 301042 can fully extend out, and push the rotating arm 301041 to turn upwards to pick up the string, and the rotating arm 301041 then cooperates with the loading frame 301040 so that the string rolls along an upper surface down into the transporting mechanism 30103, completing an action of the string entering the transporting mechanism 30103. During unloading, the rotating arm 301041 is used in cooperation with the unloading transition bridge so that the string rolls along the upper surface down into a string handling frame.

In some exemplary embodiments, an action procedure of the power catwalk 30 provided in the embodiments of the present disclosure can be described as follows.

The string loading procedure is as follows:

1) the turnover hydraulic cylinder 301036 acts, to push the turnover trough 301032 and the sliding shoe trough 301033 to turn from a middle position to a loading station, to prepare for receiving a string;
2) the loading hydraulic cylinder 301042 acts, to make the rotating arm 301041 hoist and pick up the string, and the string rolls along the rotating arm 301041 and an upper surface of the loading frame to a transition rod of the turnover trough 301032;
3) the turnover hydraulic cylinder 301036 acts, to make the turnover trough 301032 to turn from the loading station to the middle position, and the string rolls from the turnover trough 301032 into the sliding shoe trough 301033;
4) the loading hydraulic cylinder 301042 acts, to lower the rotating arm 301041 to the lowest position, preparing for picking up the pipe next time;
5) the hoisting hydraulic cylinder 301022 acts, to drive the hoisting mechanism 30102 to hoist the transporting mechanism 30103 to a predetermined height;
6) the secondary telescoping hydraulic cylinder acts, to drive the secondary telescoping mechanism to move forwards along the guide track of the bearing platform to a predetermined position;

7) the sliding shoe hydraulic cylinder acts, to drive the sliding shoe trough 301033 to move forwards along the turnover trough 301032 to a predetermined position (at this time, the string has been transported above the wellhead);
8) after the string is lifted away from the sliding shoe trough 301033 by the elevator 40, the sliding shoe hydraulic cylinder acts, to drive the sliding shoe trough 301033 to move backwards to return to an initial position;
9) the secondary telescoping hydraulic cylinder acts, to drive the secondary telescoping mechanism to move backwards along the guide track of the bearing platform to an initial position; and
10) the hoisting hydraulic cylinder 301022 acts, to drive the hoisting mechanism 30102 to lower the transporting mechanism 30103 down to a horizontal state.

So far, the whole string loading procedure is completed. The string lowering procedure is as follows:

1) the hoisting hydraulic cylinder 301022 acts, to drive the hoisting mechanism 30102 to hoist the transporting mechanism 30103 to a predetermined height;
2) the secondary telescoping hydraulic cylinder acts, to drive the secondary telescoping mechanism to move forwards along the guide track of the bearing platform to a predetermined position;
3) the sliding shoe hydraulic cylinder acts, to drive the sliding shoe trough 301033 to move forwards along the turnover trough 301032 to a predetermined position (at this time, the transporting mechanism 30103 has reached the front of the wellhead and waits for receiving a pipe);
4) after the elevator 40 completely lowers the string down into the sliding shoe trough 301033, the sliding shoe hydraulic cylinder acts to drive the sliding shoe trough 301033 to move backwards along the turnover trough 301032 to the initial position;
5) the secondary telescoping hydraulic cylinder acts, to drive the secondary telescoping mechanism to move backwards along the guide track of the bearing platform to the initial position;
6) the hoisting hydraulic cylinder 301022 acts, to drive the hoisting mechanism 30102 to lower the transporting mechanism 30103 down to a horizontal state;
7) the loading hydraulic cylinder 301042 acts, to drive the rotating arm 301041 to a certain height, and the rotating arm 301041 cooperates with the unloading transition bridge to provide a rolling ramp for the string;
8) the turnover hydraulic cylinder 301036 acts, to push the turnover trough 301032 to tilt to an unloading station, and the string rolls into the string handling frame from the sliding shoe trough 301033 along the rotating arm 301041 and the unloading transition bridge; and
9) the loading hydraulic cylinder 301042 acts, to lower the rotating arm 301041 down to the lowest position, preparing for picking up the pipe next time.

So far, the string lowering procedure is completed.

Figure 10:
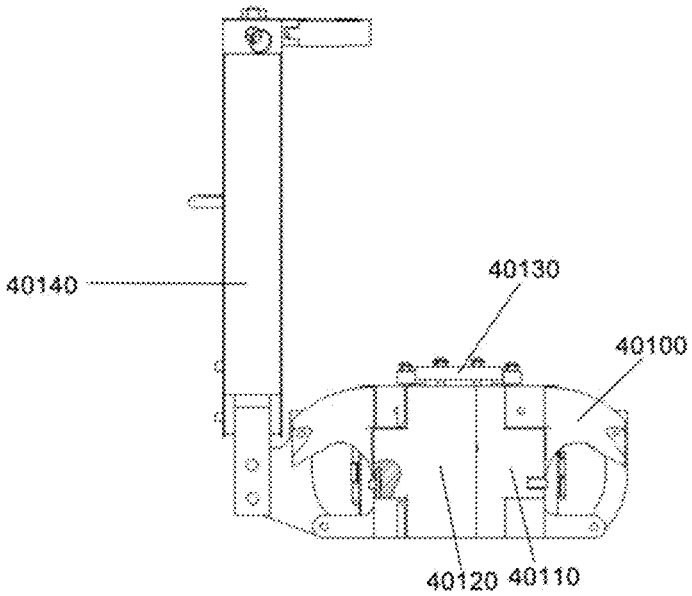
FIG. 10 is a structural schematic front view of an elevator provided in an embodiment of the present disclosure.
Figure 11:
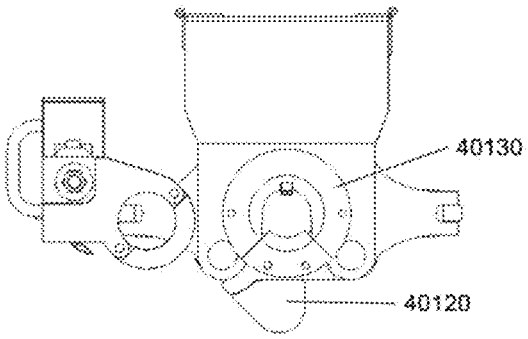
FIG. 11 is a structural schematic top view of the elevator provided in an embodiment of the present disclosure.

Next, the elevator 40 provided in an embodiment of the present disclosure will be described in detail with reference to FIG. 10 to FIG. 11. FIG. 10 is a structural schematic front view of the elevator 40 provided in an embodiment of the present disclosure. FIG. 11 is a structural schematic top view of the elevator 40 provided in an embodiment of the present disclosure.

In an exemplary embodiment shown, the elevator 40 may include an elevator main body 40100 and a bushing 40130, and the elevator main body can be overturned. In some embodiments, the elevator 40 further may include a valve 40110, a latch 40120, and a turnover mechanism 40140.

When the elevator 40 needs to clamp the string, the latch 40120 and the valve 40110 are opened in sequence, a hydraulic oil cylinder of the turnover mechanism acts, and the elevator main body 40100 is tilted. The string enters the bushing 40130 of the elevator 40, the latch 40120 and the valve 40110 are closed in sequence, and the string is clamped in the elevator 40 and travels up with a traveling block hook.

Next, the monkey-board string automatic placement apparatus 50 provided in embodiments of the present disclosure will be described in detail with reference to FIG. 12 to FIG. 15.

Figure 12:
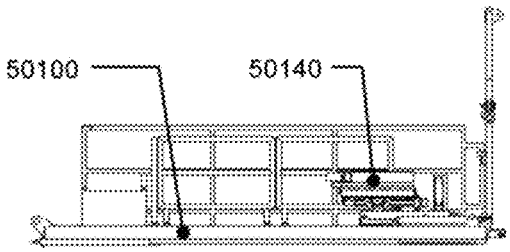
FIG. 12 is a structural schematic diagram of a monkey-board string automatic placement apparatus provided in an embodiment of the present disclosure.
Figure 13:
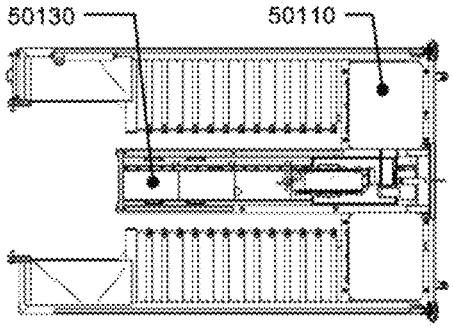
FIG. 13 is a top view of the monkey-board string automatic placement apparatus shown in FIG. 12.

Referring first to FIG. 12 and FIG. 13, FIG. 12 is a structural schematic diagram of the monkey-board string automatic placement apparatus 50 provided in an embodiment of the present disclosure, and FIG. 13 is a top view of the monkey-board string automatic placement apparatus 50 shown in FIG. 12. In an exemplary embodiment shown in the present disclosure, the monkey-board string automatic placement apparatus 50 can be installed on the derrick 10100 and positioned above the derrick floor 20. In some exemplary embodiments, the monkey-board string automatic placement apparatus 50 may include a monkey board and fingerboard mechanism 50100, an electrical control box 50110, a jaw opening mechanism 501404, a traveling trolley, a gear and rack transmission mechanism, a rotation decelerating mechanism, and a double-stroke telescoping mechanism. The monkey board and fingerboard mechanism 50100 may include a fingerboard bank for receiving the second end portion of the string. There may be a plurality of fingerboard banks, and positions of the fingerboard banks are corresponding to the positions of the string storage portions 20130 on the derrick floor 20, so that when the first end portion of the string is located in the string storage portion 20130 and the second end portion of the string is located in the corresponding fingerboard bank, the string is substantially vertically directed. A rack guide track is mounted on a monkey board of the monkey board and fingerboard mechanism 50100, and an automatic baffle is provided at an end portion of the fingerboard. In some embodiments, the monkey board and fingerboard mechanism 50100 may include a monkey-board manipulator 50140, and the monkey board manipulator 50140 can be used for pushing the second end portion of the string into the fingerboard bank or taking the second end portion of the string out from the fingerboard bank. A structure of the monkey-board manipulator 50140 is shown in FIG. 14 and FIG. 15.

Figure 14:
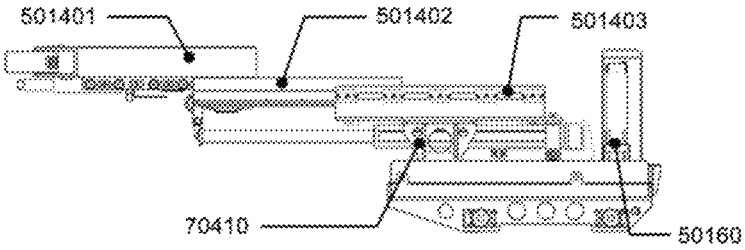
FIG. 14 is a structural schematic diagram of a monkey-board manipulator of the monkey-board string automatic placement apparatus provided in an embodiment of the present disclosure.
Figure 15:
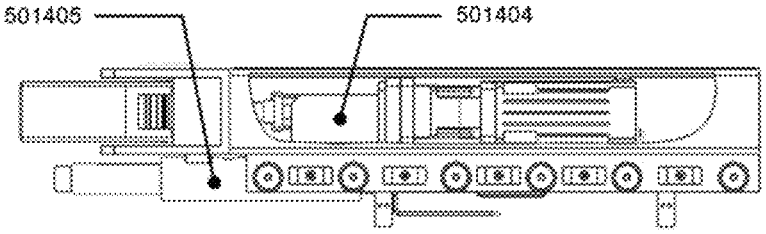
FIG. 15 is a top view of the monkey-board mechanical manipulator shown in FIG. 14.

As shown in FIG. 14, the monkey-board manipulator 50140 may include a clamping jaw arm 501401, a middle guide track 501402, a manipulator base 501403, and a traveling trolley. As shown in FIG. 15, the clamping jaw arm 501401 can be provided with the jaw opening mechanism 501404, and the jaw opening mechanism 501404 can realize opening and closing of a clamping jaw of the manipulator through a servo motor and a decelerator-driven screw-nut mechanism. In an exemplary embodiment of the present disclosure, a push rod mechanism 501405 can be provided below the clamping jaw arm 501401, and the push rod mechanism 501405 can detect whether a string exists in the clamping jaw by means of a rear-end induction sensor. An S-shaped guide track can be disposed on the middle guide track 501402, and the clamping jaw arm 501401 and a roller on the manipulator base 501403 can slide in the S-shaped guide track. An electrical push cylinder can be mounted on the manipulator base 501403, and the electrical push cylinder is a drive element configured to drive a telescoping movement of the manipulator. The traveling trolley may include a rotation decelerator and a traveling drive mechanism 50160. In some embodiments, three parts, i.e., the clamping jaw arm 501401, the middle guide track 501402, and the manipulator base 501403, can be connected by a double-stroke mechanism of chain and chain wheel. The manipulator base 501403 can be connected to a rotating mechanism 50150 of the monkey-board manipulator 50140.

An action procedure of the monkey-board string automatic placement apparatus 50 can be divided into a lifting procedure and a lowering procedure.

In the string lifting procedure, the monkey-board manipulator 50140 waits at a rear end of the monkey board, and after the elevator 40 lifts up the string in place, the traveling drive mechanism 50160 on the manipulator 50140 can drive a gear to rotate, to be in meshing transmission with rack on the monkey board, and drive the manipulator 50140 to move to the front of the monkey board. After the manipulator 50140 reaches a target position, the electrical push cylinder pushes the manipulator 50140 to extend into the elevator 40 and grab the string, and after the push rod mechanism 501405 below the clamping jaw arm 501401 touches the string, the push rod is compressed and moves back, until the induction sensor at the rear of the push rod mechanism 501405 sends an in-place signal, the electrical push cylinder stops working, and the manipulator 50140 stops extending out. At this time, the clamping jaw is driven by the jaw opening mechanism 501404 to be closed. After the clamping jaw is closed, the manipulator 50140 can be driven by the electrical push cylinder to retract to a set position, after that, the rotating mechanism 50150 of the monkey-board manipulator, driven by the servo motor, drives an upper part of the manipulator to rotate by 90°, and after the manipulator rotates in place, the traveling trolley is driven by the traveling drive mechanism 50160 to travel backwards along the monkey board to a target fingerboard position. After the traveling trolley reaches the target fingerboard position, the automatic baffle of the fingerboard is opened, the manipulator 50140 extends out and pushes the string into the fingerboard bank, and meanwhile the automatic baffle is closed. After the manipulator 50140 pushes the string in place, the clamping jaw is opened, and after retracting, the manipulator rotates reversely by 90° to reset and wait for the next string.

In the string lowering procedure, the monkey-board manipulator 50140 waits at the rear end of the monkey board, and after the elevator 40 is in place, the manipulator 50140 can rotate by 90° (facing the target fingerboard bank), the electrical push cylinder drives the manipulator 50140 to extend out and take the string, and when the manipulator 50140 extends to a target string position, after the push rod mechanism 501405 below the clamping jaw arm 501401 touches the string, the push rod is compressed and moves back, until the induction sensor at the rear of the push rod mechanism 501405 sends an in-place signal, the electrical push cylinder stops working, and the manipulator 50140 stops extending out. At this time, the clamping jaw can be driven by the jaw opening mechanism 501404 to be closed. After the clamping jaw is closed, the manipulator 50140 is driven by the electrical push cylinder to retract to a set position, the traveling drive mechanism 50160 can drive the manipulator 50140 to travel forwards along the monkey board to a set position in a front section, and after the manipulator 50140 is in place, the rotating mechanism 50150 of the monkey-board manipulator drives the manipulator 50140 to rotate by 90°. After rotating in place, the manipulator 50140 extends out and puts the string into the elevator 40, after the elevator 40 is closed, the clamping jaw of the manipulator is opened, after the clamping jaw is opened, the manipulator 50140 retracts, and after retracting in place, the manipulator 50140 travels backwards along the monkey board to a waiting position.

Figure 16:
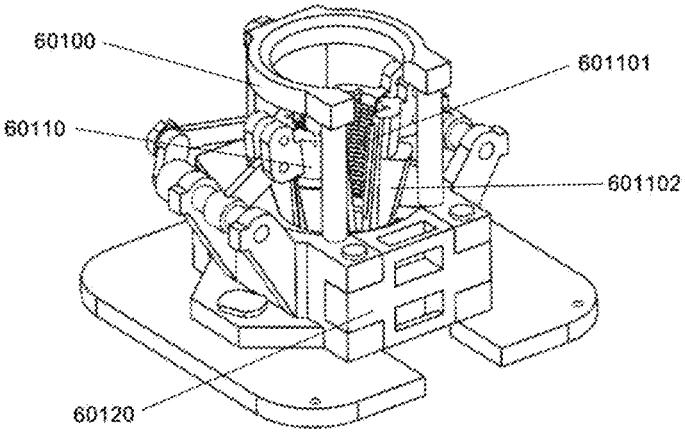
FIG. 16 is a structural schematic perspective view of a slip provided in an embodiment of the present disclosure from a first viewing angle.
Figure 17:
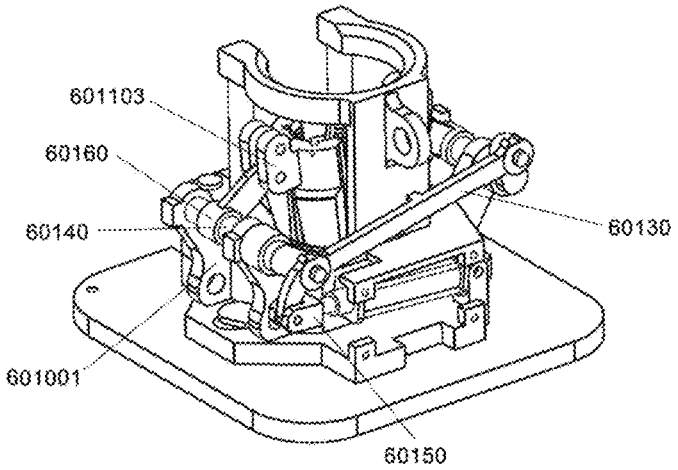
FIG. 17 is a structural schematic perspective view of the slip provided in an embodiment of the present disclosure from a second viewing angle.

The slip 60 provided in an embodiment of the present disclosure will now be described in detail with reference to FIG. 16 and FIG. 17. FIG. 16 is a structural schematic perspective view of the slip 60 provided in an embodiment of the present disclosure from a first viewing angle. FIG. 17 is a structural schematic perspective view of the slip 60 provided in an embodiment of the present disclosure from a second viewing angle.

According to an exemplary embodiment of the present disclosure, the slip 60 can be mounted on the derrick floor 20 and positioned above the wellhead, the slip 60 can be switched between a closed position where the slip 60 clamps the string so as to prevent the string from moving through, and an opened position where the slip 60 is opened so as to allow the string to move through.

As shown in FIG. 16 and FIG. 17, in an embodiment shown in the present disclosure, the slip 60 may include a slip housing 60100, a slip assembly 60110, a slip front stop 60120, a first transmission rod 60130, a connecting shaft 60140, a drive member 60150, and a second transmission rod 60160. In some embodiments of the present disclosure, the slip housing 60100 may include a slip body lug 601001, and the slip body lug 601001 may have a hole for receiving the connecting shaft 60140. The slip assembly 60110 may include a slip insert 601101, a slip bowl 601102, and a connecting lug 601103, wherein the slip insert 601101 can be used to clamp the string, and the slip bowl 601102 is shrinkable and expandable.

In an exemplary embodiment shown, the slip front stop 60120 can be mounted on the slip housing 60100, for example, fixed to the slip housing 60100 by a pin, for ease of disassembly. A cavity of the slip housing 60100 and an inner cavity of the slip front stop 60120 may jointly form a continuous tapered surface, to which the slip assembly 60110 is attached, an outer surface of the slip assembly 60110 can be shaped as a tapered surface matched with the tapered surface. The drive member 60150 can be connected to the slip assembly 60110 through the first transmission rod 60130, the connecting shaft 60140, the second transmission rod 60160, and the connecting lug 601103, so as to implement hoisting and lowering of the slip assembly 60110 through action of a piston rod of the drive member 60150. The connecting shaft 60140 can pass through an inner hole of the first transmission rod 60130 and be fixed to the first transmission rod 60130, and one end of the connecting shaft 60140 can be connected to the connecting lug 601103 through the second transmission rod 60160. The drive member 60150 can be mounted on one side of the slip assembly 60110 and be placed at an angle to the horizontal plane. When the drive member 60150 acts, an action can be transmitted in sequence to the first transmission rod 60130, the second transmission rod 60160, the connecting shaft 60140, and finally the slip assembly 60110.

In cases where the slip 60 needs to be closed to clamp the string, after the string enters the slip assembly 60110, the piston rod of the drive member 60150 can stretch so as to push the first transmission rod 60130, so that the first transmission rod 60130 drives the slip insert 601101 in the slip assembly 60110 to clamp the string. As the string is being lowered down, the slip bowl 601102 can shrink towards center along the tapered surface inside the slip housing 60100, thus realizing tight clamping of the string to prevent the string from moving through. In cases where the slip 60 needs to be opened to release the string, when the string is being lifted up, the piston rod of the drive member 60150 can be withdrawn, so that the first transmission rod 60130 and the second transmission rod 60160 drive the slip assembly 60110 to move, which makes the slip bowl 601102 to rise and open, and further causes the slip insert 601101 to release the string, thus realizing the release of the string to allow the string to move therethrough.

It should be indicated that the drive member 60150 in the embodiments of the present disclosure may be a hydraulic cylinder, but is not limited thereto.

Next, the oil field workover operation device 70 provided in embodiments of the present disclosure will be described in detail with reference to FIG. 18 to FIG. 29.

Figure 18:
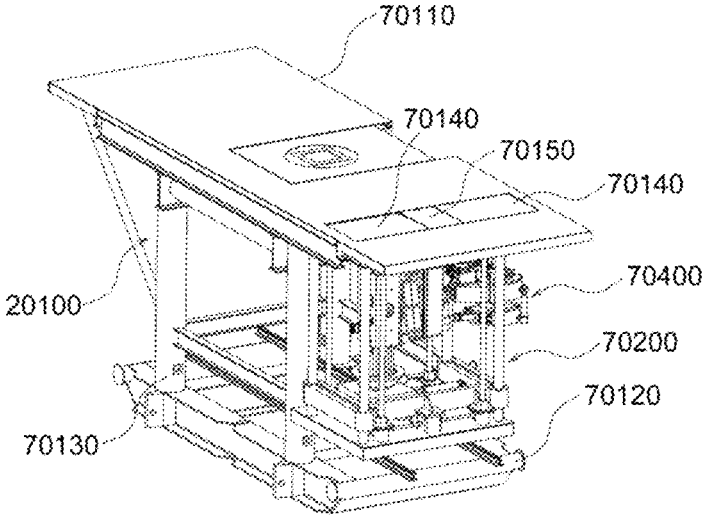
FIG. 18 is a structural schematic diagram of an oil field workover operation device provided in an embodiment of the present disclosure, wherein the oil field workover operation device is in a transportation state.
Figure 19:
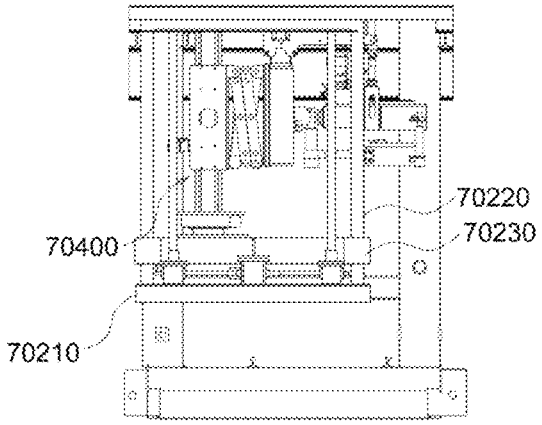
FIG. 19 is a right view of the oil field workover operation device shown in FIG. 18.
Figure 20:
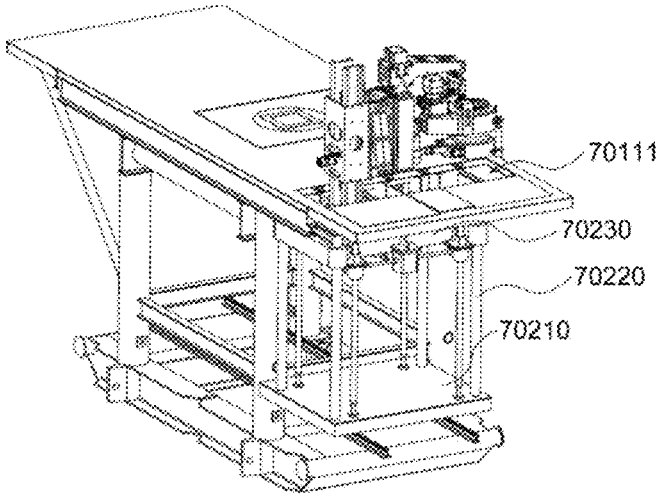
FIG. 20 is a structural schematic diagram of the oil field workover operation device provided in an embodiment of the present disclosure, wherein a screwing on and off apparatus is in a jacked state.

Referring to FIG. 18 to FIG. 20, the present embodiment provides an oil field workover operation device 70, wherein the oil field workover operation device 70 may include the first derrick floor 20100, a lifting apparatus 70200, and a screwing on and off apparatus 70400, wherein the first derrick floor 20100 may include a derrick floor panel 70110, and an avoidance hole 70111 is formed in the derrick floor panel 70110; the lifting apparatus 70200 can be mounted below the derrick floor panel 70110, the lifting apparatus 70200 may include a platform base 70210, a guide stand column group, a lifting platform 70230, and a lifting drive mechanism, wherein the guide stand column group is fixedly connected between the platform base 70210 and the derrick floor panel 70110; the lifting platform 70230 can be slidably connected to the guide stand column group; the lifting driving mechanism is in transmission connection with the lifting platform 70230 for driving the lifting platform 70230 to be lifted up and down along the guide stand column group; and the screwing on and off apparatus 70400 can be mounted on the lifting platform 70230, and the lifting platform 70230 can drive the screwing on and off apparatus 70400 to extend out of or retreat to the avoidance hole 70111.

For the oil field workover operation device 70 provided in the present embodiment, since the screwing on and off apparatus 70400 is mounted on the lifting platform 70230, the lifting platform 70230 can drive the screwing on and off apparatus 70400 to be lifted up and down, so as to extend out of or retreat to the avoidance hole 70111. Specifically, when in use, the screwing on and off apparatus 70400 can be made to extend out of the avoidance hole 70111 (specifically see FIG. 20) so as to facilitate use, and when not in use, the screwing on and off apparatus 70400 can be made to retreat to the avoidance hole 70111 (specifically see FIG. 18), facilitating storage and transportation. It can be seen that the oil field workover operation device 70 integrates the screwing on and off apparatus 70400 to the first derrick floor 20100, then when in use, on-site installation is not required, and installation time is saved; meanwhile, overall transportation is realized, and the transportation is also relatively convenient.

Specifically, referring to FIG. 18, the first derrick floor 20100 further may include a derrick floor bottom plate 70120 and a supporting column 70130, wherein the supporting column 70130 is fixedly connected between the derrick floor panel 70110 and the derrick floor bottom plate 70120, so that a space for mounting the lifting apparatus 70200 is formed therebetween.

Figure 21:
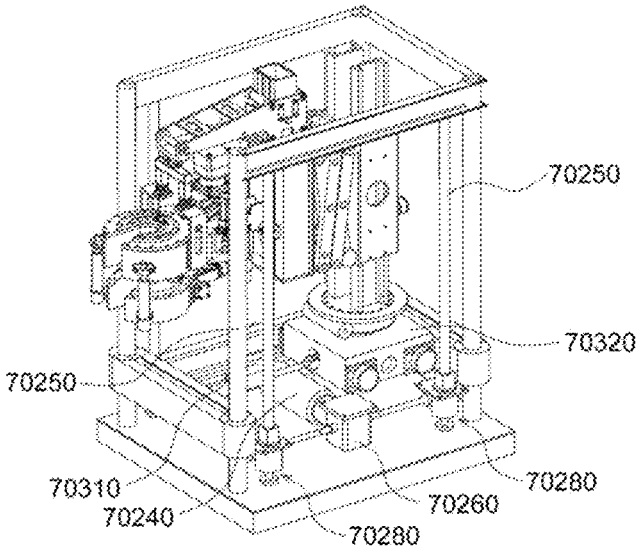
FIG. 21 is a first schematic diagram of a connection structure of a lifting apparatus and the screwing on and off apparatus.

In the present embodiment, referring to FIG. 21, the lifting drive mechanism can be arranged in two groups and opposite to each other; the lifting drive mechanism may include a lifting motor 70240, a transmission component, and a lead screw 70250, wherein two groups of lead screws 70250 can be provided and arranged parallel to the guide stand column group, and the lifting motor 70240 can be connected to the two groups of lead screws 70250 respectively through the transmission component; the lifting platform 70230 can be in transmission connection with the lead screws 70250, and the lifting motor 70240 can drive the lead screws 70250 to rotate through the transmission component, so as to make the lifting platform 70230 move along axes of the lead screws 70250. With such configuration, the lifting platform 70230 can be allowed to be vertically lifted up and down, ensuring that the lifting platform 70230 moves steadily along the lead screws 70250.

Figure 22:
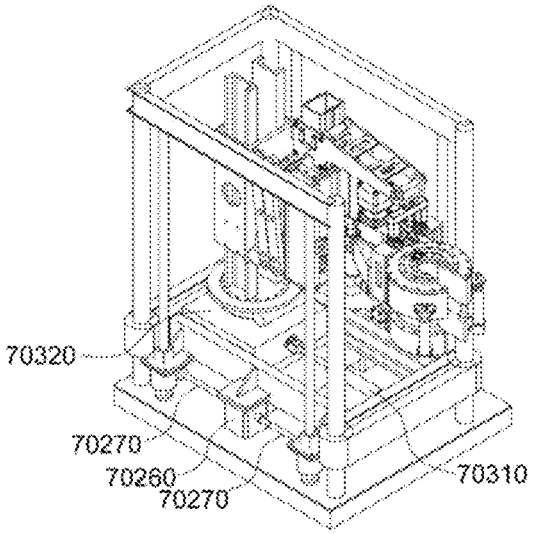
FIG. 22 is a second schematic diagram of the connection structure of the lifting apparatus and the screwing on and off apparatus.

Specifically, referring to FIG. 21 and FIG. 22, the transmission component may include an angular transmission box 70260, a coupling 70270, and a worm gear mechanism 70280, wherein the angular transmission box 70260 can be in transmission connection with the lifting motor 70240, and the angular transmission box 70260 is connected between two groups of couplings 70270, and the couplings 70270 are arranged perpendicular to the lead screws 70250; the worm gear mechanism 70280 can be provided in two groups, and each worm gear mechanism 70280 is in transmission connection between the coupling 70270 and the lead screw 70250. With such configuration, synchronous rotation of the two groups of lead screws 70250 can be realized through one group of the angular transmission box 70260 and the lifting motor 70240, which simplifies the overall structure, and meanwhile, converts the rotating movement in the horizontal direction into the rotating movement in the vertical direction through the worm gear mechanism 70280, can effectively reduce overall height of the lifting apparatus 70200 (generally, by directly connecting the motor to a bottom end of the lead screw 70250, the height can be made relatively high).

Figure 23:
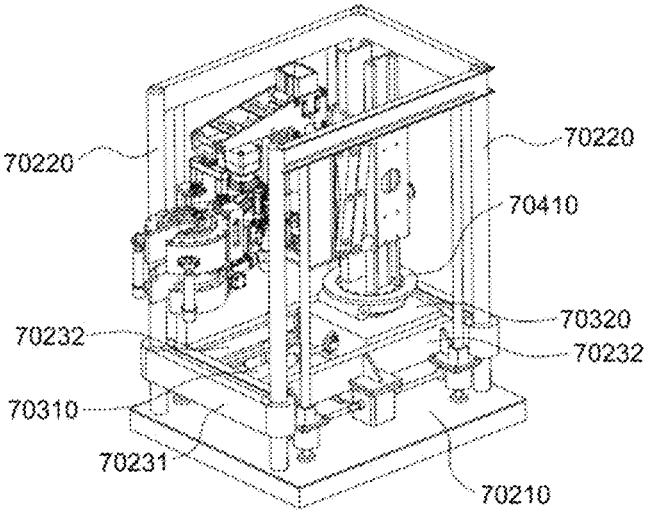
FIG. 23 is a third schematic diagram of the connection structure of the lifting apparatus and the screwing on and off apparatus.

Optionally, referring to FIG. 23, the guide stand column group may include four guide stand columns 70220, and the four guide stand columns 70220 are arranged in a rectangular shape; the lifting platform 70230 may include two groups of guide cylinders 70231 and a track group fixedly connected between the two groups of guide cylinders 70231; and the guide cylinders 70231 can be slidably sleeved on two guide stand columns 70220 located on the same side. In the above, the track group may include two tracks 70232. With such configuration, a certain space can be reserved between the two groups of guide cylinders 70231 and the two tracks 70232, so as to facilitate arrangement of a translation apparatus later.

Figure 24:
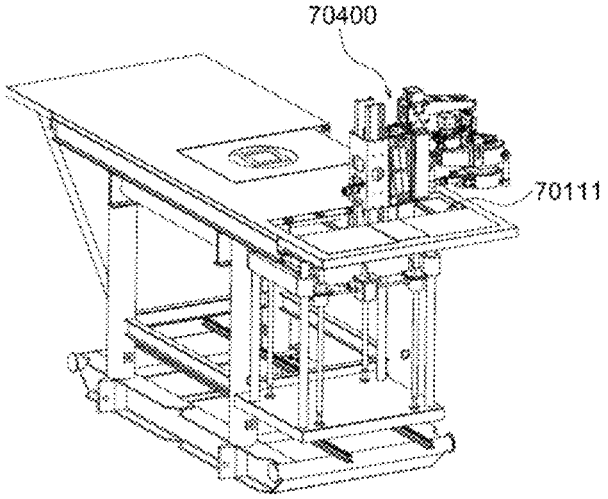
FIG. 24 is a structural schematic diagram of the oil field workover operation device provided in an embodiment of the present disclosure, wherein the screwing on and off apparatus is in an operation position.

Referring to FIG. 20, FIG. 23, and FIG. 24, the translation apparatus can be provided between the lifting platform 70230 and the screwing on and off apparatus 70400; the translation apparatus may include a translation drive cylinder 70310 and a movable trolley 70320 in transmission connection, the translation drive cylinder 70310 is mounted on a guide cylinder 70231, the movable trolley 70320 is movably arranged on the track group, and the translation drive cylinder 70310 is used to drive the movable trolley 70320 to move between the two groups of guide cylinders 70231; and the avoidance hole 70111 can be a long hole, and an extension direction of the long hole is the same as a moving direction of the movable trolley 70320. In the above, FIG. 20 shows that the screwing on and off apparatus 70400 is vertically jacked up by the lifting apparatus 70200, and FIG. 24 shows that the screwing on and off apparatus 70400 is driven by the movable trolley 70320 to move rightwards to an operation position.

Specifically, the movable trolley 70320 can be provided between the two tracks 70232 through a roller.

Figure 25:
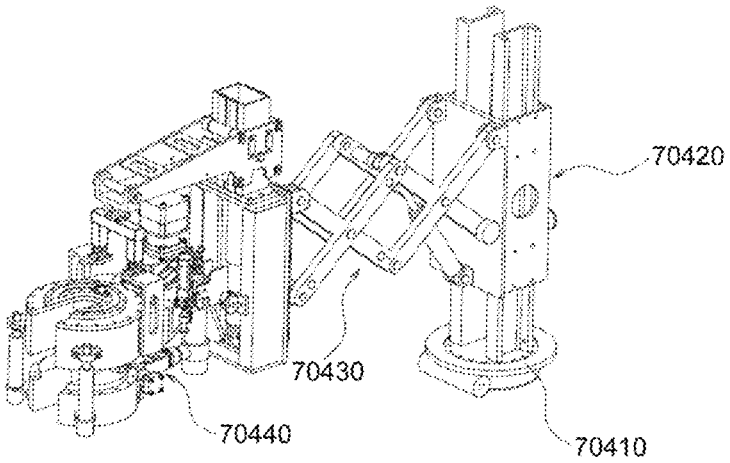
FIG. 25 is a structural schematic diagram of the screwing on and off apparatus, wherein a telescoping mechanism is in an elongated state.

Referring to FIG. 25, the screwing on and off apparatus 70400 may include a rotating mechanism 70410, a lifting fine-tuning mechanism 70420, a telescoping mechanism 70430, and a screwing on and off mechanism 70440, wherein the rotating mechanism 70410 can be mounted on the movable trolley 70320; the lifting fine-tuning mechanism 70420 can be mounted on an output end of the rotating mechanism 70410; the telescoping mechanism 70430 can be mounted on an output end of the lifting fine-tuning mechanism 70420; and the screwing on and off mechanism 70440 can be mounted on an output end of the telescoping mechanism 70430. It can be seen from the preceding that the screwing on and off mechanism 70440 can realize lifting, horizontal telescoping, and rotating movements, so that the screwing on and off mechanism 70440 operates more accurately.

Optionally, the rotating mechanism 70410 can use a rotation decelerator.

Figure 26:
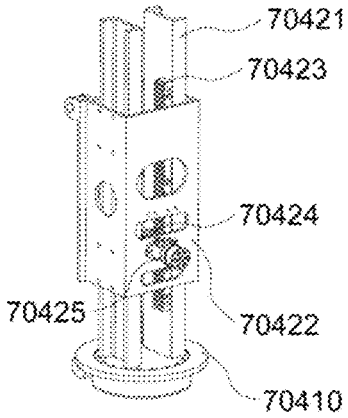
FIG. 26 is a schematic diagram of a connection structure of a lifting fine-tuning mechanism and a rotating mechanism.

Referring to FIG. 26, the lifting fine-tuning mechanism 70420 may include a lifting guide track 70421, a lifting pulley 70422, a rack 70423, a gear 70424, and a lifting motor 70425, wherein the lifting guide track 70421 can be fixedly connected to the output end of the rotating mechanism 70410; the lifting pulley 70422 can be slidably connected to the lifting guide track 70421; the rack 70423 can be fixedly connected to the lifting guide track 70421 and be meshed with the gear 70424; the gear 70424 can be pivotally connected to the lifting pulley 70422 and be in transmission connection with the lifting motor 70425, the lifting motor 70425 can drive the lifting pulley 70422 to move along the lifting guide track 70421; and the telescoping mechanism 70430 can be mounted on the lifting pulley 70422.

In specific operations, the lifting motor 70425 can drive the gear 70424 to rotate, and as the gear 70424 is meshed with the rack 70423, at this time, the gear 70424 can rotate along the rack 70423, and drive the lifting pulley 70422 to perform lifting movement along the lifting guide track 70421 in the rotating process.

In the above, the lifting apparatus 70200 can drive the screwing on and off apparatus 70400 to extend out of the avoidance hole 70111, and when operation is needed, the lifting motor 70425 drives the telescoping mechanism 70430 and the screwing on and off mechanism 70440 to be finely tuned in a vertical direction through the lifting pulley 70422.

Figure 27:
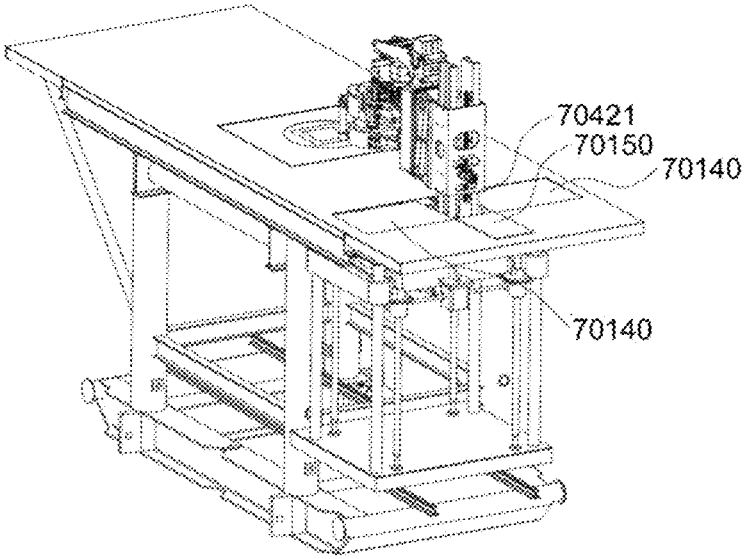
FIG. 27 is a structural schematic diagram of the oil field workover operation device provided in an embodiment of the present disclosure, wherein the screwing on and off apparatus is rotated to an operation angle.

Referring to FIG. 27, in a process that the screwing on and off apparatus 70400 extends out of the avoidance hole 70111, a projection area thereof on the horizontal plane is not larger than a projection area of the avoidance hole 70111, and the lifting guide track 70421 penetrates through the avoidance hole 70111; a first cover plate 70140 and a second cover plate 70150 can be provided at the avoidance hole 70111, and the first cover plate 70140 can cover a part of the avoidance hole 70111 at two sides of the lifting guide track 70421; an area of plate surfaces of the first cover plate 70140 and the second cover plate 70150 can be adapted to an aperture area of the avoidance hole 70111. Such configuration can make the first cover plate 70140 and the second cover plate 70150 completely cover the avoidance hole 70111; meanwhile, in an operation state, the first cover plate 70140 can be made to cover a part of the avoidance hole 70111 at two sides of the lifting guide track 70421, and the second cover plate 70150 is in an opened state.

In the above, the first cover plate 70140 and the second cover plate 70150 can be hinged to the derrick floor panel 70110, so as to ensure that the screwing on and off apparatus 70400 can directly jack up the first cover plate 70140 and the second cover plate 70150 in a rising process, so that the first cover plate 70140 and the second cover plate 70150 are opened.

Figure 28:
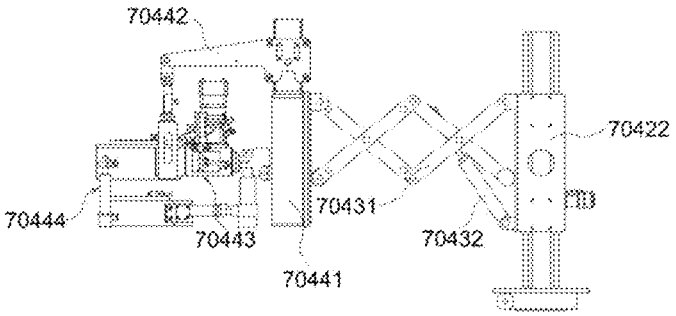
FIG. 28 is a front view of the screwing on and off apparatus device shown in FIG. 25.
Figure 29:
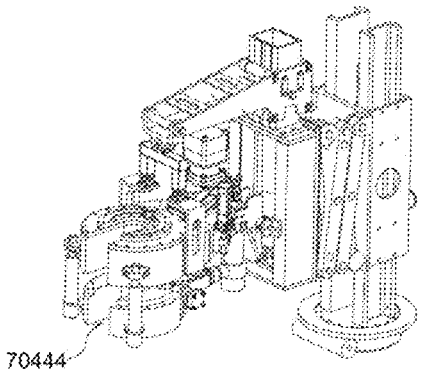
FIG. 29 is a structural schematic diagram of the screwing on and off apparatus, wherein the telescoping mechanism is in a retracted state.

Referring to FIG. 28 and FIG. 29, the telescoping mechanism 70430 may include a scissor-type cross component 70431 and a telescoping hydraulic cylinder 70432, wherein the scissor-type cross component 70431 can be hinged between the lifting pulley 70422 and the screwing on and off mechanism 70440, and the telescoping hydraulic cylinder 70432 can be in transmission connection with the scissor-type cross component 70431, for driving the scissor-type cross component 70431 to extend and retract.

It should be noted that the scissor-type cross component 70431 may use relevant technologies, which will not be repeated in detail herein.

Optionally, the screwing on and off mechanism 70440 may include a bracket 70441, a cantilever 70442, a shifting mechanism 70443, and a hydraulic clamp 70444, wherein the bracket 70441 can be connected to one end of the scissor-type cross component 70431 away from the lifting pulley 70422; the cantilever 70442 can be fixedly connected to a top end of the bracket 70441; the shifting mechanism 70443 can be mounted on the hydraulic clamp 70444; and the hydraulic clamp 70444 can be hinged to the cantilever 70442.

In the above, the bracket 70441 further can be provided with a torque detection sensor for detecting a rotation angle of the hydraulic clamp 70444, so as to control a rotation angle of the rotating mechanism 70410.

To sum up, a process that the oil field workover operation device 70 moves to an operation angle is as follows:

- starting the lifting motor 70240, to make the lifting platform 70230 drive the screwing on and off apparatus 70400 to extend out of the avoidance hole 70111;
- starting the translation drive cylinder 70310, to make it drive, through the movable trolley 70320, the screwing on and off apparatus 70400 to move rightwards to a middle position along the extension direction of the avoidance hole 70111; and
- starting the rotating mechanism 70410, to make it drive the lifting fine-tuning mechanism 70420, the telescoping mechanism 70430, and the screwing on and off apparatus 70440 to rotate by 90° to the operation angle, at which moment, the first cover plate 70140 can be covered.

Next, the integrated hydraulic clamp 700 provided in an embodiment of the present disclosure will be described in detail with reference to FIG. 30 to FIG. 33.

Figure 30:
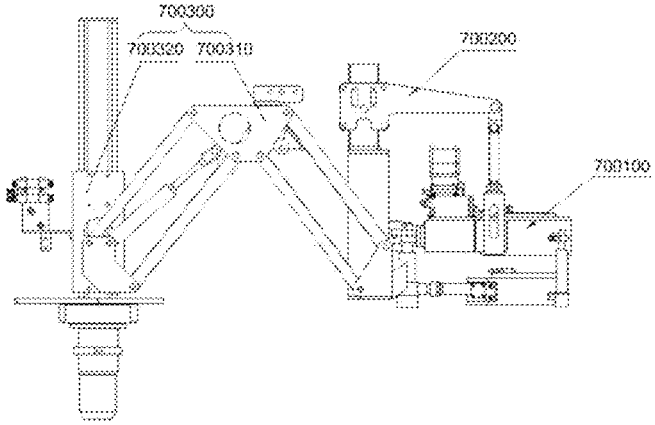
FIG. 30 is a first schematic diagram of an integrated hydraulic clamp provided in an embodiment of the present disclosure.
Figure 31:
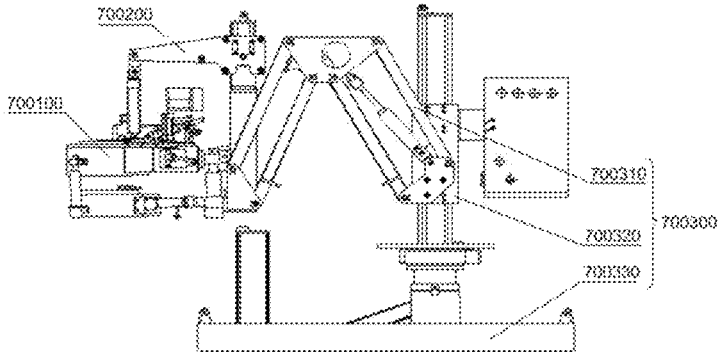
FIG. 31 is a second schematic diagram of the integrated hydraulic clamp provided in an embodiment of the present disclosure.

As shown in FIG. 30 and FIG. 31, the integrated hydraulic clamp 700 provided in an embodiment of the present disclosure may include: a hydraulic clamp body 700100, a floating deflection device 700200, and a movable bracket 700300, wherein

- the floating deflection device 700200 can be connected to the movable bracket 700300, and the hydraulic clamp body 700100 is mounted on the floating deflection device 700200.

Specifically, the movable bracket 700300 can drive the floating deflection device 700200 to move in position, and the hydraulic clamp body 700100 is driven by the floating deflection device 700200 to move. The floating deflection device 700200 has a floating margin, so that the hydraulic clamp body 700100 has an up-down floating amount relative to the movable bracket 700300, and thus the hydraulic clamp body 700100 can be stably fitted to the string, further ensuring smooth progress of the workover operations.

Figure 32:
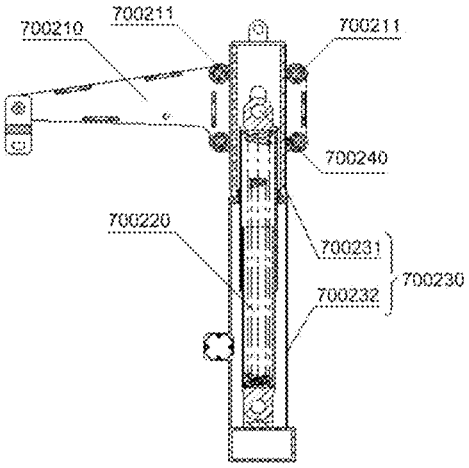
FIG. 32 is a schematic diagram of a floating deflection device of the integrated hydraulic clamp provided in an embodiment of the present disclosure.

As shown in FIG. 30, FIG. 31, and FIG. 32, in an embodiment of the present disclosure, the floating deflection device 700200 may include: a floating mounting frame 700210 and a spring sleeve 700220, wherein one end of the spring sleeve 700220 is connected to the movable bracket 700300, the other end of the spring sleeve 700220 is connected to the floating mounting frame 700210, and the hydraulic clamp body 700100 is mounted on the floating mounting frame 700210.

Specifically, the spring sleeve 700220 can elastically extend and retract longitudinally, and the floating mounting frame 700210 can be made to float longitudinally relative to the movable bracket 700300 through the spring sleeve 700220, further keeping the hydraulic clamp body 700100 stably fitted to the string.

Optionally, the floating deflection device 700200 further may include a floating barrel fixing seat 700230, the floating barrel fixing seat 700230 is mounted on the movable bracket 700300, and the floating mounting frame 700210 is slidably connected to the floating barrel fixing seat 700230.

Specifically, the floating mounting frame 700210 can be fitted to the floating barrel fixing seat 700230, and the floating mounting frame 700210 can slide along the floating barrel fixing seat 700230. In a process that the floating mounting frame 700210 slides along the floating barrel fixing seat 700230, the spring sleeve 700220 is elastically deformed between the floating mounting frame 700210 and the movable bracket 700300, so that the spring sleeve 700220 has an elastic supporting effect on the floating mounting frame 700210.

Optionally, a tackle 700211 can be mounted on the floating mounting frame 700210, the tackle 700211 is fitted to the floating barrel fixing seat 700230, and the tackle 700211 rolls along the floating barrel fixing seat 700230.

Specifically, four tackles 700211 can be mounted on the floating mounting frame 700210, wherein two tackles 700211 are located on one side of the floating barrel fixing seat 700230, and the other two tackles 700211 are located on the other side of the floating barrel fixing seat 700230, and in a sliding process of the floating mounting frame 700210 along the floating barrel fixing seat 700230, the tackles 700211 roll along the floating barrel fixing seat 700230, thus reducing sliding resistance of the floating mounting frame 700210 relative to the floating barrel fixing seat 700230.

Figure 33:
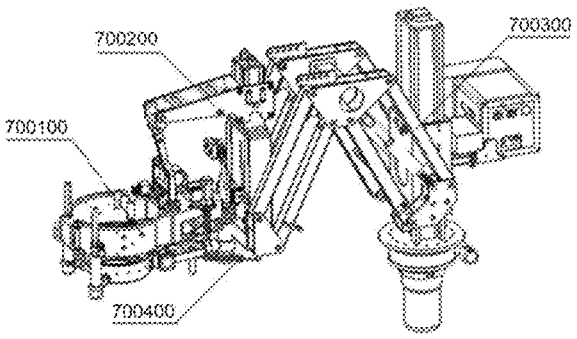
FIG. 33 is a third schematic diagram of the integrated hydraulic clamp provided in an embodiment of the present disclosure.

As shown in FIG. 30, FIG. 31, and FIG. 33, a top portion of the hydraulic clamp body 700100 can be hinged with the floating mounting frame 700210, and a tension spring 700400 can be disposed between the hydraulic clamp body 700100 and the floating barrel fixing seat 700230.

Specifically, the hydraulic clamp body 700100 can swing around a hinge shaft relative to the floating mounting frame 700210, the tension spring 700400 has a traction effect on the hydraulic clamp body 700100, and in a process that the movable bracket 700300 drives the hydraulic clamp body 700100 to move, the tension spring 700400 can mitigate shaking of the hydraulic clamp body 700100 relative to the movable bracket 700300.

As shown in FIG. 32, the spring sleeve 700220 can be connected to the floating mounting frame 700210 through a pin shaft 700240, and the pin shaft 700240 can be slidably connected to the floating barrel fixing seat 700230.

Specifically, a sliding groove can be disposed on the floating barrel fixing seat 700230, and the pin shaft 700240 passes through an end portion of the spring sleeve 700220 and the floating mounting frame 700210, so that the spring sleeve 700220 is connected to the floating mounting frame 700210.

As shown in FIG. 30, FIG. 31, and FIG. 32, the floating barrel fixing seat 700230 may include: a sliding frame 700231 and a stand column 700232, wherein the sliding frame 700231 is mounted in a top portion of the stand column 700232, the floating mounting frame 700210 is slidably connected to the sliding frame 700231, and the stand column 700232 is provided with a chamber for accommodating the spring sleeve 700220.

Specifically, the sliding groove can be provided on the sliding frame 700231, and the floating mounting frame 700210 can slide along the sliding frame 700231. The spring sleeve 700220 can be mounted in the chamber of the stand column 700232, and the spring sleeve 700220 and the stand column 700232 are connected to the movable bracket 700300.

As shown in FIG. 30, FIG. 31, FIG. 32, and FIG. 33, the movable bracket 700300 can include a telescoping boom 700310, and the floating deflection device 700200 is connected to the telescoping boom 700310.

Specifically, a parallelogram boom can be used as the telescoping boom 700310, and the parallelogram boom is driven by the hydraulic cylinder to extend, retract, and deform, so as to adjust the floating deflection device 700200 to move along the horizontal direction.

Optionally, the movable bracket 700300 further may include a lifting pulley 700320, and the telescoping boom 700310 is mounted at a movable end of the lifting pulley 700320.

Specifically, the lifting pulley 700320 may include a stand column and a lifting drive member, the lifting drive member slides along the stand column, and the lifting drive member can drive the telescoping boom 700310 to lift up and down.

Optionally, the movable bracket 700300 further may include a transportation base 700330, and the lifting pulley 700320 is mounted on the transportation base 700330. In the above, the stand column of the lifting pulley 700320 can be rotatably connected to the transportation base 700330, and the lifting pulley 700320 rotates around a longitudinal rotating shaft, so that a position of the floating deflection device 700200 can be adjusted, further making the hydraulic clamp body 700100 move above the string. By driving the telescoping boom 700310 to be lowered down by the lifting pulley 700320, the hydraulic clamp body 700100 can be fitted to the string.

Next, the buckling apparatus 80 provided in an embodiment of the present disclosure will be described in detail with reference to FIG. 34 to FIG. 37.

The buckling apparatus 80 provided in the present embodiment may include a slip component 80100, a drive member 80200, and a pipe centralizing component 80300, wherein the pipe centralizing component 80300 can be movably connected to the slip component 80100, the drive member 80200 can be connected to the slip component 80100 and be in transmission connection with the pipe centralizing component 80300, and the drive member 80200 can be used to drive the pipe centralizing component 80300, so that an axis of the string in the pipe centralizing component 80300 coincides with an axis of the string fixed in the slip component 80100.

Figure 34:
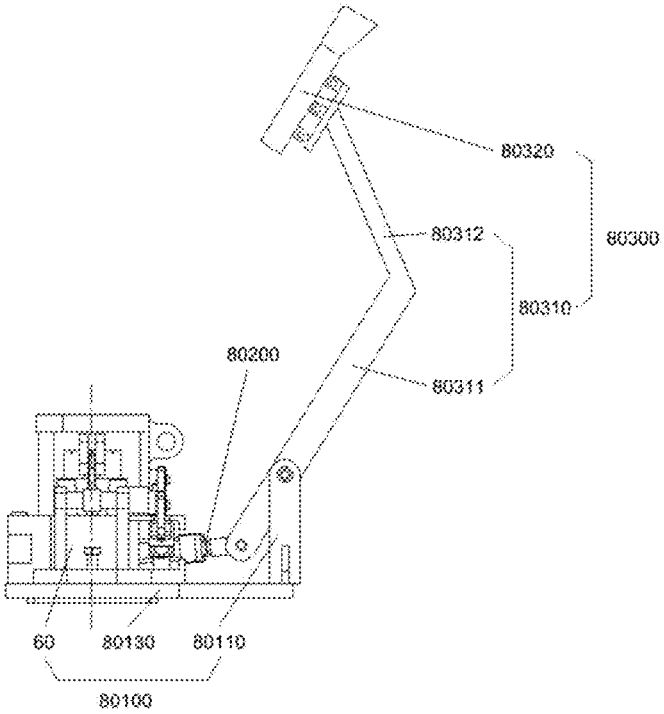
FIG. 34 is a first front view of a buckling apparatus provided in an embodiment of the present disclosure.

In the present embodiment, referring to FIG. 34, the drive member 80200 can be fixedly connected to the slip component 80100, the pipe centralizing component 80300 can be movably connected to the slip component 80100, and the three are integrated into one body. When the slip component

80100 has displacement changes with the derrick, the drive member 80200 and the pipe centralizing component 80300 connected thereto move synchronously therewith. Specifically, in operations of the buckling apparatus, the drive member 80200 is started, and the drive member 80200 drives the pipe centralizing component 80300 to move. After the drive member 80200 drives for a certain period of time, referring to FIG. 35, an axis of a free end of the pipe centralizing component coincides with the axis of the string in the slip component, and at this time, a multi-functional manipulator of the derrick floor grabs the string and places the string into the free end of the pipe centralizing component, so that the axis of the string in the pipe centralizing component coincides with the axis of the string in the slip component, thus realizing accurate buckling of two strings. It can thus be seen that, when the buckling apparatus operates, relative positions of the pipe centralizing component 80300 and the slip component 80100 are unchanged, so that a problem of inaccurate buckling of the strings caused by the displacement change of the slip component 80100 is eliminated, and meanwhile, the buckling of the strings can be realized through cooperation of the slip component 80100, the drive member 80200, and the pipe centralizing component 80300 with each other, which simplifies the structure of the buckling apparatus, thus a space occupied by the buckling apparatus is reduced, and the buckling apparatus is easy to maintain and repair due to the simple structure.

It should be indicated that the drive member 80200 of the present disclosure can use a hydraulic cylinder, an air cylinder, an electric cylinder, a linear motor, and so on.

In an optional technical solution of the present embodiment, the pipe centralizing component 80300 may include a pipe centralizing arm 80310 and a pipe centralizing hand 80320, wherein the pipe centralizing arm 80310 can be movably connected to the slip component 80100 and be in transmission connection with the drive member 80200, and the pipe centralizing hand 80320 can be connected to one end of the pipe centralizing arm 80310 away from the drive member 80200, for guiding buckling of the strings.

Specifically, referring to FIG. 34, the pipe centralizing arm 80310 can be in transmission connection with the drive member 80200, when the drive member 80200 drives the pipe centralizing arm 80310 to move on the slip component 80100, and the pipe centralizing hand 80320 can move synchronously with the pipe centralizing arm 80310. After the drive member 80200 drives for a certain period of time, referring to FIG. 35, an axis of the pipe centralizing hand 80320 coincides with the axis of the string fixed in the slip component 80100, and at this time, the multi-function manipulator of the derrick floor grabs the string and places the string into the pipe centralizing hand 80320, so that two strings are aligned, thereby ensuring accuracy of buckling. Meanwhile, by applying the buckling apparatus of the present disclosure, the pipe is not needed to be manually held, such that work of workmen at the wellhead in a poor working environment is avoided, and occurrence of safety accidents is reduced to a certain extent.

In an optional technical solution of the present embodiment, the pipe centralizing arm 80310 can be rotatably connected to the slip component 80100.

Optionally, the slip component 80100 may include a fixing seat 80110, the slip 60, and a positioning plate 80130, wherein all of the fixing seat 80110, the slip 60, and the drive member 80200 can be connected to the positioning plate 80130, the pipe centralizing arm 80310 can be rotatably connected to the fixing seat 80110 through a rotating shaft, and the drive member 80200 can drive the pipe centralizing arm 80310 to rotate around the axis of the rotating shaft.

Specifically, the fixing seat 80110 can be used to support the pipe centralizing arm 80310, as shown in FIG. 34, a lower end of the pipe centralizing arm 80310 can be hinged to the drive member 80200, a top end of the pipe centralizing arm 80310 can be connected to the pipe centralizing hand 80320, and a position of the pipe centralizing arm 80310 close to the lower end thereof is hinged with the fixing seat 80110, so as to shorten an interval between the fixing seat 80110 and the slip 60, that is, shortening a length of the positioning plate 80130, and further reducing the space occupied by the buckling apparatus.

In the operations of the buckling apparatus of the present embodiment, a case that the drive member 80200 is a hydraulic cylinder, the string fixed in the slip 60 is a first string, and the string to be centralized by the pipe centralizing hand 80320 is a second string is taken as an example.

When the hydraulic cylinder is started, a drive end thereof extends out rightwards, and drives the pipe centralizing arm 80310 to rotate in the anti-clockwise direction, and the pipe centralizing hand 80320 also rotates in the anti-clockwise direction. When the drive end extends out rightwards for a certain stroke, referring to FIG. 35, the axis of the pipe centralizing hand 80320 can be perpendicular to the positioning plate 80130, in this case, the multi-functional manipulator of the derrick floor grabs the second string and places the second string into the pipe centralizing hand 80320, so that an axis of the second string coincides with an axis of the first string, and the pipe centralizing hand 80320 centralizes the second string. When returning, the drive end drives the pipe centralizing arm 80310 to rotate in the clockwise direction, and the pipe centralizing hand 80320 gets out of the way in a direction away from the slip 60.

In an optional technical solution of the present embodiment, the pipe centralizing arm 80310 may include a transmission arm 80311 and a supporting arm 80312 that are connected at an angle, the transmission arm 80311 can be rotatably connected to the fixing seat 80110 through the rotating shaft, the drive member 80200 can be in transmission connection with the transmission arm 80311, one end of the transmission arm 80311 away from the drive member 80200 can be connected to one end of the supporting arm 80312, and the other end of the supporting arm 80312 can be connected to the pipe centralizing hand 80320.

Figure 35:
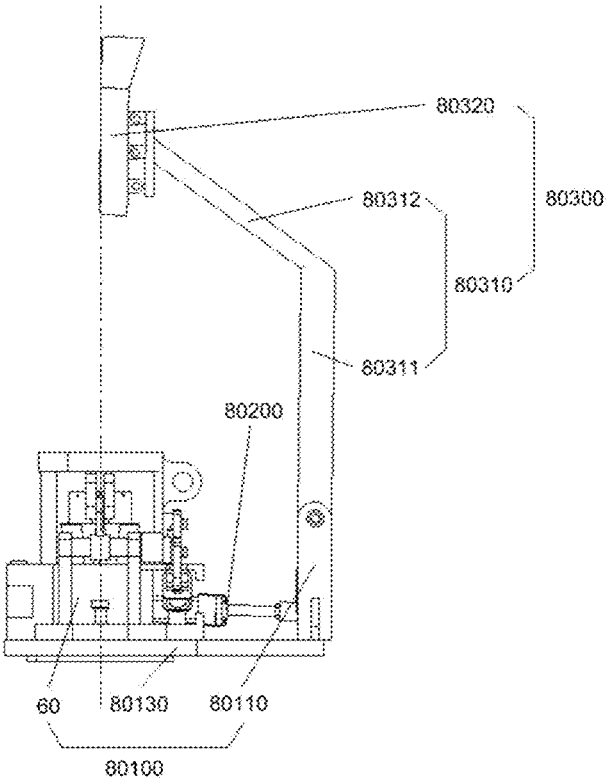
FIG. 35 is a second front view of the buckling apparatus provided in an embodiment of the present disclosure.

Specifically, referring to FIG. 35, a lower end of the transmission arm 80311 can be hinged with the drive member 80200, an upper portion of the transmission arm 80311 can be hinged with the fixing seat 80110, a top end of the transmission arm 80311 can be fixedly connected to a lower end of the supporting arm 80312, an included angle between the transmission arm 80311 and the supporting arm 80312 is an obtuse angle, and an upper end of the supporting arm 80312 can be connected to the pipe centralizing hand 80320. After the pipe centralizing hand 80320 centralizes the string, the axis of the transmission arm 80311 coincides with the axis of the fixing seat 80110. A position where the transmission arm 80311 is located after the string is centralized is just boundary of the buckling apparatus where the fixing seat 80110 is located, and the part of the transmission arm 80311 below a position thereof hinged with the fixing seat 80110 never go beyond the boundary of the buckling apparatus, thus, the space occupied by the buckling apparatus is reduced, and meanwhile, the transmission arm 80311 is prevented from colliding with a person or an object on the right of the positioning plate 80130 during rotation.

The pipe centralizing arm 80310 can be designed as an integrated structure, that is, the transmission arm 80311 and the supporting arm 80312 are integrally formed, or designed as a connected structure, that is, the transmission arm 80311 and the supporting arm 80312 are separately formed, and the two are connected to form the pipe centralizing arm 80310.

Optionally, the pipe centralizing hand 80320 can be detachably connected to the supporting arm 80312.

In an optional technical solution of the present embodiment, the pipe centralizing hand 80320 is a half cylinder, an inner wall of the pipe centralizing hand 80320 is provided with a clamping platform 80321, and the clamping platform 80321 is used to block the string fixed in the slip component 80100.

Figure 36:
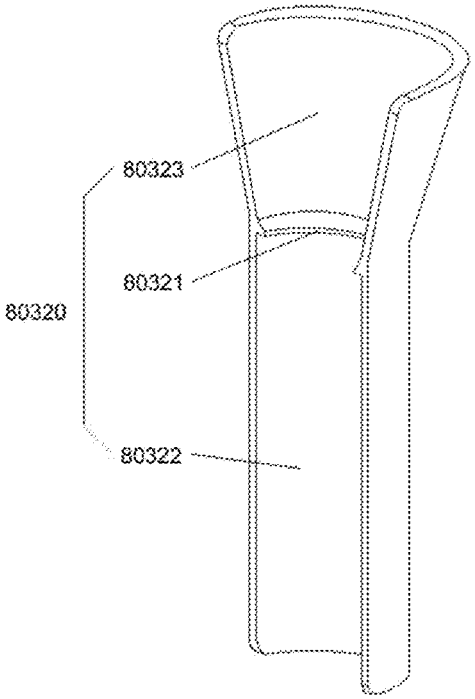
FIG. 36 is a schematic diagram of a pipe centralizing hand of the buckling apparatus provided in an embodiment of the present disclosure.

Specifically, referring to FIG. 35, a right side of the pipe centralizing hand 80320 can be connected to the supporting arm 80312 through a bolt, and referring to FIG. 36, an inner diameter of the pipe centralizing hand 80320 is adapted to a diameter of an outer wall of a string connector. When the inner diameter of the pipe centralizing hand 80320 is not matched with specification of the string to be centralized, the pipe centralizing hand 80320 can be disassembled and replaced, so that the pipe centralizing hand 80320 is adapted to the string. The detachable connection between the pipe centralizing hand 80320 and the supporting arm 80312 guarantees practicability of the pipe centralizing hand 80320, and meanwhile enables the buckling apparatus to buckle strings of different specifications.

In the following, the string fixed in the slip 60 being a first string and the string to be centralized by the pipe centralizing hand 80320 being a second string is taken as an example.

Referring to FIG. 36, the clamping platform 80321 can be disposed along a semi-circumferential direction of the inner wall of the pipe centralizing hand 80320, an inner diameter of the clamping platform 80321 can be greater than an outer diameter of the second string, so that the second string can pass through the clamping platform 80321, an outer diameter of a first string connector can be greater than the inner diameter of the clamping platform 80321, so that a part of an end surface of the first string connector is blocked at a lower end surface of the clamping platform 80321 all the time. It should be indicated that designing clamping platforms of different sizes respectively for the inner walls of a plurality of pipe centralizing hands 80320 with different inner diameters can satisfy the buckling of strings of different specifications.

In an optional technical solution of the present embodiment, the pipe centralizing hand 80320 may include a semi-cylindrical barrel 80322 and a semi-horn barrel 80323, wherein a diameter of a first end of the semi-horn barrel 80323 can be smaller than a diameter of a second end of the semi-horn barrel 80323, the first end of the semi-horn barrel 80323 can be connected to the semi-cylindrical barrel 80322, and the clamping platform 80321 can be located at a joint of the semi-cylindrical barrel 80322 and the semi-horn barrel 80323.

Specifically, referring to FIG. 36, the first end can be a lower end of the semi-horn barrel 80323, and the second end can be an upper end of the semi-horn barrel 80323. From bottom to top, the diameter of the semi-horn barrel 80323 gradually increases; and the first end is connected to an upper end of the semi-cylindrical barrel 80322, and the clamping platform 80321 can be located at the joint of the semi-cylindrical barrel 80322 and the semi-horn barrel 80323. When the pipe centralizing hand 80320 centralizes the string, the existence of the semi-horn barrel 80323 increases a pipe centralizing range of the pipe centralizing hand 80320, so that the string deviated from a rotation path of the pipe centralizing hand 80320 can be accommodated by the semi-horn barrel 80323, and further move into the semi-cylindrical barrel 80322 to be adapted to the semi-cylindrical barrel 80322.

In an optional technical solution of the present embodiment, the drive member 80200 is in transmission connection with the pipe centralizing arm 80310 through a connecting rod 80400, and the connecting rod 80400 is vertically connected to the drive member 80200 and the pipe centralizing arm 80310 respectively.

Figure 37:
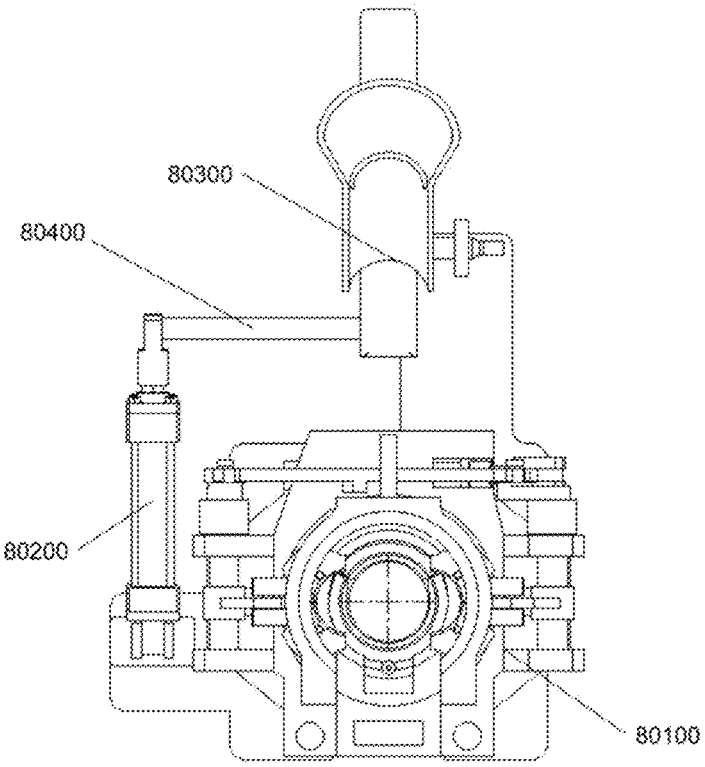
FIG. 37 is a top view of the buckling apparatus provided in an embodiment of the present disclosure.

Specifically, referring to FIG. 37, the drive member 80200 can use a hydraulic cylinder, the hydraulic cylinder can be hinged with the positioning plate 80130 and located on the left of the slip 60, a drive end of the hydraulic cylinder can be hinged with a left end of the connecting rod 80400, a right end of the connecting rod 80400 can be hinged with the transmission arm 80311, and the connecting rod 80400 is perpendicular to the hydraulic cylinder and the transmission arm 80311 respectively, wherein the transmission arm 80311 is located above the slip 60.

In the present embodiment, when the hydraulic cylinder is started, the drive end thereof extends out and drives the connecting rod 80400 to move, and while the connecting rod 80400 is moving, the transmission arm 80311 is made to rotate around the axis of the rotating shaft, so that the pipe centralizing hand 80320 rotates towards the center of the slip 60. With reference to FIG. 35, it can be seen that when the string is in a centralized state, staggered design of the drive member 80200 and the pipe centralizing arm 80310 saves the space occupied by the buckling apparatus, and improves the utilization rate of the space at the wellhead.

A string automated operating apparatus provided in the present embodiment may include the buckling apparatus, thus, technical advantages achieved by the string automated operating apparatus include the technical advantages and effects achieved by the above buckling apparatus, which will not be repeated herein again.

Next, the derrick floor pipe handling manipulator 90 provided in embodiments of the present disclosure will be described in detail with reference to FIG. 38 to FIG. 47.

Figure 38:
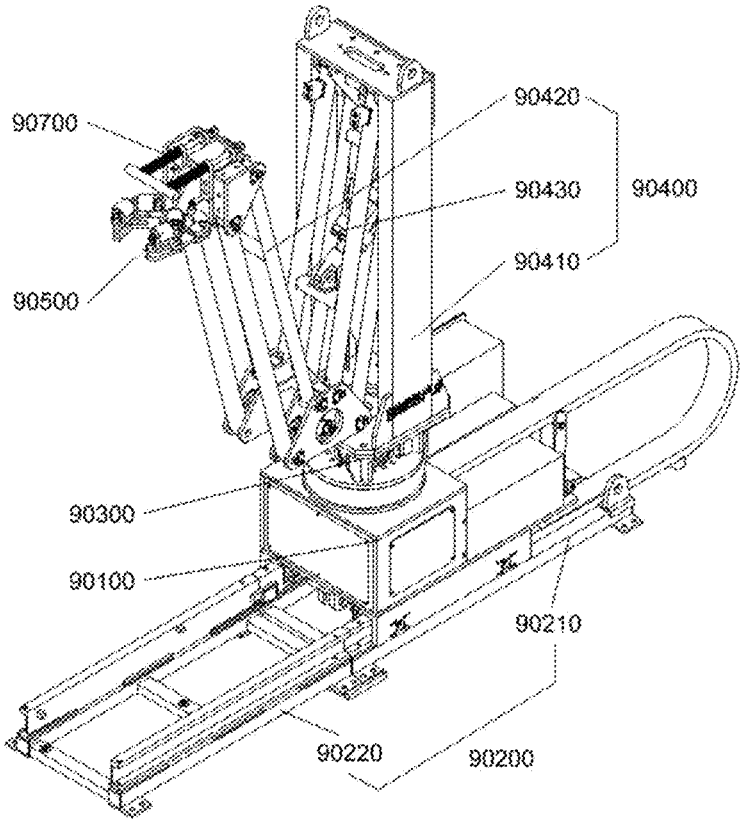
FIG. 38 is a structural schematic diagram of a derrick floor pipe handling manipulator provided in an embodiment of the present disclosure from a first viewing angle.
Figure 39:
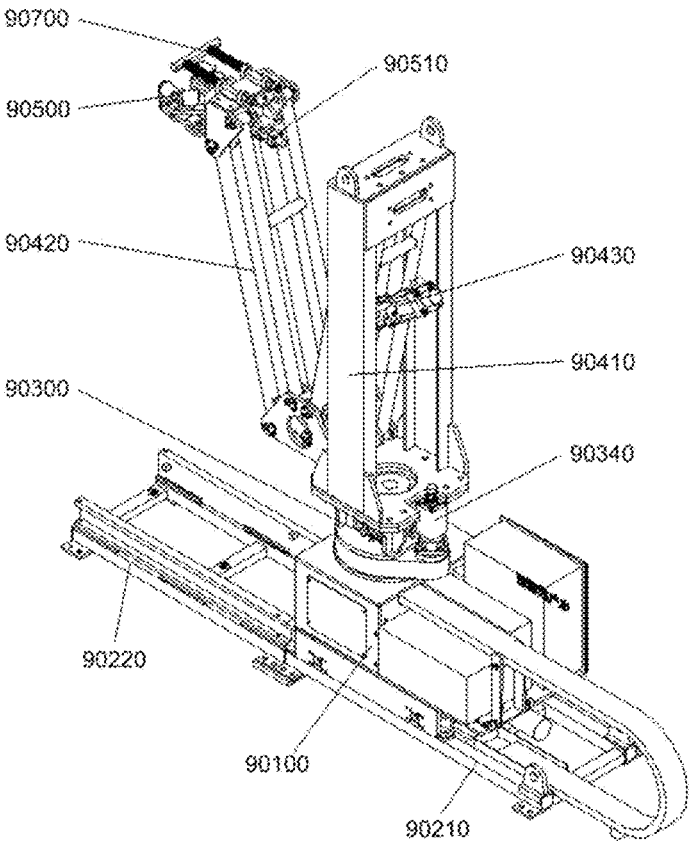
FIG. 39 is a structural schematic diagram of the derrick floor pipe handling manipulator provided in an embodiment of the present disclosure from a second viewing angle.

As shown in FIG. 38 and FIG. 39, the derrick floor pipe handling manipulator 90 provided in the present embodiment may include a trolley feeding mechanism 90100, a base 90200, a rotating mechanism 90300, a boom mechanism 90400, a clamping jaw mechanism 90500, and a first drive member 90600, wherein the trolley feeding mechanism 90100 can be slidably connected to the base 90200, the base 90200 may include a first base 90210 and a second base 90220, the first base 90210 and the second base 90220 can be detachably connected, the first drive member 90600 can be connected to the first base 90210 and be in transmission connection with the trolley feeding mechanism 90100, a bottom end of the rotating mechanism 90300 can be connected to the trolley feeding mechanism 90100, a top end of the rotating mechanism 90300 can be in transmission connection with the boom mechanism 90400, and a free end of the boom mechanism 90400 can be connected with the clamping jaw mechanism 90500.

Specifically, with reference to FIG. 38 to FIG. 41, the first drive member 90600 can be used to drive the trolley feeding mechanism 90100 to slide from the first base 90210 to the second base 90220 or from the second base 90220 to the first base 90210, the rotating mechanism 90300 can be used to drive the boom mechanism 90400 to rotate around a vertical line, and the clamping jaw mechanism 90500 can be used to clamp or release the string. When the derrick floor pipe handling manipulator 90 operates in an operation area, the first drive member 90600 can start and drive the trolley feeding mechanism 90100 to slide on the first base 90210 and the second base 90220, the trolley feeding mechanism 90100 synchronously drives the rotating mechanism 90300, the boom mechanism 90400, and the clamping jaw mechanism 90500 to move, and the rotating mechanism 90300 can drive the clamping jaw mechanism 90500 to rotate through the boom mechanism 90400, such that with the cooperation of the first drive member 90600 and the rotating mechanism 90300, the clamping jaw mechanism 90500 can move to a position where the string is located, and then the string can be grabbed or released by the jaw mechanism 90500. When the derrick floor pipe handling manipulator 90 fails, the trolley feeding mechanism 90100 can be driven by the first drive member 90600 to slide to the first base 90210, then the second base 90220 is detached from the first base 90210, so that a space occupied by the derrick floor pipe handling manipulator 90 in the operation area is reduced, a path is provided for the manual pipe handling, and meanwhile, potential safety risks underfoot during the manual pipe handling are also eliminated, so that the manual pipe handling can still be carried out in cases where the derrick floor pipe handling manipulator 90 fails, ensuring normal progress of the workover operations.

In an optional technical solution of the present embodiment, the first base 90210 can be provided with a first clamping member 90211, the second base 90220 can be provided with a second clamping member 90221 adapted to the first clamping member 90211, and the first base 90210 and the second base 90220 can be connected through a bolt.

In an optional technical solution of the present embodiment, the base 90200 can be provided thereon with a track 90230, two ends of the track 90230 both can be provided with a limiting part, and the limiting part can be used to restrict a sliding range of the trolley feeding mechanism 90100.

Figure 41:
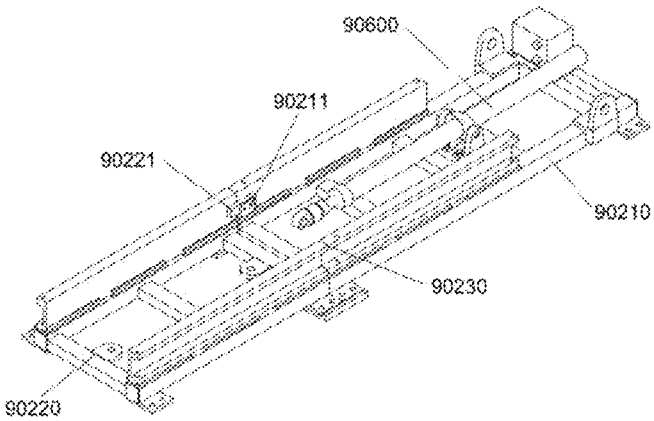
FIG. 41 is a structural schematic diagram of a base of the derrick floor pipe handling manipulator provided in an embodiment of the present disclosure.
Figure 42:
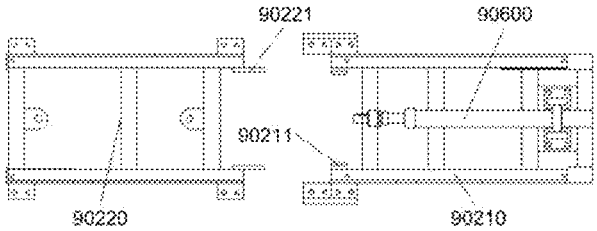
FIG. 42 is a top view of the base of the derrick floor pipe handling manipulator provided in an embodiment of the present disclosure.

Specifically, referring to FIGS. 41 and 42, the first base 90210 and the second base 90220 each may include pedestals and a framework, wherein the pedestals can be welded to four corners of the framework, and the track 90230 can be welded to an upper portion of the framework.

Referring to FIG. 41, the first clamping member 90211 can be disposed at a left end of the first base 90210 and is an L-shaped limiting plate, an end surface of the first clamping member 90211 can be welded to an inner wall of the track 90230 on the first base 90210, the first clamping member 90211 and the track 90230 form a clamping groove, the second clamping member 90221 can be disposed at a right end of the second base 90220, and is an L-shaped insertion plate, a side surface of the second clamping member 90221 can be welded to the inner wall of the track 90230 on the second base 90220, the second clamping member 90221 can be clamped with the clamping groove, and a first side wall of the second clamping member 90221 can be located at one side of the first clamping member 90211 away from the second base 90220, so that the first base 90210 and the second base 90220 are clamped. In another embodiment, it also can be designed in such a manner that the first clamping member 90211 is an L-shaped limiting plate, and the second clamping member 90221 is an L-shaped insertion plate. Besides, the right pedestals of the second base 90220 may be vertically lapped with the left pedestals of the first base 90210, and they are fixed together by bolts, so that the first base 90210 and the second base 90220 are bolted.

Referring to FIG. 41, two ends of the track 90230 can be provided with pin holes, the limiting part can be a stop pin, and the stop pin can be provided in the pin holes. When the trolley feeding mechanism 90100 slides back and forth on the track 90230, the stop pin prevents the trolley feeding mechanism 90100 from sliding out of the track 90230. In addition, the limiting part can use a baffle plate, and the baffle plate can be provided at two ends of the base 90200 for limiting the sliding range of the trolley feeding mechanism 90100.

In an optional technical solution of the present embodiment, the first drive member 90600 may use a hydraulic cylinder, a cylinder body of the hydraulic cylinder can be hinged with the first base 90210, and a drive end of the hydraulic cylinder can be hinged with the trolley feeding mechanism 90100.

Figure 40:
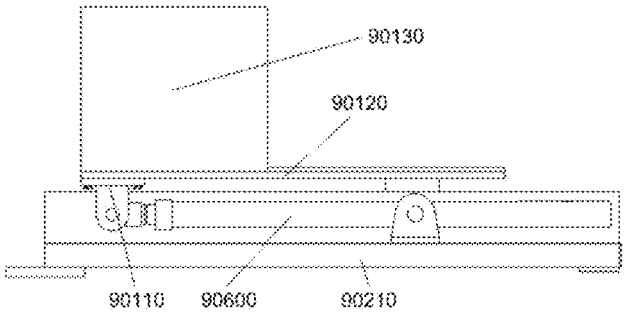
FIG. 40 is a structural schematic diagram of a trolley feeding mechanism of the derrick floor pipe handling manipulator provided in an embodiment of the present disclosure.

Specifically, referring to FIG. 40 and FIG. 41, the cylinder body of the hydraulic cylinder can be hinged with the first base 90210, the drive end of the hydraulic cylinder can be hinged with the bottom of the trolley feeding mechanism 90100, and when the hydraulic cylinder is operating, the drive end thereof can push the trolley feeding mechanism 90100 to move linearly on the track 90230, and further drive the rotating mechanism 90300, the boom mechanism 90400, and the clamping jaw mechanism 90500 to move along a length direction of the track 90230. When the derrick floor pipe handling manipulator 90 is not in operation or needs to give way, the drive end of the hydraulic cylinder returns and drives the trolley feeding mechanism 90100 back to the first base 90210; when the derrick floor pipe handling manipulator 90 fails or the manual pipe handling is required for the operation, the hydraulic cylinder can drive the trolley feeding mechanism 90100 back to the first base 90210, and then the second base 90220 is disassembled, so that the manual pipe handling can be carried out.

It should be supplemented that using the hydraulic cylinder as the drive member of the trolley feeding mechanism 90100, a transmission mode thereof is simple, and it is easy to maintain when it fails.

In an optional technical solution of the present embodiment, the clamping jaw mechanism 90500 may include a second drive member 90510, a first link rod 90520, a second link rod 90530, two third link rods 90540, and two curved rods 90550, wherein the curved rods 90550 can be in a bent shape, and openings of the two curved rods 90550 are disposed opposite to each other. The second drive member 90510 can be mounted on the boom mechanism 90400 and be in transmission connection with the first link rod 90520. Two ends of the first link rod 90520 can be respectively hinged with one end of the two third link rods 90540, and the other ends of the two third link rods 90540 can be correspondingly hinged to bent parts of the two curved rods 90550 respectively. The second link rod 90530 can be connected to the boom mechanism 90400, two ends of the second link rod 90530 can be respectively hinged to one end of the two curved rods 90550 close to the first link rod 90520, and the other ends of the two curved rods 90550 can move close to or away from each other under driving of the third link rods 90540, so that the other ends of the two curved rods 90550 are in a fully opened state, a half opened and half closed state, or a fully closed state.

Figure 43:
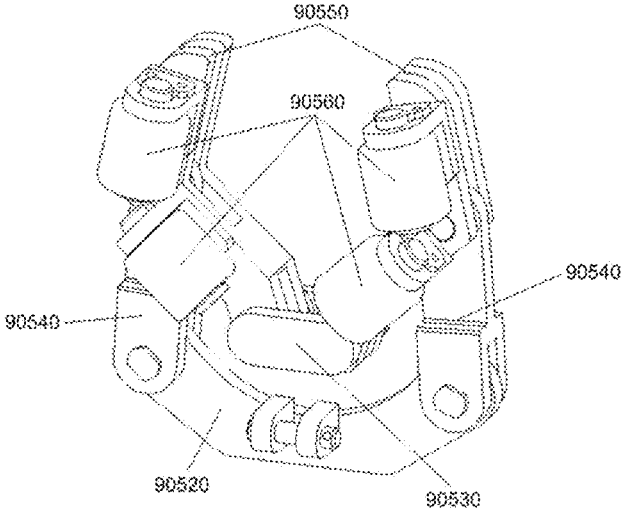
FIG. 43 is a structural schematic diagram of a clamping jaw mechanism of the derrick floor pipe handling manipulator provided in an embodiment of the present disclosure.
Figure 44:
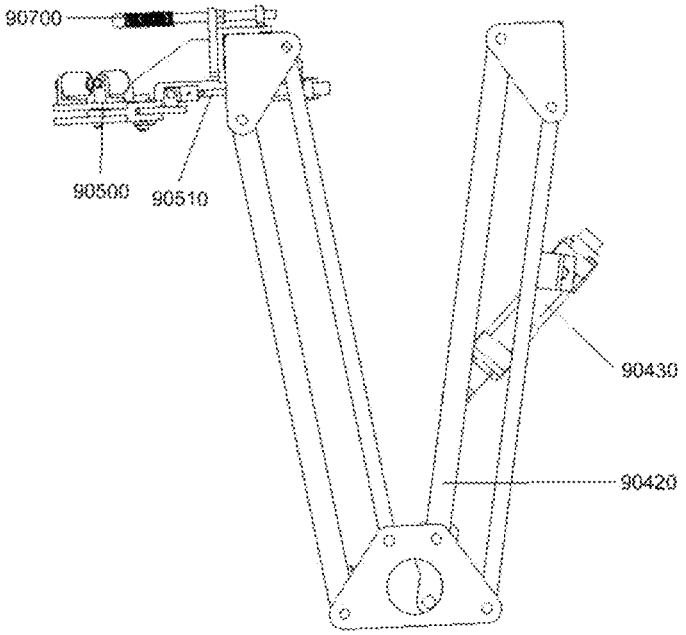
FIG. 44 is a structural schematic diagram of a telescoping boom of the derrick floor pipe handling manipulator provided in an embodiment of the present disclosure.

In the present embodiment, referring to FIG. 43 and FIG. 44, the second drive member 90510 may use a hydraulic cylinder, a cylinder body of the hydraulic cylinder can be mounted on the boom mechanism 90400, a drive end of the hydraulic cylinder can be hinged to a middle portion of the first link rod 90520, and when the clamping jaw mechanism 90500 is in operation, a stroke of the drive end of the hydraulic cylinder can control an opened or closed state of the curved rods 90550. Specifically, taking that the drive end of the hydraulic cylinder extends out as an example, referring to FIG. 43, the second link rod 90530 can be fixed to the boom mechanism 90400, and the first link rod 90520 can move upwards under the driving of the hydraulic cylinder, and synchronously drive the two third link rods 90540 to rotate to directions of approaching each other around a hinge axis at a lower end thereof, such that the two curved rods 90550 rotate around their hinge axes to directions of approaching each other, thus realizing that the upper ends of the two curved rods 90550 get close to each other.

During continued extension of the drive end of the hydraulic cylinder, component states of the two curved rods 90550 are gradually changed from fully opened to half opened and half closed and fully closed. In practical application, when the clamping jaw mechanism 90500 is ready to grab the string, the two curved rods 90550 are in the fully opened state; when the string is clamped or the string is driven to rotate, the two curved rods 90550 are in a half opened and half closed state; and when the strings are buckled, the two curved rods 90550 are in the fully closed state, so that the strings are tightly clamped, not easy to vibrate, and easy to buckle.

Optionally, a plurality of rollers 90560 can be provided on the curved rods 90550, and when the curved rods 90550 clamp the string, the plurality of rollers 90560 can be in rolling fit with the string.

Specifically, referring to FIG. 43, a first seat can be provided in an upper portion of a bent position of the curved rods 90550, a second seat can be provided in a lower portion of the bent position of the curved rods 90550, and the plurality of rollers 90560 can be rotatably connected to the first seat and the second seat respectively. When the upper ends of the two curved rods 90550 move close to or away from each other, the rollers 90560 move synchronously therewith; if the two curved rods 90550 are in the fully closed state and clamp the string, a circumferential surface of the string abuts against circumferential surfaces of the rollers 90560; and when the string moves up and down, the rollers 90560 can slide relative to the string, thus effectively preventing the curved rods 90550 from scratching a surface of the string.

The trolley feeding mechanism 90100 may include a feeding trolley 90110, a first holding plate 90120, and a supporting framework 90130, wherein the feeding trolley 90110 can be slidably connected to the base 90200 and be in transmission connection with the first drive member 90600, a bottom surface of the first holding plate 90120 can be connected to the feeding trolley 90110, an upper surface of the first holding plate 90120 can be connected to the supporting framework 90130, and the rotating mechanism 90300 can be mounted on the supporting framework 90130.

Referring to FIG. 40, the feeding trolley 90110 can be slidably connected to the track 90230, the first drive member 90600 can be in transmission connection with a bottom end of the feeding trolley 90110, and the rotating mechanism 90300 can be connected to the feeding trolley 90110 through the first holding plate 90120 and the supporting framework 90130. When the first drive member 90600 is started, the feeding trolley 90110 can slide on the track 90230 and drive the rotating mechanism 90300 to move in the horizontal direction.

In an optional technical solution of the present embodiment, the rotating mechanism 90300 may include a rotating base 90310, a rotating component 90320, a decelerator 90330, and a fourth drive member 90340, wherein the rotating base 90310 can be mounted on the trolley feeding mechanism 90100, and be rotatably connected to the rotating component 90320, and the rotating component 90320 can be connected to the boom mechanism 90400, and be in transmission connection with the decelerator 90330, and the decelerator 90330 can be connected to the rotating base 90310, and be in transmission connection with the fourth drive member 90340.

Figure 46:
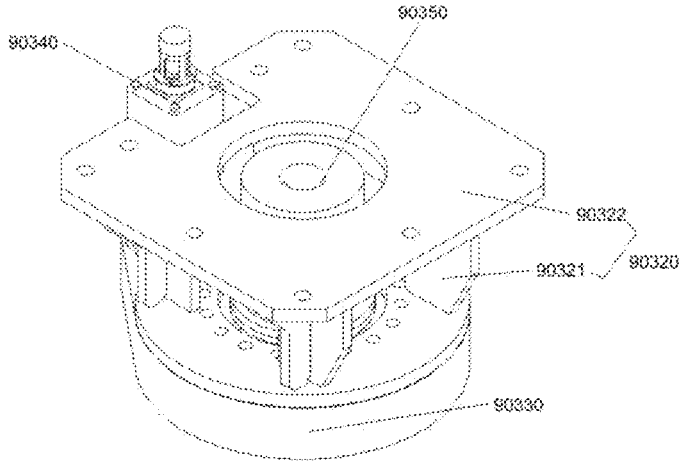
FIG. 46 is a structural schematic diagram of a rotating mechanism of the derrick floor pipe handling manipulator provided in an embodiment of the present disclosure.
Figure 47:
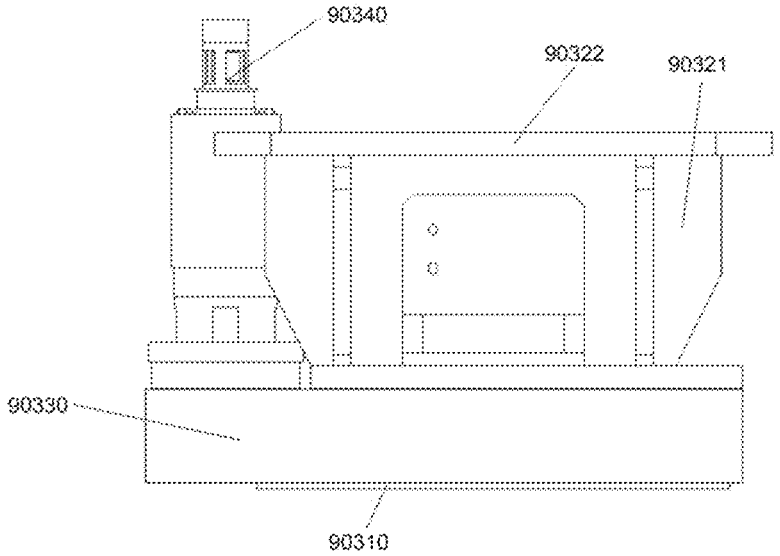
FIG. 47 is a front view of the rotating mechanism of the derrick floor pipe handling manipulator provided in an embodiment of the present disclosure.

In the present embodiment, with reference to FIG. 39, FIG. 46, and FIG. 47, the rotating mechanism 90300 further may include a hydraulic transducer 90350, the hydraulic transducer 90350 may include a fixed flange and a rotary drum rotatably connected to each other, and the rotating component 90320 may include the supporting frame 90321 and the second holding plate 90322 fixedly connected to each other, wherein the fixed flange and the rotary drum can be disposed in the supporting frame 90321, the fixed flange is fixedly connected to the rotating base 90310, the rotary drum is connected to the supporting frame 90321, the supporting frame 90321 and the rotating base 90310 can be rotatably connected and be in transmission connection with the decelerator 90330, the boom mechanism 90400 can be connected to the second holding plate 90322 and the fourth drive member 90340 can use a hydraulic motor. Specifically, when the hydraulic motor is started, the hydraulic motor can drive the decelerator 90330 to move, the decelerator 90330 can drive the supporting frame 90321 to rotate, and further drive the rotary drum and the second holding plate 90322 to rotate, and the boom mechanism 90400 can synchronously rotate with the second holding plate 90322.

In an optional technical solution of the present embodiment, the boom mechanism 90400 may include a supporting boom 90410, a telescoping boom 90420, and a third drive member 90430, wherein one end of the supporting boom 90410 can be connected to the rotating mechanism 90300, and the other end can be hinged with a first end of the telescoping boom 90420, a second end of the telescoping boom 90420 can be connected to the clamping jaw mechanism 90500, and the third drive member 90430 can be hinged with the supporting boom 90410 and be in transmission connection with the telescoping boom 90420.

In the present embodiment, referring to FIG. 38 and FIG. 46, the supporting boom 90410 can be mounted on the second holding plate 90322, the third drive member 90430 can use a hydraulic cylinder, a cylinder body of the hydraulic cylinder can be hinged with the supporting boom 90410, a drive end of the hydraulic cylinder can be hinged with the telescoping boom 90420, when the hydraulic cylinder is started, the drive end thereof can drive the telescoping boom 90420 to rotate around a hinge axis of the telescoping boom 90420, so as to mainly realize height change of the telescoping boom 90420 in a vertical direction.

To sum up, through the cooperation of the first drive member 90600, the fourth drive member 90340, and the third drive member 90430, the clamping jaw mechanism 90500 can realize the movement in the horizontal direction, the rotation around the vertical axis, and the movement in the vertical direction respectively, ensuring that the clamping jaw mechanism 90500 can be adapted to strings at different positions.

In an optional technical solution of the present embodiment, referring to FIG. 44, the second end of the telescoping boom 90420 can be provided with a buffer mechanism 90700, the buffer mechanism 90700 can be located at an upper end of the clamping jaw mechanism 90500, and the buffer mechanism 90700 may include a buffer rod 90710, a supporting rod 90720, a supporting base 90730, and a buffer spring 90740, wherein the buffer rod 90710 can be connected to one end of the supporting rod 90720, and the supporting rod 90720 can be slidably connected to the supporting base 90730, the supporting base 90730 can be connected to the telescoping boom 90420, the buffer spring 90740 can be sleeved on the supporting rod 90720, and two ends of the buffer spring 90740 abut against the buffer rod 90710 and the supporting base 90730 respectively. When the clamping jaw mechanism 90500 clamps the string, the buffer rod 90710 is impacted by the string, and the buffer spring 90740 has a tendency to make the string move in a direction away from the telescoping boom 90420.

Figure 45:
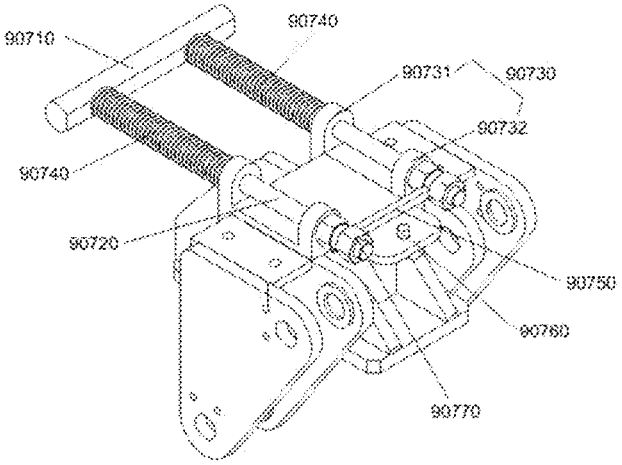
FIG. 45 is a structural schematic diagram of a buffer mechanism of the derrick floor pipe handling manipulator provided in an embodiment of the present disclosure.

Specifically, referring to FIG. 45, the supporting base 90730 may include a first supporting base 90731 and a second supporting base 90732, a locking nut 90770 can be thread-fitted to the supporting rod 90720 and located between the first supporting base 90731 and the second supporting base 90732, or located on the right of the second supporting base 90732, the first supporting base 90731 can be bolted to the telescoping boom 90420, and the second supporting base 90732 can be welded to the telescoping boom 90420. After the clamping jaw mechanism 90500 grabs the string, the string impacts the buffer rod 90710, so that the buffer rod 90710 moves rightwards, and drives the supporting rod 90720 to move rightwards. Meanwhile, the buffer rod 90710 compresses the buffer spring 90740, so that an impact force of the string is borne by the compressed spring, thus relieving the impact force of the string on the boom mechanism 90400 to a certain extent. It should be noted that, when the supporting rod 90720 slides, the locking nut 90770 can move synchronously for preventing the supporting rod 90720 from being detached from the supporting base 90730. In addition, a position of the threaded fit between the locking nut 90770 and the supporting rod 90720 determines compression degree of the buffer spring 90740, and further affects a movement distance of the buffer rod 90710 when being impacted by the string. Therefore, by changing the position of the locking nut 90770, the buffer mechanism 90700 can be adapted to strings of different specifications, so as to relieve an impact force thereof on the boom mechanism 90400.

Optionally, an induction rod 90750 can be connected to the supporting rod 90720, and the telescoping boom 90420 can be provided with a proximity switch 90760, then when the buffer rod 90710 is impacted by the string, the proximity switch 90760 can be triggered due to contact with the induction rod 90750.

Specifically, referring to what is shown in FIG. 45, each supporting rod 90720 can be provided thereon with two locking nuts 90770, and the two locking nuts 90770 can be arranged at intervals for clamping the induction rod 90750. When a string is clamped in the clamping jaw mechanism 90500, the string pushes the buffer rod 90710 to move rightwards, and drives the supporting rod 90720 to move rightwards, the induction rod 90750 synchronously moves therewith, and contacts the proximity switch 90760, so as to trigger the proximity switch 90760. In turn, trigger of the proximity switch 90760 also proves that a string is clamped within the clamping jaw mechanism 90500.

Next, the driller centralized control operating apparatus 100 provided in an embodiment of the present disclosure will be described in detail.

In an exemplary embodiment of the present disclosure, the driller centralized control operating apparatus 100 can integrally design an automated operating system, a workover rig operating system, and a monitoring system into an operation panel, and internal layout can be divided, according to functions, into a workover rig operation region, an automated equipment operation region, a video monitoring and automated equipment parameter setting region.

In some embodiments of the present disclosure, the driller centralized control operating apparatus 100 can be highly integrated, remotely controlled, and operated in one key mode, to realize the operation process management of each unit. In some optional embodiments, the driller centralized control operating apparatus 100 may have a mechanism of multi-level safety emergency stop for unit body emergency stop and device total emergency stop and pause, and in a synchronous operation process of multiple devices, the driller centralized control operating apparatus 100 detects device position information in real time, and realizes motion anti-collision and interlocking protection of the devices. In addition, the driller centralized control operating apparatus 100 can have device status and parameter collection, storage, and fault alarm diagnosis functions. Preferably, the functions of the driller centralized control operating apparatus 100 can be flexibly switched remotely/locally, manually/automatically. The driller centralized control operating apparatus 100 is highly integrated, and one driller can complete the tripping operation.

Next, the hydraulic station 110 provided in an embodiment of the present disclosure will be described in detail.

The hydraulic station 110 may include a skid-mounted seat, a hydraulic oil tank, a pump set, connecting pipelines, various valve sets, a control system, and other auxiliary supporting measures. The hydraulic station 110 can be used to provide power to the derrick floor pipe handling manipulator 90, the buckling apparatus 80, the integrated hydraulic clamp 700, the power catwalk 30, the elevator 40 and so on.

The hydraulic station 110 can consist of two identical motors and two identical oil pumps, one group of "electric motor+oil pump" is for use, and the other for standby; the two pumps operate independently, with interlocked electrical control, are equipped with independent cooling system and heating system, and have temperature sensing and PLC automatic control.

The automated equipment 1 for drilling and workover operations of oil field in the exemplary embodiments of the present disclosure completes the lowering operation and the lifting operation of the string 1000 at the wellhead through cooperation of the workover rig 10, the derrick floor 20, the elevator 40, the monkey-board string automatic placement apparatus 50, the slip 60, the oil field workover operation device 70, the buckling apparatus 80, and the derrick floor pipe handling manipulator 90.

Figure 48:
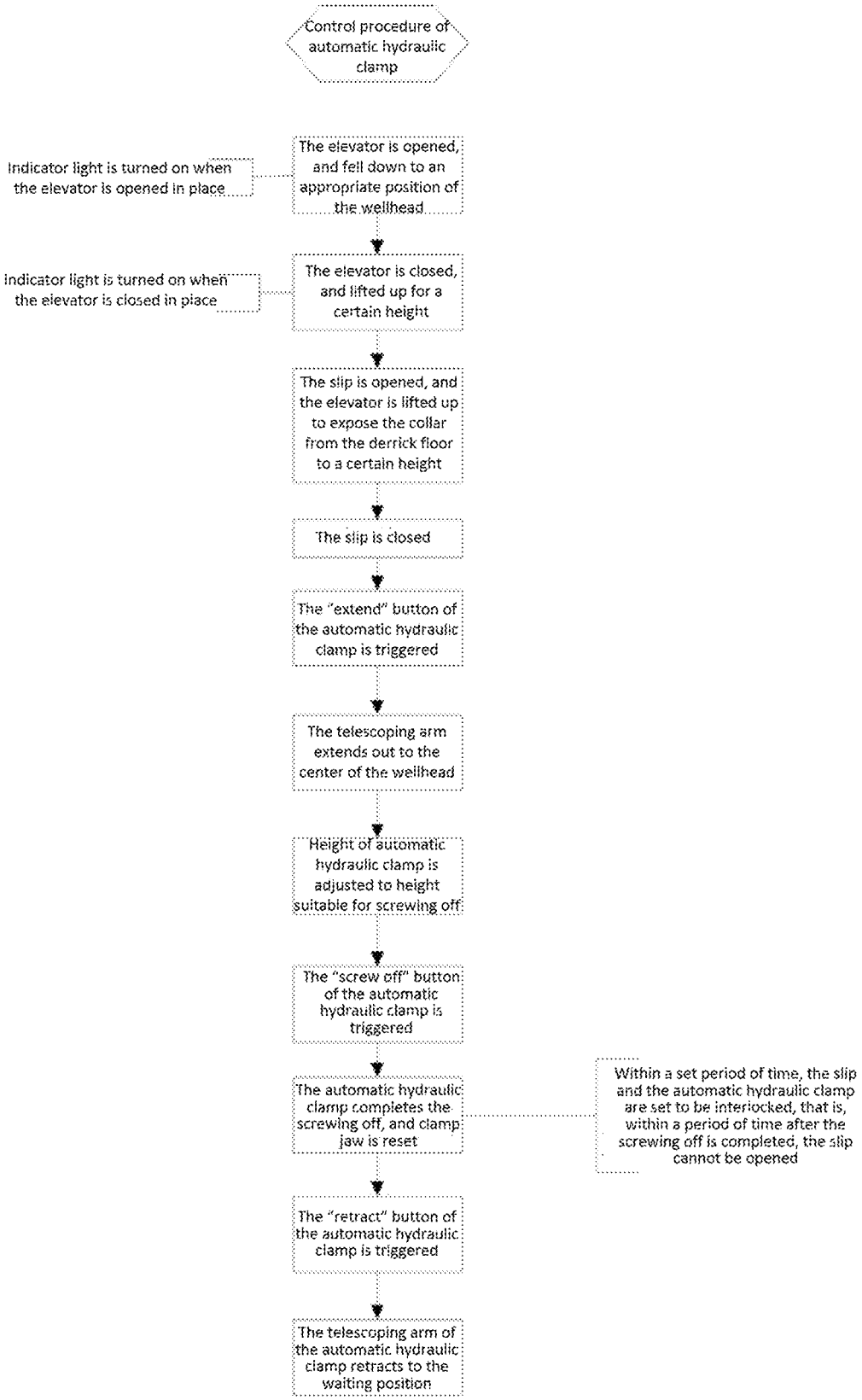
FIG. 48 is a flowchart of a control procedure of a string lifting process of the integrated hydraulic clamp provided in an embodiment of the present disclosure.

Next, a control procedure of the lifting process of the integrated hydraulic clamp 700 provided in an embodiment of the present disclosure will be described in detail with reference to FIG. 48. FIG. 48 is a flowchart of the control procedure of the lifting process of the integrated hydraulic clamp 700 provided in an embodiment of the present disclosure.

As shown in FIG. 48, in the lifting operation of the string 1000, after the elevator 40 is started, the elevator 40 is fell down to an appropriate position of the wellhead so as to clamp the string 1000 on which the lifting operation is to be performed. After that, the slip 60 is opened, and the elevator 40 lifts up the string 1000 for a certain height, so as to lift up the string 1000 such that the collar is exposed from the derrick floor 20 for a certain height. At this time, the slip 60 can be closed. Next, the telescoping arm of the hydraulic clamp 700 extends out to the center of the wellhead, and the height of the hydraulic clamp 700 is adjusted to a height suitable for screwing off. Then the hydraulic clamp 700 screws off the string 1000, and after the string 1000 is screwed off, the slip 60 and the hydraulic clamp 700 are interlocked so that the slip 60 cannot be opened for a period of time. Next, the telescoping arm of the hydraulic clamp 700 retracts to a waiting position.

Figure 49:
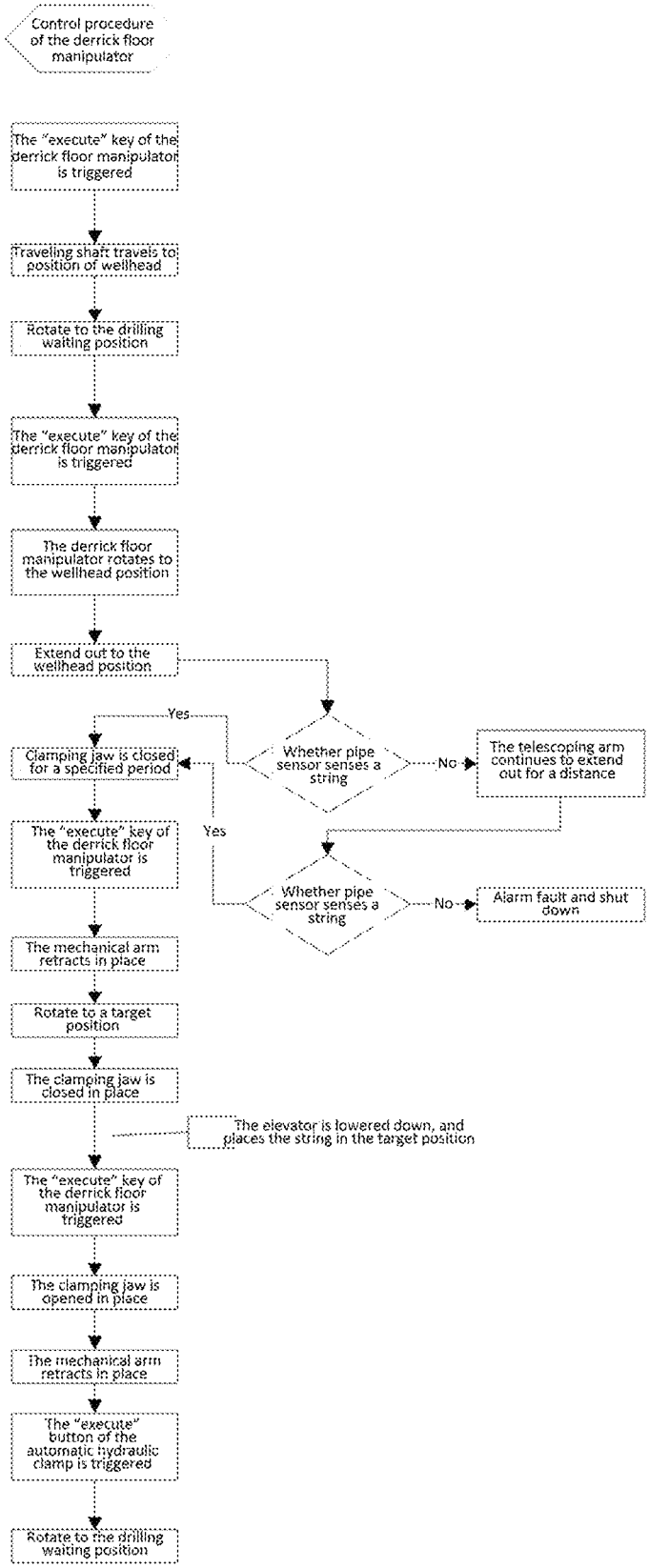
FIG. 49 is a flowchart of a control procedure of a string lifting process of the derrick floor pipe handling manipulator provided in an embodiment of the present disclosure.

Next, the control procedure of the lifting process of the derrick floor pipe handling manipulator 90 provided in an embodiment of the present disclosure will be described in detail with reference to FIG. 49. FIG. 49 is a flowchart of the control procedure of the lifting process of the derrick floor pipe handling manipulator 90 provided in an embodiment of the present disclosure.

As shown in FIG. 49, in the lifting operation of the string 1000, after the string 1000 is screwed off, the derrick floor pipe handling manipulator 90 can travel to a wellhead position, i.e., the second position close to the slip 60, and then the derrick floor pipe handling manipulator 90 can rotate to a drilling waiting position, i.e., the facing position facing the slip 60. Next, the derrick floor pipe handling manipulator 90 extends out to the wellhead position so as to detect whether the string 1000 exists and grab the string 1000. When a pipe sensor senses the string 1000, the telescoping arm of the derrick floor pipe handling manipulator 90 stops, and when the telescoping arm of the derrick floor pipe handling manipulator 90 reaches a target position, the clamping jaw of the derrick floor pipe handling manipulator 90 is closed for a specified period of time. When the pipe sensor does not sense the string 1000, a fault alarm is sent, and the derrick floor pipe handling manipulator 90 is shut down. During the closing of the clamping jaw, the elevator 40 lifts up the string 1000 so that the string 1000 is disengaged from the collar. Then, the telescoping arm of the derrick floor pipe handling manipulator 90 retracts, and the derrick floor pipe handling manipulator 90 rotates to the target position, i.e., the back position facing back to the slip 60, so as to convey the disengaged string 1000 to above the string storage portion 20130. Next, the elevator 40 can lower down the string 1000 until the first end portion of the string 1000 is placed into the string storage portion 20130. After that, the clamping jaw of the derrick floor pipe handling manipulator 90 is opened, and when the clamping jaw is opened in place, the telescoping arm of the derrick floor pipe handling manipulator 90 retracts, and the derrick floor pipe handling manipulator 90 rotates to the drilling waiting position.

Figure 50:
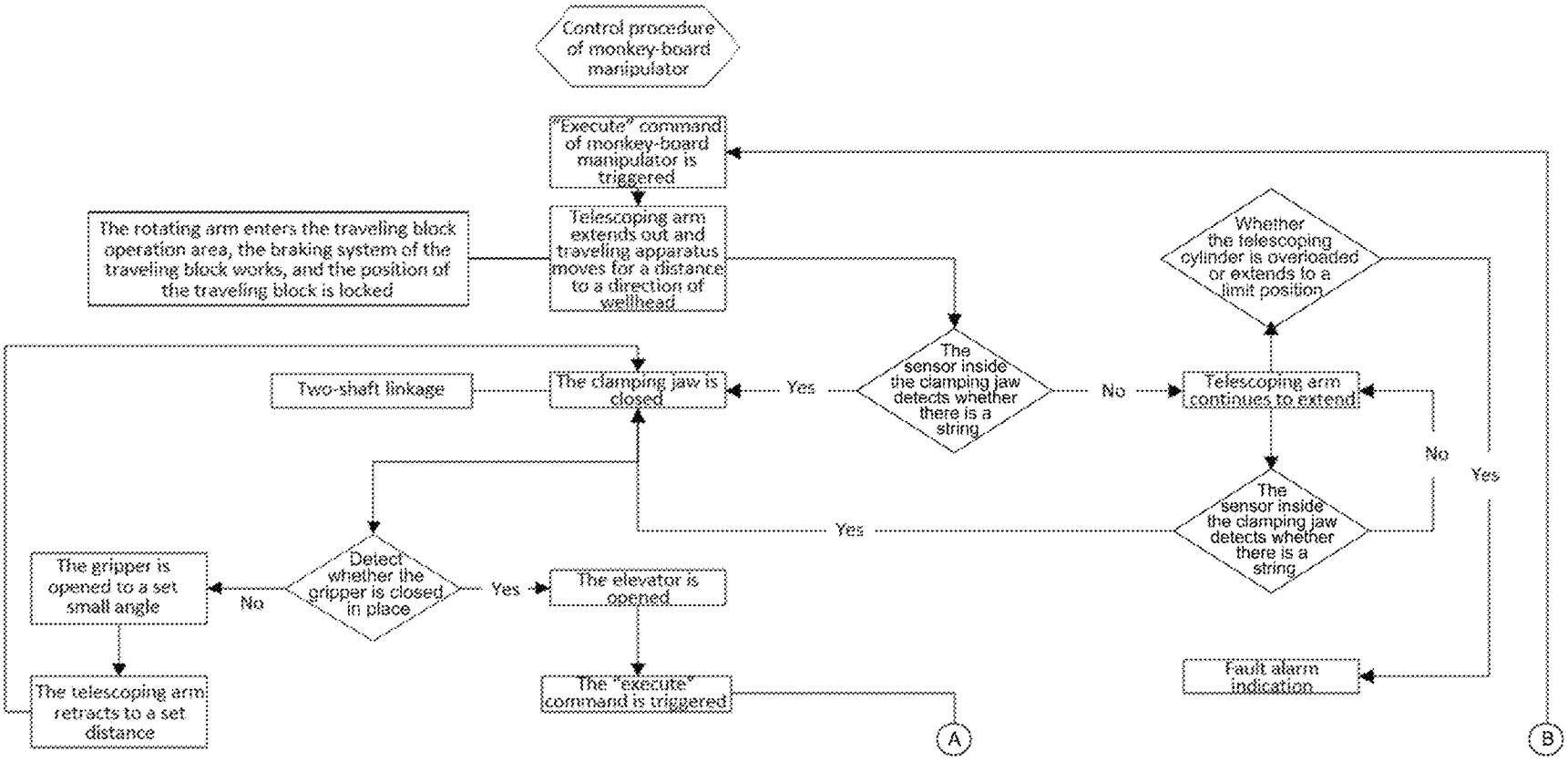
FIG. 50 is a flowchart of a control procedure of a string lifting process of the monkey-board manipulator of the monkey-board string automatic placement apparatus provided in an embodiment of the present disclosure.
Figure 50:
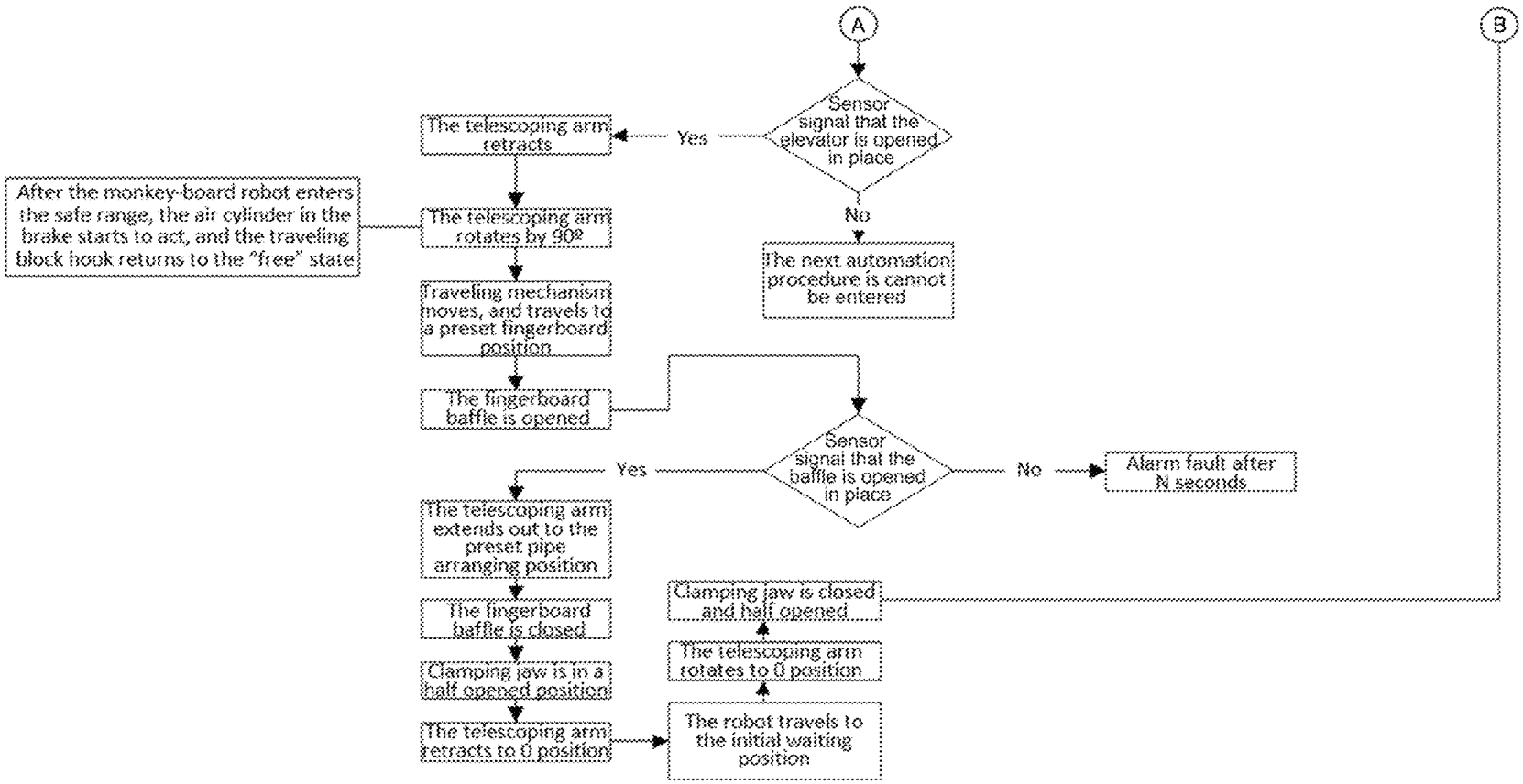
Figure 51A:
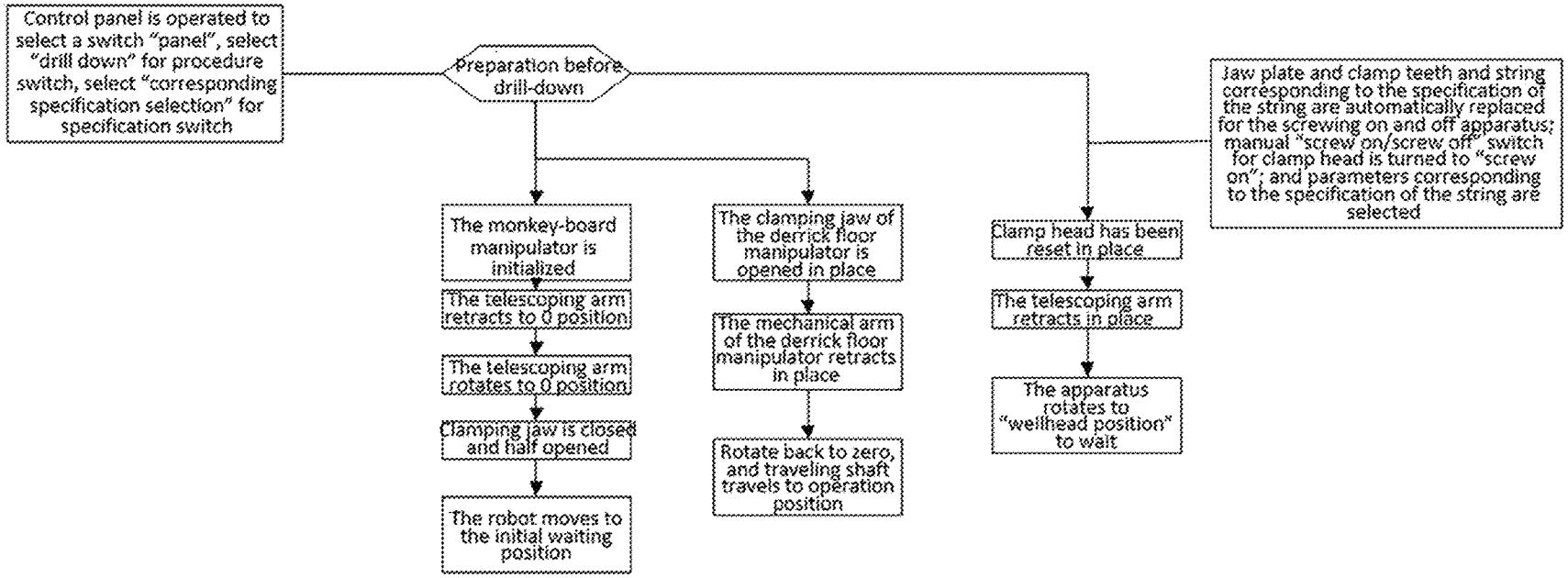
Figure 51B:
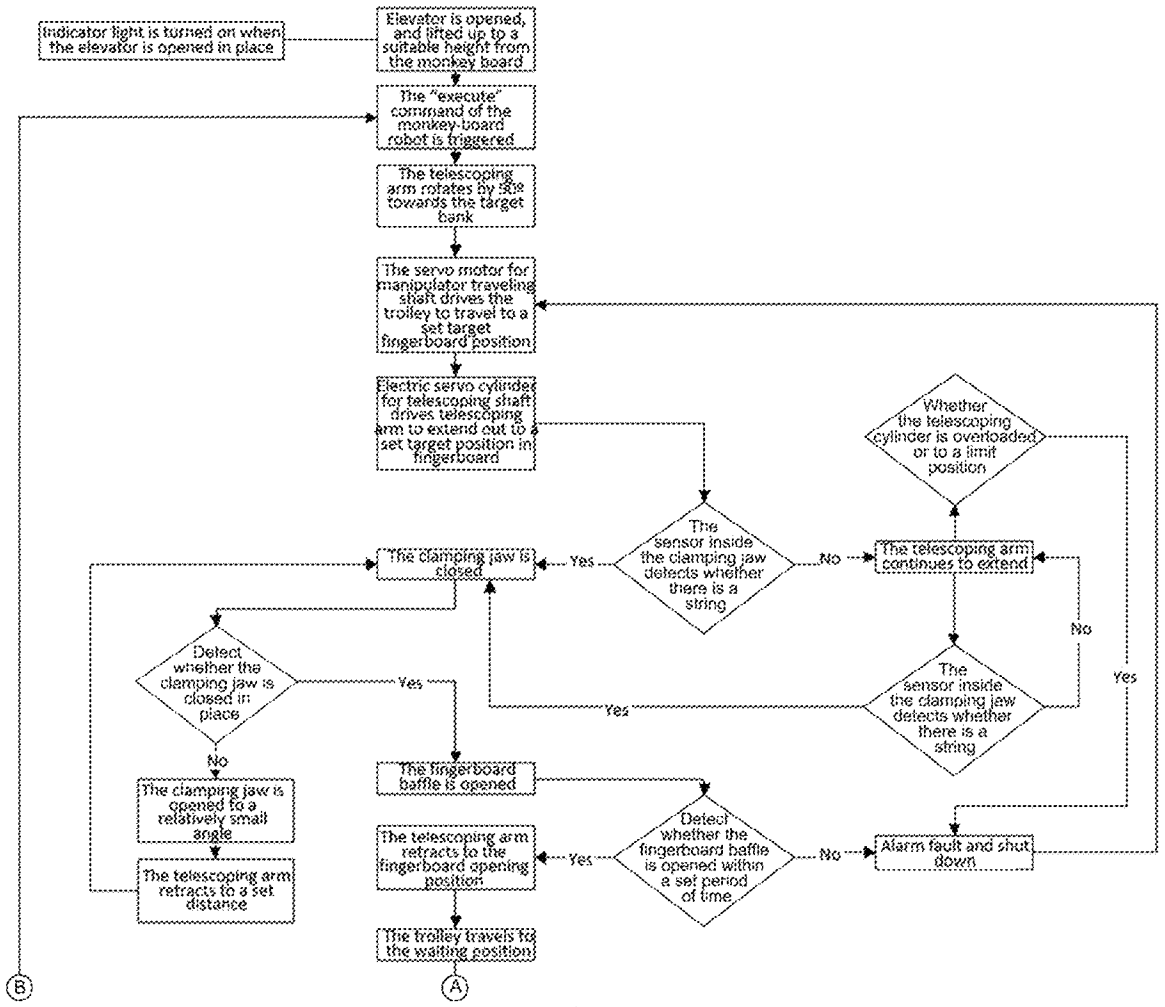
Figure 51B:
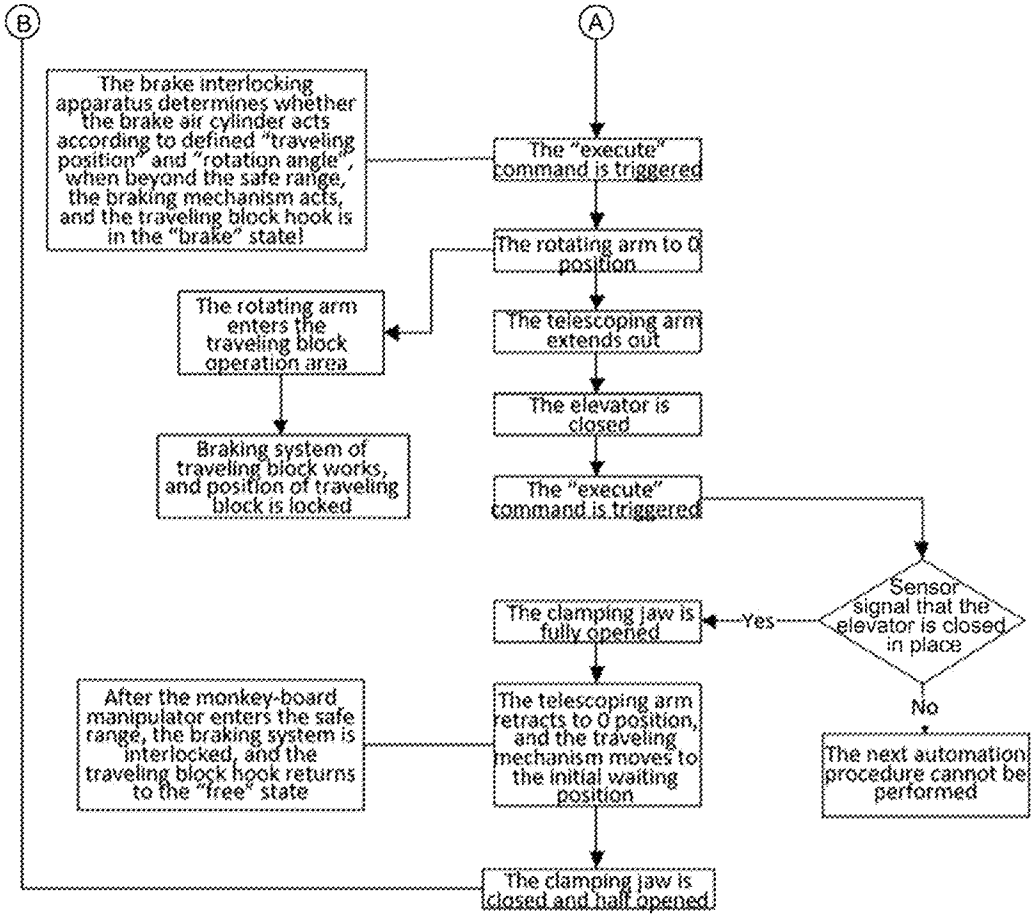
Figure 51C:
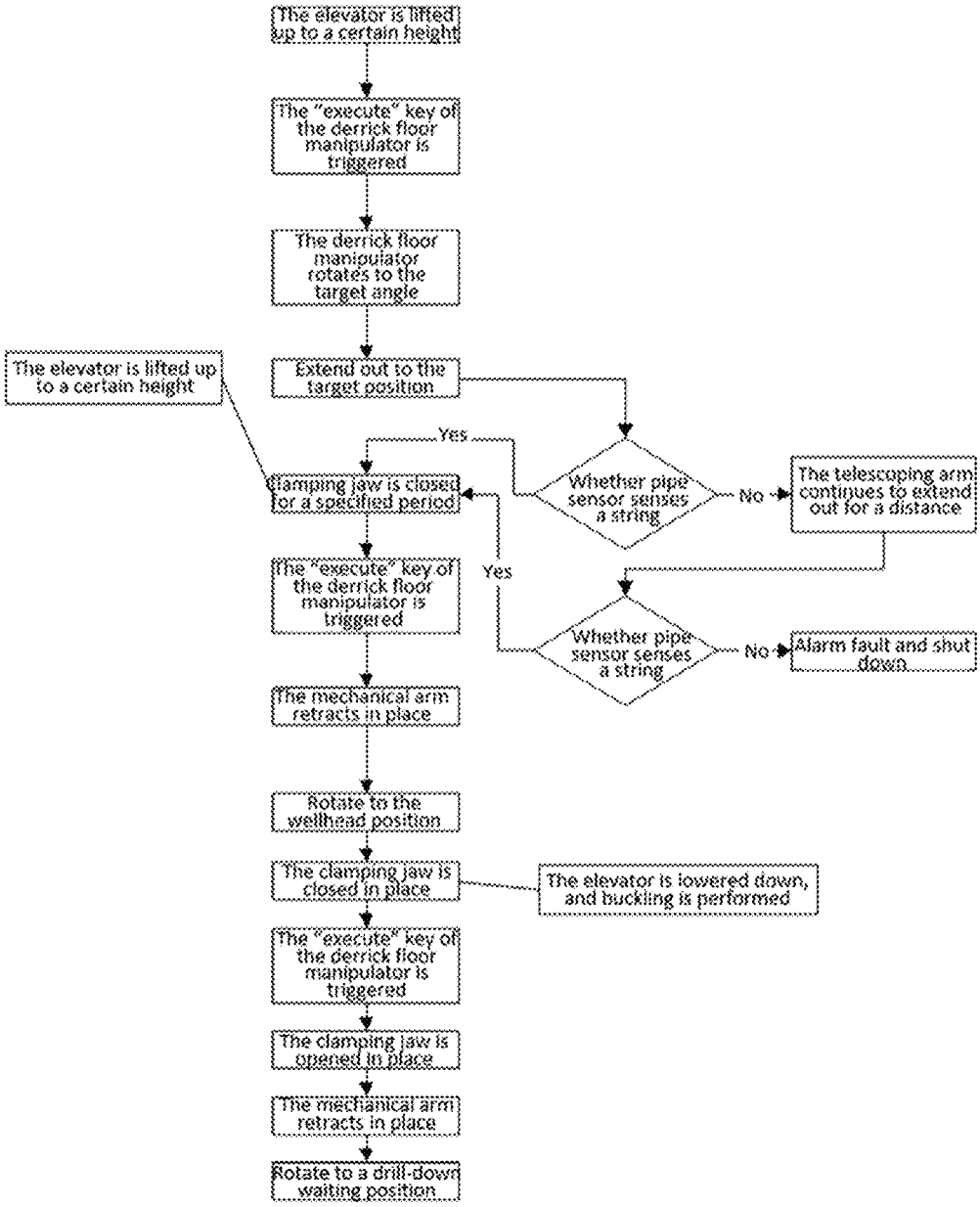
Figure 51D:
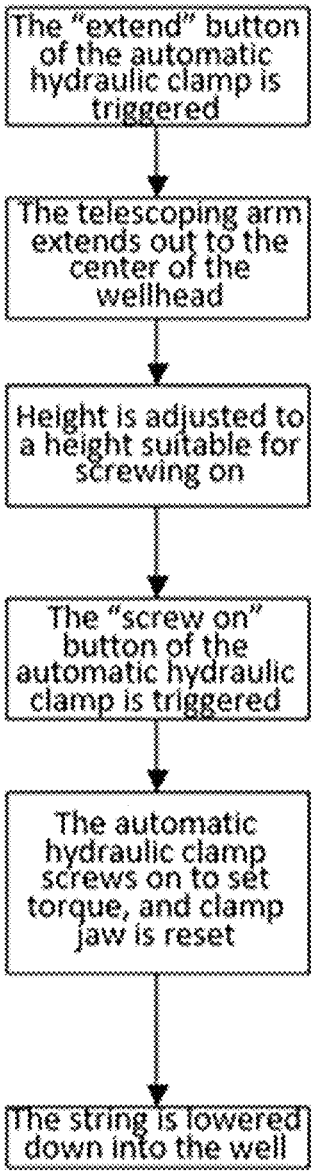

Next, a control procedure of a lifting process of the monkey-board manipulator 50140 of the monkey-board string automatic placement apparatus 50 provided in an embodiment of the present disclosure will be described in detail with reference to FIG. 50. FIG. 50 is a flowchart of the control procedure of the lifting process of the monkey-board manipulator 50140 of the monkey-board string automatic placement apparatus 50 provided in an embodiment of the present disclosure.

As shown in FIG. 50, during the lifting operation of the string 1000, after the first end portion of the string 1000 is placed into the string storage portion 20130, the telescoping arm of the monkey-board manipulator 50140 extends out (meanwhile, the rotating arm enters a traveling block operation area, a braking system of the traveling block works, and a position of the traveling block is locked) and makes a traveling apparatus to move for a certain distance towards the direction of the wellhead. After that, the sensor in the clamping jaw of the monkey-board manipulator 50140 detects whether the string 1000 exists, and when the string 1000 exists, the clamping jaw is closed. When the string 1000 does not exist, the telescoping arm of the monkey-board manipulator 50140 continues to extend out, and after the telescoping arm extends out for a distance, the sensor in the clamping jaw continues to detect whether the string 1000 exists, and if not, this action continues to be performed. When the telescoping arm of the monkey-board manipulator 50140 extends out, it is judged whether a telescoping cylinder is overloaded and whether the telescoping arm extends to a limit position, and if so, a fault alarm indication is sent. When the clamping claw is closed, it is detected whether a gripper is closed in place, and if the gripper is not closed in place, the gripper is opened to a set small angle, and the telescoping arm retracts to a set distance. If it is detected that the gripper is closed in place, the elevator 40 is opened. It is detected whether the elevator 40 is opened in place, if a sensor signal indicating that the elevator is opened in place is not received, it cannot enter the next automation procedure, if the signal is received, the telescoping arm of the monkey-board manipulator 50140 retracts, and then the telescoping arm rotates by 90° (meanwhile, after a monkey-board robot enters a safe range, an air cylinder in a brake starts to act, and the traveling block hook returns to a free state). Then, a traveling mechanism moves to travel to a pre-set fingerboard position, and after the traveling mechanism reaches the pre-set fingerboard position, the fingerboard baffle is opened, and at this time, whether the baffle is opened in place is detected, if a sensor signal that the baffle is opened in place is not received, a fault alarm is sent out after pre-set N seconds, and if the signal is received, the telescoping arm of the monkey-board manipulator 50140 extends out to a pre-set pipe arranging position. When the telescoping arm reaches the pre-set pipe arranging position, the clamping jaw is opened to a half opened position so as to release the string 1000. After that, the telescoping arm retracts to 0 position, and the robot travels to an initial waiting position.

Next, a control procedure of the lowering operation of the string 1000 realized by the automated equipment 1 for drilling and workover operations of oil field provided in an embodiment of the present disclosure will be described in detail with reference to FIG. 51A, FIG. 51B, FIG. 51C and FIG. 51D. FIG. 51A, FIG. 51B, FIG. 51C and FIG. 51D show flowcharts of realizing the lowering operation of the string 1000 by the automated equipment for drilling and workover operations of oil field provided in an embodiment of the present disclosure.

As shown in FIG. 51A, FIG. 51B, FIG. 51C and FIG. 51D, the lowering operation of the string 1000 may include the following steps.

Preparation (FIG. 51A): preparation before drill-down is performed (operation can be performed through a control panel, a switch "panel" is selected, "drill down" is selected for procedure switch, "corresponding specification selection" is selected for specification switch) to initialize the automated equipment 1 into a preparation state as shown in FIG. 3B, so that the monkey-board manipulator 50140 is initialized, wherein the telescoping arm retracts to 0 position, the telescoping arm rotates to 0 position, the clamping jaw is closed and then half opened, and the robot moves to the initial waiting position; the clamping jaw of the derrick floor pipe handling manipulator 90 is opened in place, the mechanical arm of the derrick floor pipe handling manipulator 90 retracts in place, the derrick floor pipe handling manipulator 90 rotates back to zero, and meanwhile a traveling shaft travels to an operation position; and the integrated hydraulic clamp 700 is reset in place, the telescoping arm of the integrated hydraulic clamp 700 retracts in place, and the automatic screwing on and off apparatus 70400 rotates to the wellhead position for waiting (jaw plate and clamp teeth corresponding to the specification of the string 1000 are replaced for the screwing on and off apparatus 70400; manual "screw on/screw off" switch for clamp head is turned to "screw on"; and parameters corresponding to the specification of the string are selected).

Taking out the string (FIG. 51B): after the initialization of the automated equipment 1 is completed, the elevator 40 is opened and is lifted up to an appropriate height from the monkey board (indicator light is turned on when the elevator is opened in place), the telescoping arm rotates by 90° towards the target fingerboard bank, and a servo motor of manipulator traveling shaft drives the trolley to travel to a set target fingerboard position, a telescoping-shaft electric servo cylinder drives the telescoping arm to extend out to a set target position in the fingerboard, and the sensor in the clamping jaw detects whether a string exists, which detection process is similar to that described above with reference to FIG. 50 and will not be repeated again. When the clamping jaw is closed in place, the fingerboard baffle is opened, and it is detected whether the fingerboard baffle remains opened within pre-set time, if not, a fault alarm is sent and machine is stopped, and if so, the telescoping arm retracts to a fingerboard opening position, and the trolley travels to the waiting position, after that, the rotating arm returns to 0 position and enters the traveling block operation area, the telescoping arm extends out, and the elevator 40 is closed to clamp the string 1000, then the clamping jaw is fully opened, the telescoping arm returns to 0 position and a traveling structure moves to the initial waiting position, and the clamping jaw is closed and then half opened.

Conveying the string (FIG. 51C): the derrick floor pipe handling manipulator 90 rotates to a target angle to reach the back position facing back to the slip 60, the derrick floor pipe handling manipulator 90 extends out to a target position, and at this time, it is detected whether a string exists, which detection process is similar to that described above with reference to FIG. 49, and will not be repeated again. When it is detected that a string exists, the clamping jaw is closed for a specified period of time, during which time the elevator 40 lifts up the string 1000 for a certain height so as to make the first end portion of the string 1000 move away from the string storage portion 20130, after that the mechanical arm of the derrick floor pipe handling manipulator 90 retracts in place and rotates to the wellhead position, i.e., the facing position facing the slip 60, the mechanical arm extends out so as to convey the string 1000 to the buckling apparatus 80, after that, the clamping jaw is opened so as to release the string 1000, the mechanical arm retracts in place and rotates to a drill-down waiting position, after the strings 1000 are buckled by the buckling apparatus 80, the elevator 40 lowers down the string 1000, so that the string 1000 comes into contact with the collar at the slip 60.

Screwing on the string (FIG. 51D): after the string 1000 is located at the slip 60, the integrated hydraulic clamp 700 is started, the telescoping arm of the integrated hydraulic clamp 700 extends out to the center of the wellhead, the height of the integrated hydraulic clamp 700 is adjusted to a height suitable for screwing on, then the integrated hydraulic clamp 700 screws on the string 1000 to set torque, and after the screwing on is completed, the integrated hydraulic clamp 700 is reset.

Lowering down the string (FIG. 51D): after the string 1000 is screwed on, the slip 60 is opened, and the elevator 40 lowers the string 1000 down into the well, completing the lowering operation of the string 1000.

Finally, it should be indicated that the various embodiments above are merely used for illustrating the technical solutions of the present disclosure, rather than limiting the present disclosure; while the detailed description is made to the present disclosure with reference to various preceding embodiments, those ordinarily skilled in the art should understand that they still could modify the technical solutions recited in various preceding embodiments, or make equivalent substitutions to some or all of the technical features therein; and these modifications or substitutions do not make the essence of the corresponding technical solutions depart from the scope of the technical solutions of the various embodiments of the present disclosure.

INDUSTRIAL APPLICABILITY

The present disclosure discloses the automated equipment for drilling and workover operations of oil field, and the oil field workover operation device, the integrated hydraulic clamp, the buckling apparatus and the string automated operating apparatus, and the derrick floor pipe handling manipulator for use in the automated equipment. The automated equipment includes the workover rig, the derrick floor, the elevator, the monkey-board string automatic placement apparatus, the slip, the oil field workover operation device, the power clamp, and the derrick floor pipe handling manipulator, and the lifting operation and the lowering operation of the string at the wellhead is realized through the cooperation of the workover rig, the derrick floor, the elevator, the monkey-board string automatic placement apparatus, the slip, the oil field workover operation device, the power clamp, and the derrick floor pipe handling manipulator. The workover rig has the derrick, the workover rig is arranged along the front-rear direction of the automated equipment, and the derrick is provided at the rear end portion of the workover rig and is aligned with the wellhead. The derrick floor is disposed on the ground and at the wellhead, and the derrick floor is provided adjacent to the derrick. The oil field workover operation device is positioned on one side of the wellhead in the left-right direction of the automated equipment, and the oil field workover operation device is provided on the derrick floor in such a manner of being movable between the raised position where the oil field workover operation device extends out above the derrick floor and the retreated position where the oil field workover operation device retreats below the derrick floor. The automated equipment in the present disclosure significantly improves the operation efficiency of the drilling and workover operations, greatly reduces the manual operation strength, and improves the safety factor.

In addition, it should be understood that, the automated equipment for drilling and workover operations of oil field, and the oil field workover operation device, the integrated hydraulic clamp, the buckling apparatus and the string automated operating apparatus, and the derrick floor pipe handling manipulator for use in the automated equipment in the present disclosure are reproducible, and can be applied in a variety of industrial applications. For example, the automated equipment for drilling and workover operations of oil field, and the oil field workover operation device, the integrated hydraulic clamp, the buckling apparatus and the string automated operating apparatus, and the derrick floor pipe handling manipulator for use in the automated equipment can be used in the technical field of drilling and workover operations of oil field.

What is claimed is:

1. An automated equipment for drilling and workover operations of oil field, the automated equipment comprising:

a workover rig, a derrick floor, an elevator, a monkey-board string automatic placement apparatus, a slip, an oil field workover operation device, a power clamp, and a derrick floor pipe handling manipulator, wherein the workover rig, the derrick floor, the elevator, the monkey-board string automatic placement apparatus, the slip, the oil field workover operation device, the power clamp, and the derrick floor pipe handling manipulator cooperate with each other to realize a lifting operation and a lowering operation of a string at a wellhead, and wherein the workover rig has a derrick, the workover rig is arranged along a front-rear direction of the automated equipment, and the derrick is disposed at a rear end portion of the workover rig and aligned with the wellhead;

the derrick floor is placed on a ground and disposed at the wellhead, and the derrick floor is disposed adjacent to the derrick; and the oil field workover operation device is positioned on one side of the wellhead in a left-right direction of the automated equipment, and the oil field workover operation device is disposed on the derrick floor in a manner of being movable between a raised position where the oil field workover operation device extends out above the derrick floor and a retreated position where the oil field workover operation device retreats below the derrick floor.

2. The automated equipment according to claim 1, wherein in the raised position of the oil field workover operation device, the oil field workover operation device is movable between an extended state and a retracted state, in the extended state of the oil field workover operation device, the power clamp connected to the oil field workover operation device is positioned close to the wellhead so as to screw on and off the string positioned at the wellhead, and in the retracted state of the oil field workover operation device, the power clamp connected to the oil field workover operation device is positioned away from the wellhead, and in the retreated position of the oil field workover operation device, the oil field workover operation device is in the retracted state of the oil field workover operation device.

3. The automated equipment according to claim 1, wherein the derrick floor is provided thereon with a string storage portion for receiving the string, the derrick floor pipe handling manipulator is movable between a first position away from the slip and a second position close to the slip, and in the second position of the derrick floor pipe handling manipulator, the derrick floor pipe handling manipulator is configured to grab the string, and the derrick floor pipe handling manipulator is rotatable between a facing position facing the slip and a back position facing back to the slip, and in the facing position of the derrick floor pipe handling manipulator, the derrick floor pipe handling manipulator is configured to grab the string located at the slip, and in the back position of the derrick floor pipe handling manipulator, the derrick floor pipe handling manipulator is configured to grab the string located at the string storage portion.

4. The automated equipment according to claim 1, wherein the monkey-board string automatic placement apparatus comprises a fingerboard bank for receiving the string, the monkey-board string automatic placement apparatus further comprises a monkey-board manipulator, and the monkey-board manipulator is configured to push the string into the fingerboard bank or take the string from the fingerboard bank.

5. The automated equipment according to claim 1, further comprising an integrated hydraulic clamp, wherein the integrated hydraulic clamp comprises:

a hydraulic clamp body, a floating deflection device, and a movable bracket; and the floating deflection device is connected to the movable bracket, and the hydraulic clamp body is mounted on the floating deflection device.

6. The automated equipment according to claim 5, wherein the floating deflection device comprises: a floating mounting frame and a spring sleeve, one end of the spring sleeve is connected to the movable bracket, the other end of the spring sleeve is connected to the floating mounting frame, and the hydraulic clamp body is mounted on the floating mounting frame.

7. The automated equipment according to claim 6, wherein the floating deflection device further comprises a floating barrel fixing seat, the floating barrel fixing seat is mounted on the movable bracket, and the floating mounting frame is slidably connected to the floating barrel fixing seat.

8. The automated equipment according to claim 7, wherein a tackle is mounted on the floating mounting frame, the tackle is fitted to the floating barrel fixing seat, and the tackle rolls along the floating barrel fixing seat.

9. The automated equipment according to claim 7, wherein a top portion of the hydraulic clamp body is hinged with the floating mounting frame, and a tension spring is disposed between the hydraulic clamp body and the floating barrel fixing seat.

10. The automated equipment according to claim 7, wherein the spring sleeve is connected to the floating mounting frame through a pin shaft, and the pin shaft is slidably connected to the floating barrel fixing seat.

11. The automated equipment according to claim 7, wherein the floating barrel fixing seat comprises: a sliding frame and a stand column, the sliding frame is mounted in a top portion of the stand column, the floating mounting frame is slidably connected to the sliding frame, and the stand column is provided with a chamber for accommodating the spring sleeve.

12. The automated equipment according to claim 1, further comprising a buckling apparatus, wherein the buckling apparatus comprises:

a slip component, a drive member, and a pipe centralizing component; and the pipe centralizing component is movably connected to the slip component, the drive member is connected to the slip component and is in transmission connection with the pipe centralizing component, and the drive member is configured to drive the pipe centralizing component, so that an axis of a string in the pipe centralizing component coincides with an axis of a string fixed in the slip component.

13. The automated equipment according to claim 12, wherein the pipe centralizing component comprises a pipe centralizing arm and a pipe centralizing hand;

the pipe centralizing arm is movably connected to the slip component and is in transmission connection with the drive member, and the pipe centralizing hand is connected to one end of the pipe centralizing arm away from the drive member, for guiding buckling of strings.

14. The automated equipment according to claim 13, wherein the pipe centralizing arm is rotatably connected to the slip component.

15. The automated equipment according to claim 14, wherein the slip component comprises a fixing seat, the slip, and a positioning plate, and the fixing seat, the slip, and the drive member are all connected to the positioning plate; and the pipe centralizing arm is rotatably connected to the fixing seat through a rotating shaft, and the drive member drives the pipe centralizing arm to rotate around an axis of the rotating shaft.

16. The automated equipment according to claim 15, wherein the pipe centralizing arm comprises a transmission arm and a supporting arm that are connected at an angle; and the transmission arm is rotatably connected to the fixing seat through the rotating shaft, the drive member is in transmission connection with the transmission arm, one end of the transmission arm away from the drive member is connected to one end of the supporting arm, and the other end of the supporting arm is connected to the pipe centralizing hand.

17. The automated equipment according to claim 1, further comprising a derrick floor pipe handling manipulator, wherein the derrick floor pipe handling manipulator comprises:

a trolley feeding mechanism, a base, a rotating mechanism, a boom mechanism, a clamping jaw mechanism, and a first drive member;

the trolley feeding mechanism is slidably connected to the base, the base comprises a first base and a second base, the first base and the second base are detachably connected, the first drive member is connected to the first base and is in transmission connection with the trolley feeding mechanism; and a bottom end of the rotating mechanism is connected to the trolley feeding mechanism, a top end of the rotating mechanism is in transmission connection with the boom mechanism, and a free end of the boom mechanism is connected with the clamping jaw mechanism.

18. The automated equipment according to claim 17, wherein the first base is provided with a first clamping member, the second base is provided with a second clamping member adapted to the first clamping member, and the first base and the second base are connected through a bolt.

19. The automated equipment according to claim 17, wherein the first drive member is a hydraulic cylinder, a cylinder body of the hydraulic cylinder is hinged with the first base, and a drive end of the hydraulic cylinder is hinged with the trolley feeding mechanism.

20. The automated equipment according to claim 17, wherein the clamping jaw mechanism comprises a second drive member, a first link rod, a second link rod, two third link rods, and two curved rods, the two curved rods are in a bent shape, and openings of the two curved rods are disposed oppositely to each other; and the second drive member is mounted on the boom mechanism and is in transmission connection with the first link rod, and two ends of the first link rod are respectively hinged with one end of the two third link rods, the other ends of the two third link rods are correspondingly hinged to bent parts of the two curved rods respectively, the second link rod is connected to the boom mechanism, and two ends of the second link rod are respectively hinged to one end of the two curved rods close to the first link rod, the other ends of the two curved rods move close to or away from each other under driving of the two third link rods, so that the other ends of the two curved rods are in a fully opened state, a half opened and half closed state, or a fully closed state.

* * * * *